US012655717B2

(12) United States Patent
El Mallawany et al.

(10) Patent No.: US 12,655,717 B2
(45) **Date of Patent: *Jun. 16, 2026**

(54) PRODUCTION SUB INCLUDING A FLUID FLOW ASSEMBLY HAVING A PAIR OF RADIAL BURST DISCS

(71) Applicant: Halliburton Energy Services, Inc., Houston, TX (US)

(72) Inventors: Ibrahim El Mallawany, Al-Khobar (SA); Sean Canning, Carrollton, TX (US); Joseph Ray Collins, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/956,487

(22) Filed: Nov. 22, 2024

(65) Prior Publication Data

US 2025/0084728 A1 Mar. 13, 2025

Related U.S. Application Data

(63) Continuation of application No. 17/960,998, filed on Oct. 6, 2022, now Pat. No. 12,163,401.

(51) Int. Cl.

| | |
|---|---|
| ***E21B 34/06*** | (2006.01) |
| ***E21B 33/10*** | (2006.01) |
| ***E21B 43/28*** | (2006.01) |

(52) U.S. Cl.

CPC ..... *E21B 34/063* (2013.01); *E21B 33/10* (2013.01); *E21B 43/28* (2013.01); *E21B 2200/08* (2020.05)

(58) Field of Classification Search

CPC ..... E21B 34/063; E21B 33/10; E21B 43/28

See application file for complete search history.

(56) References Cited

U.S. PATENT DOCUMENTS

| | | | |
|---|---|---|---|
| 9,677,383 | B2 | 6/2017 | Sladic et al. |
| 9,963,953 | B2 | 5/2018 | Lopez |
| 9,995,109 | B2 | 6/2018 | Least et al. |
| 10,280,707 | B2 | 5/2019 | Styler et al. |
| 11,401,778 | B1 | 8/2022 | Saraya |
| 12,163,401 | B2 * | 12/2024 | El Mallawany ..... E21B 33/10 |
| 2007/0039741 | A1 | 2/2007 | Hailey, Jr. |
| 2011/0303420 | A1 | 12/2011 | Thorkildsen et al. |

(Continued)

*Primary Examiner* — Catherine Loikith

(74) *Attorney, Agent, or Firm* — Scott Richardson; Parker Justiss, P.C.

(57) ABSTRACT

The present disclosure, in at least one aspect, provides a production sub, a well system, and a method. The production sub, in one aspect, includes a tubular having a length (l), an inside ID, an OD, and a sidewall thickness (t), a plurality of production ports extending through the sidewall thickness (t) and coupling the inside diameter (ID) and the outside diameter (OD), and a fluid flow assembly positioned in each of the plurality of production ports. Each fluid flow assembly, in one aspect, includes a radially interior burst disc, a radially exterior burst disc, a sealing member positioned in a chamber created between the radially interior burst disc and the radially exterior burst disc, and a sealing member seat located in the chamber proximate the radially exterior burst disc, the sealing member configured to engage with the sealing member seat as fluid is pushing the sealing member radially outward.

26 Claims, 58 Drawing Sheets

(56) References Cited

U.S. PATENT DOCUMENTS

| | | | |
|---|---|---|---|
| 2014/0367116 | A1 | 12/2014 | Lopez |
| 2015/0240584 | A1 | 8/2015 | Desai et al. |
| 2015/0315872 | A1 | 11/2015 | Phi et al. |
| 2017/0254174 | A1 | 9/2017 | Least et al. |
| 2020/0095845 | A1* | 3/2020 | Watkins ..... E21B 33/1208 |
| 2021/0047901 | A1 | 2/2021 | Kuhlman et al. |
| 2022/0065070 | A1 | 3/2022 | Watkins et al. |

* cited by examiner

PRODUCTION SUB INCLUDING A FLUID FLOW ASSEMBLY HAVING A PAIR OF RADIAL BURST DISCS

CROSS-REFERENCE TO RELATED APPLICATION

This application is a continuation of U.S. patent application Ser. No. 17/960,998, entitled "PRODUCTION SUB INCLUDING A FLUID FLOW ASSEMBLY HAVING A PAIR OF RADIAL BURST DISCS", filed on Oct. 6, 2022. The above-listed application is commonly assigned with the present application is incorporated herein by reference as if reproduced herein in its entirety.

BACKGROUND

In cementing casing or liners (both referred to hereinafter as "casing") in wellbores (a process known as primary cementing), a cement slurry is pumped downwardly through the casing to be cemented and then upwardly into the annulus between the casing and the walls of the wellbore. Upon setting, the cement bonds the casing to the walls of the wellbore and restricts fluid movement between formations or zones penetrated by the wellbore. Such a cementing operation is particularly useful and/or necessary in the lateral wellbores of multilateral wells, and particularly at the junction between the lateral wellbores and the main wellbore.

Prior to a primary cementing operation, the casing is suspended in a wellbore (e.g., main wellbore or lateral wellbore) and both the casing and the wellbore are usually filled with drilling fluid. In order to reduce contamination of the cement slurry at the interface between it and the drilling fluid, a displacement plug for sealingly engaging the inner surfaces of the casing may be pumped ahead of the cement slurry whereby the cement slurry is separated from the drilling fluid as the cement slurry and drilling fluid ahead of it are displaced through the casing. The displacement plug wipes the drilling fluid from the walls of the casing and maintains a separation between the cement slurry and drilling fluid until the plug lands on a float collar attached near the bottom end of the casing.

The displacement plug, which precedes the cement slurry and separates it from drilling fluid is referred to herein as the "bottom plug." When the predetermined required quantity of the cement slurry has been pumped into the casing, a second displacement plug, referred to herein as the "top plug", may be released into the casing to separate the cement slurry from additional drilling fluid or other displacement fluid used to displace the cement slurry. In certain situations, the bottom plug is not used, but the top plug is.

When the bottom plug lands on the float collar attached to the casing, a valve mechanism opens which allows the cement slurry to proceed through the plug and the float collar upwardly into the annular space between the casing and the wellbore. The design of the top plug is such that when it lands on the bottom plug it shuts off fluid flow, which prevents the displacement fluid from entering the annulus. After the top plug lands on the bottom plug, the pumping of the displacement fluid into the casing is often continued whereby the casing is pressured up and the casing and associated equipment including the pump are pressure tested for leaks or other defects.

BRIEF DESCRIPTION

Reference is now made to the following descriptions taken in conjunction with the accompanying drawings, in which.

Figure 5A:
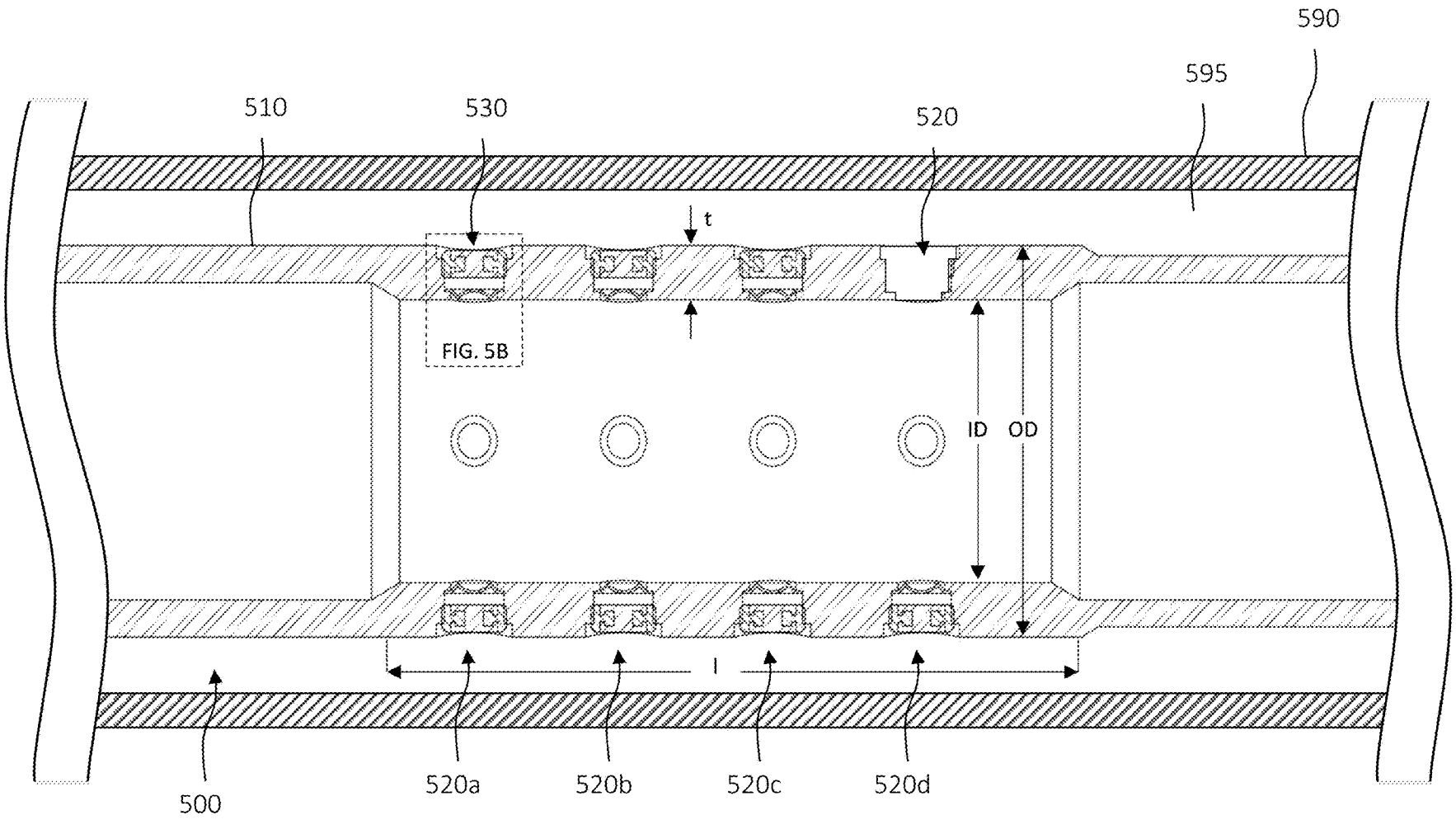
Figure 5B:
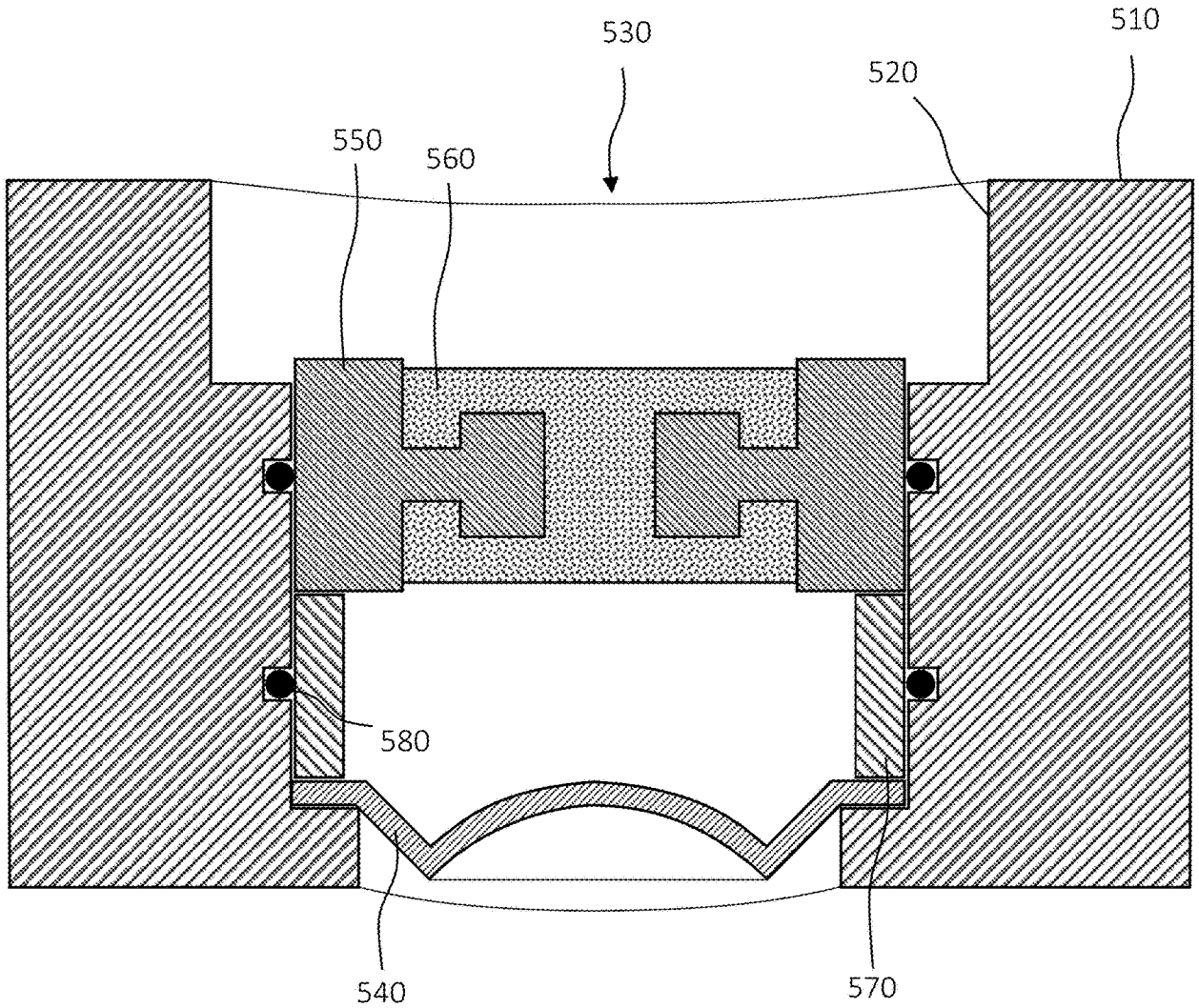
Figure 6A:
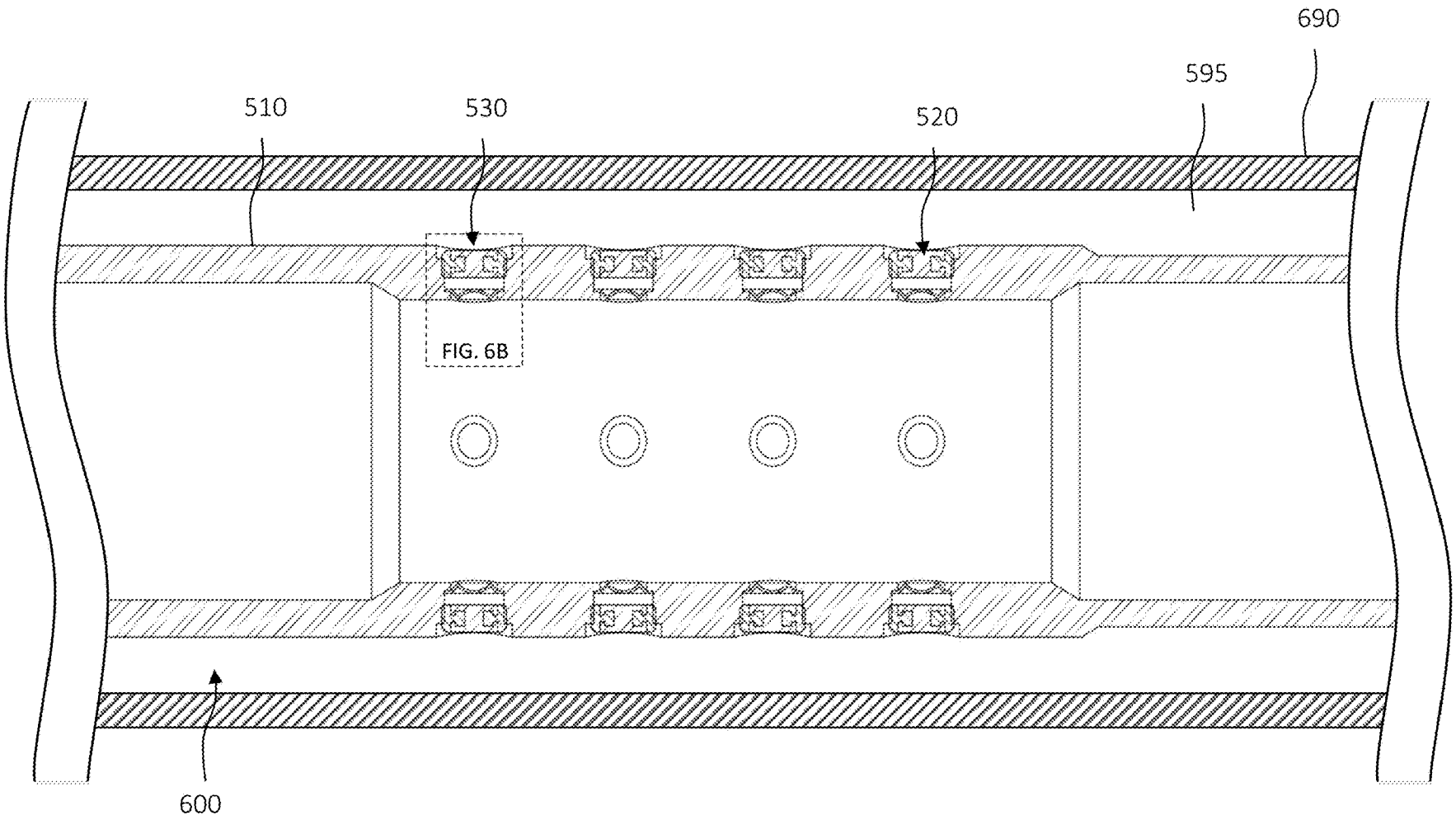
Figure 6B:
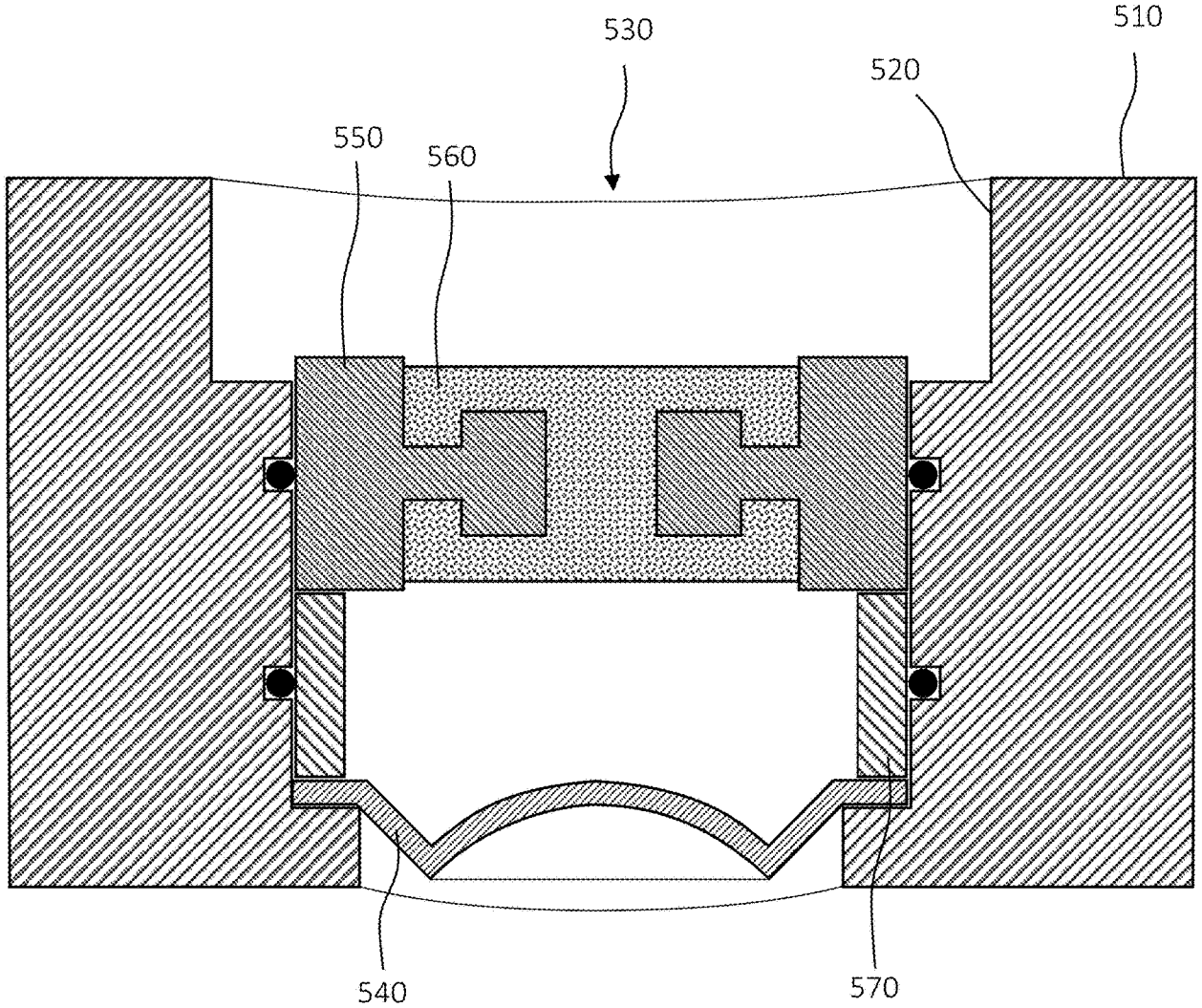
Figure 6C:
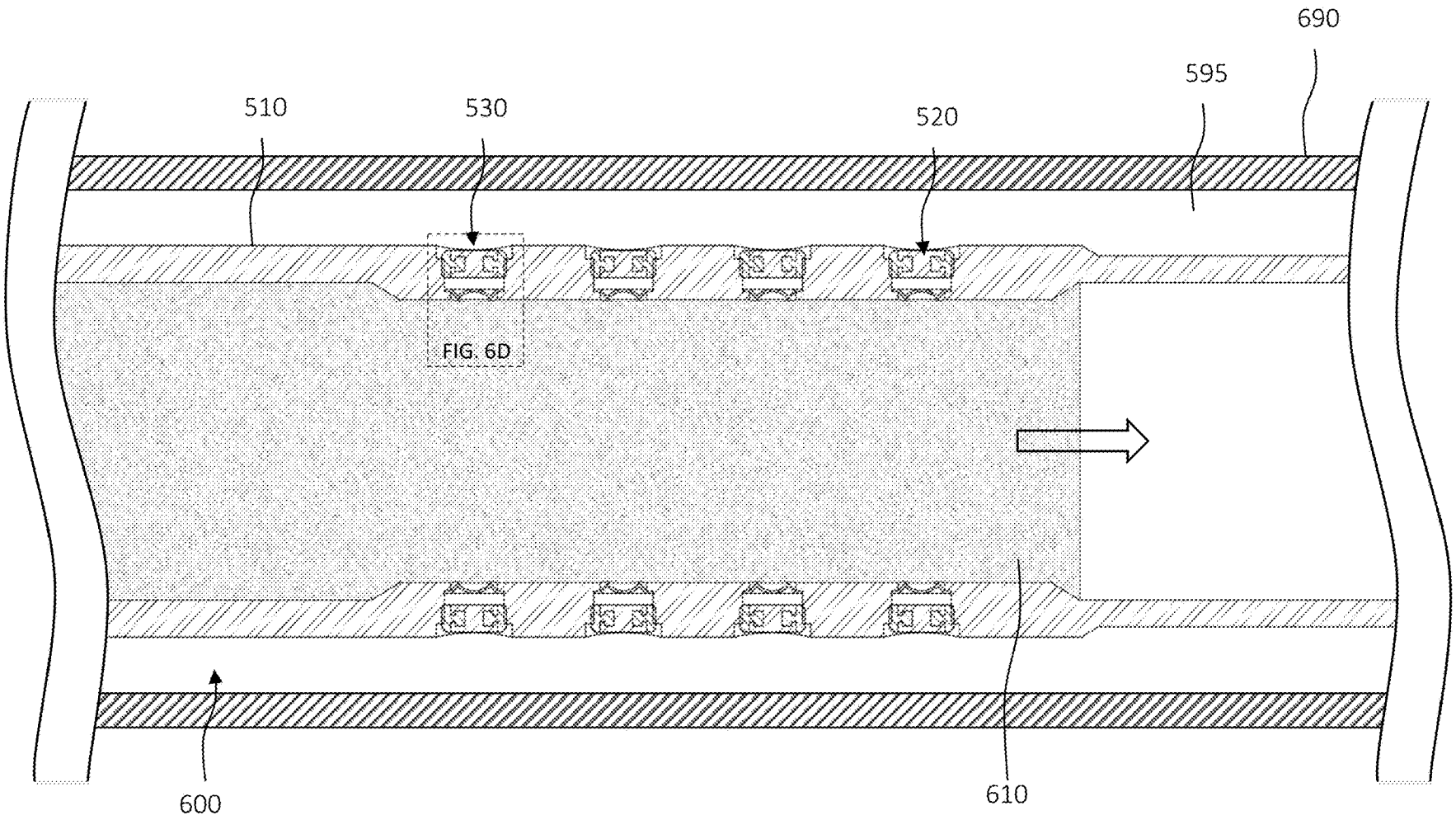
Figure 6D:
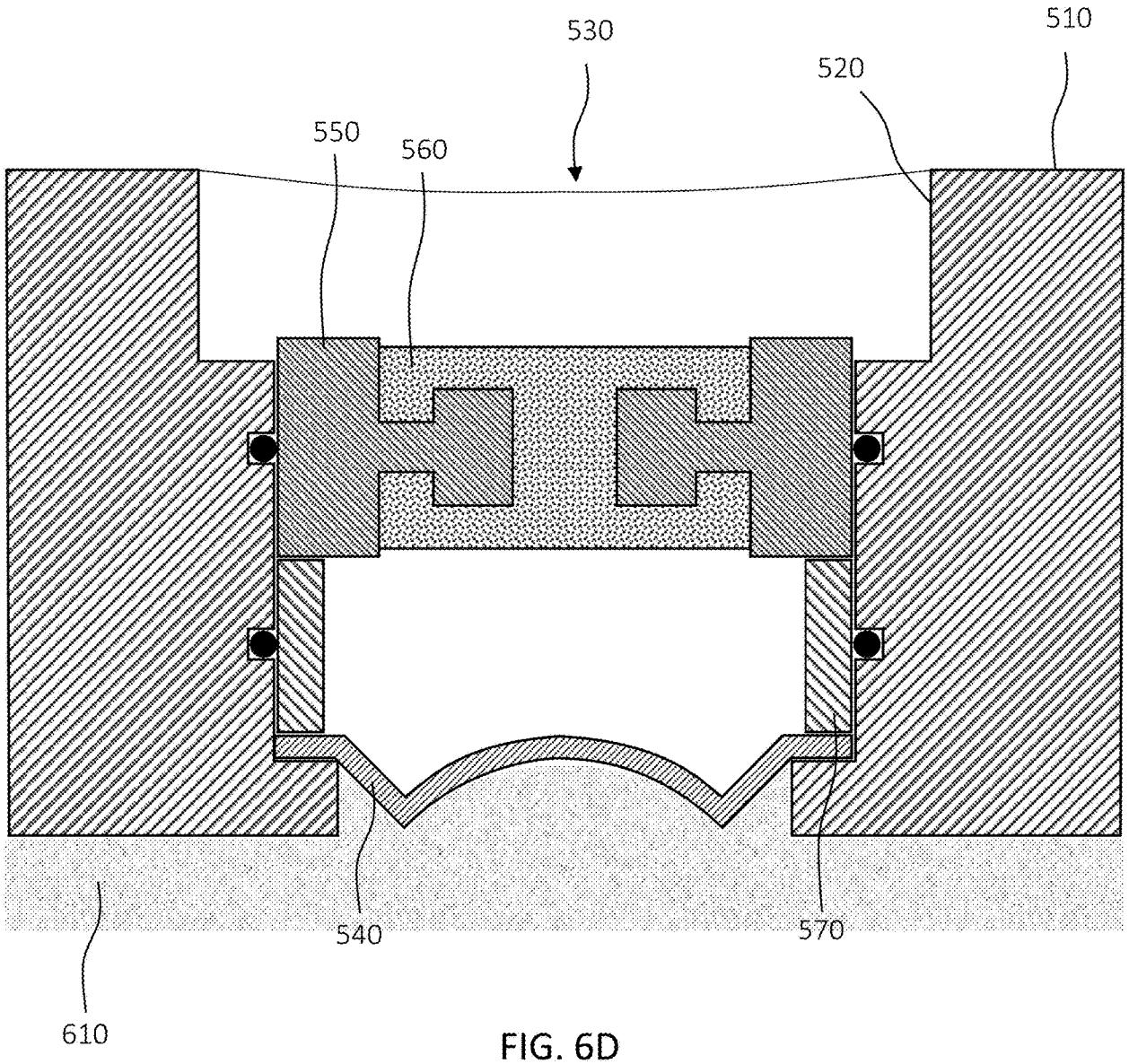
Figure 6E:
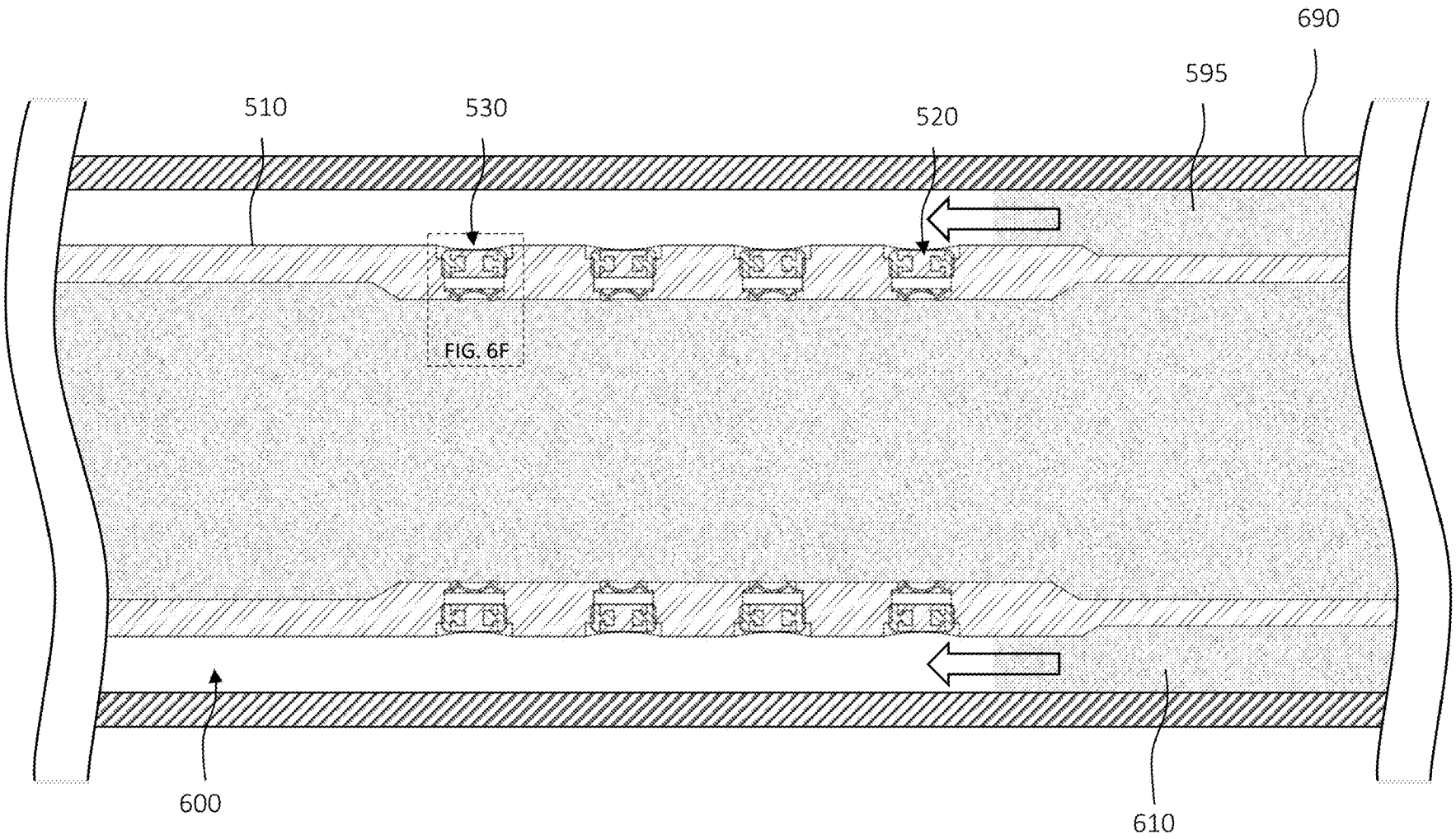
Figure 6F:
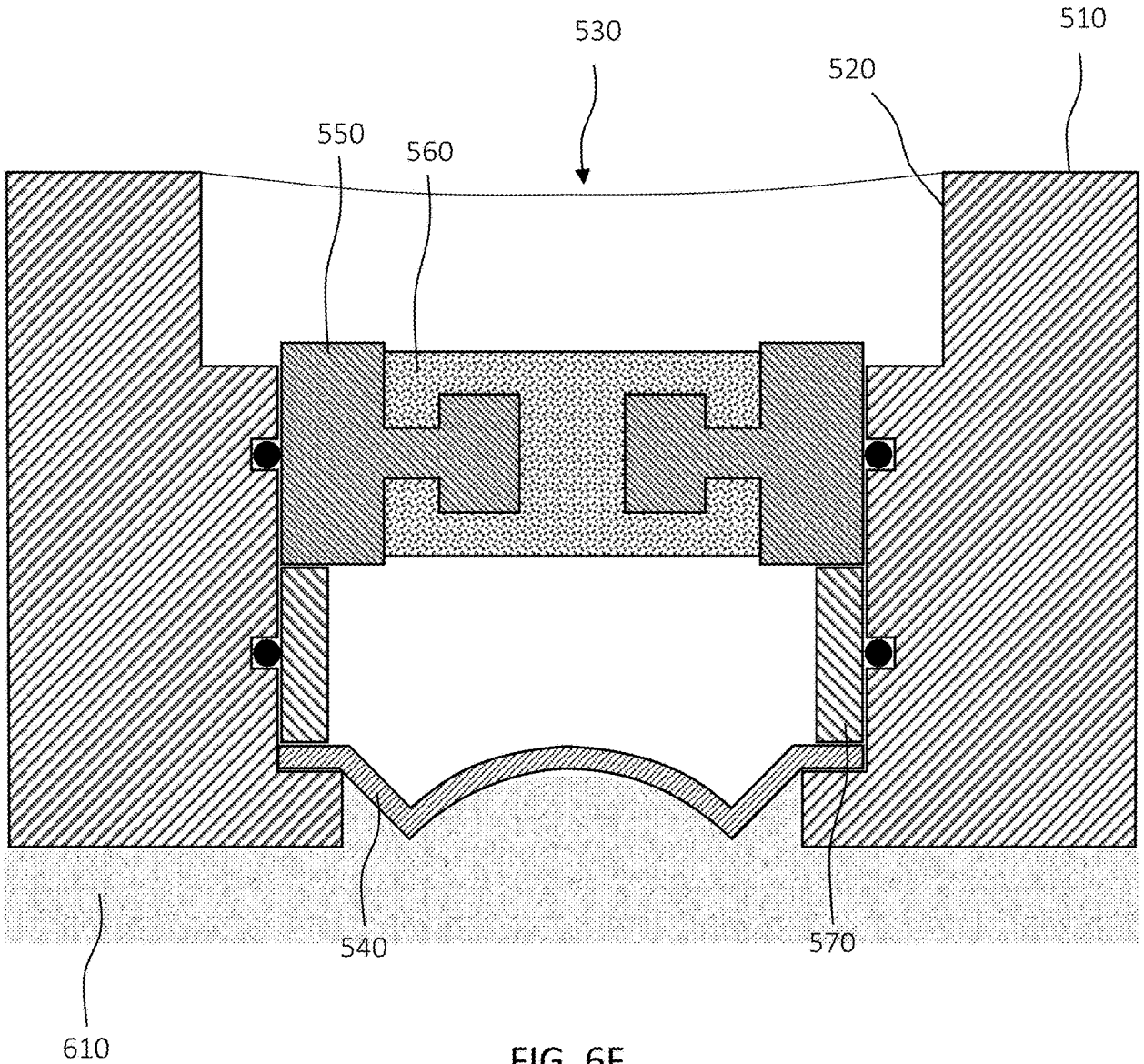
Figure 6G:
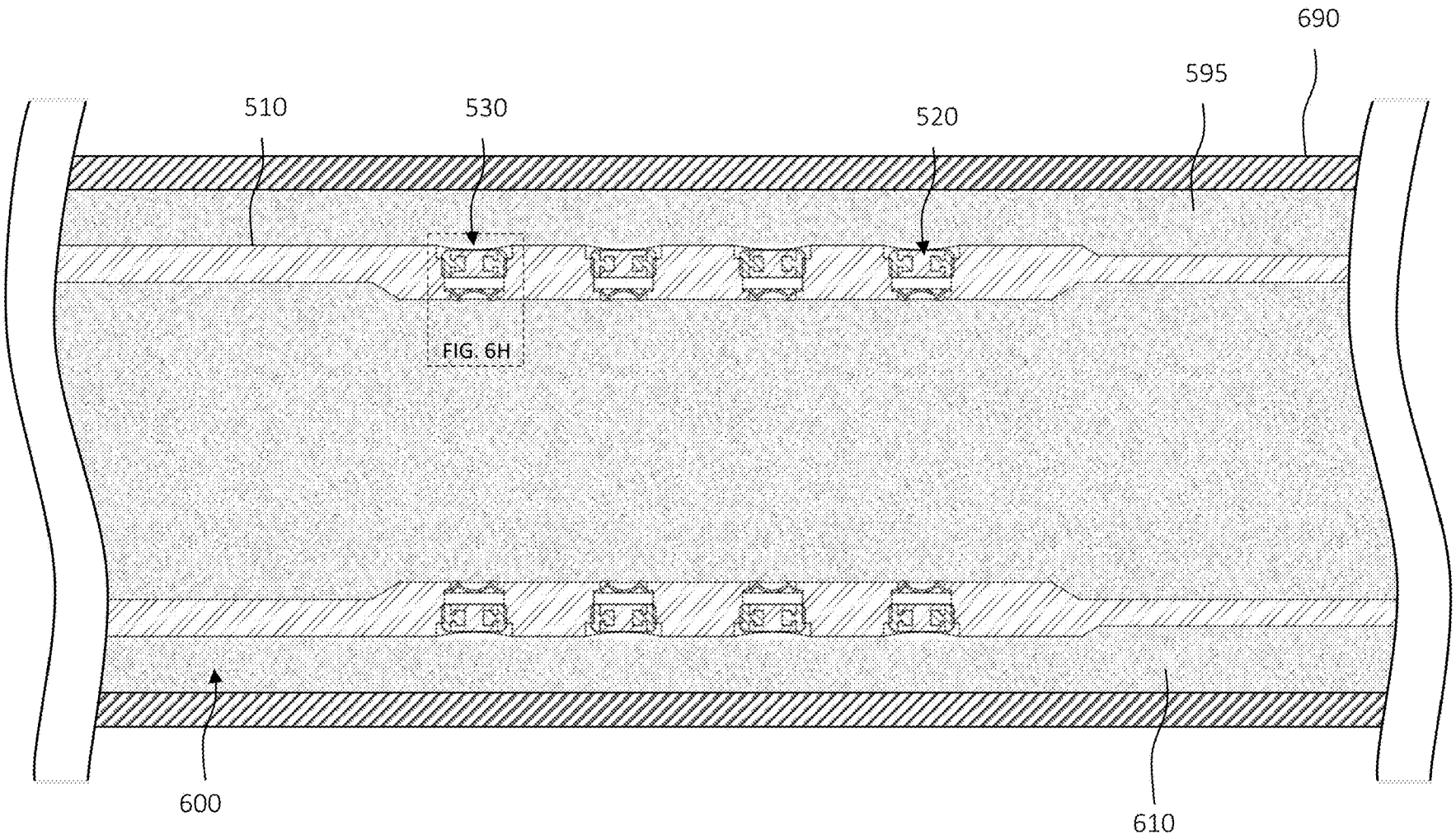
Figure 6H:
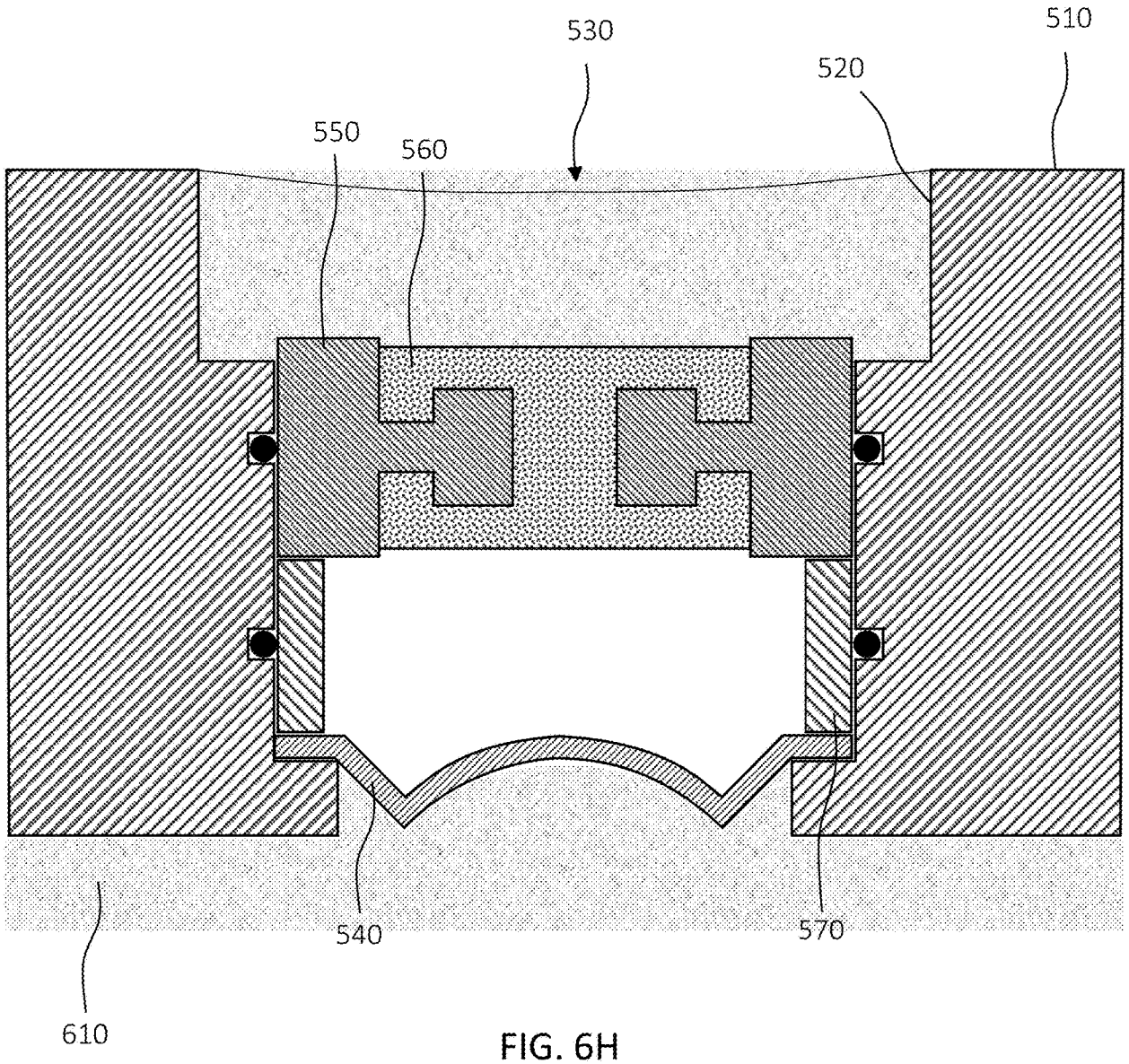
Figure 6I:
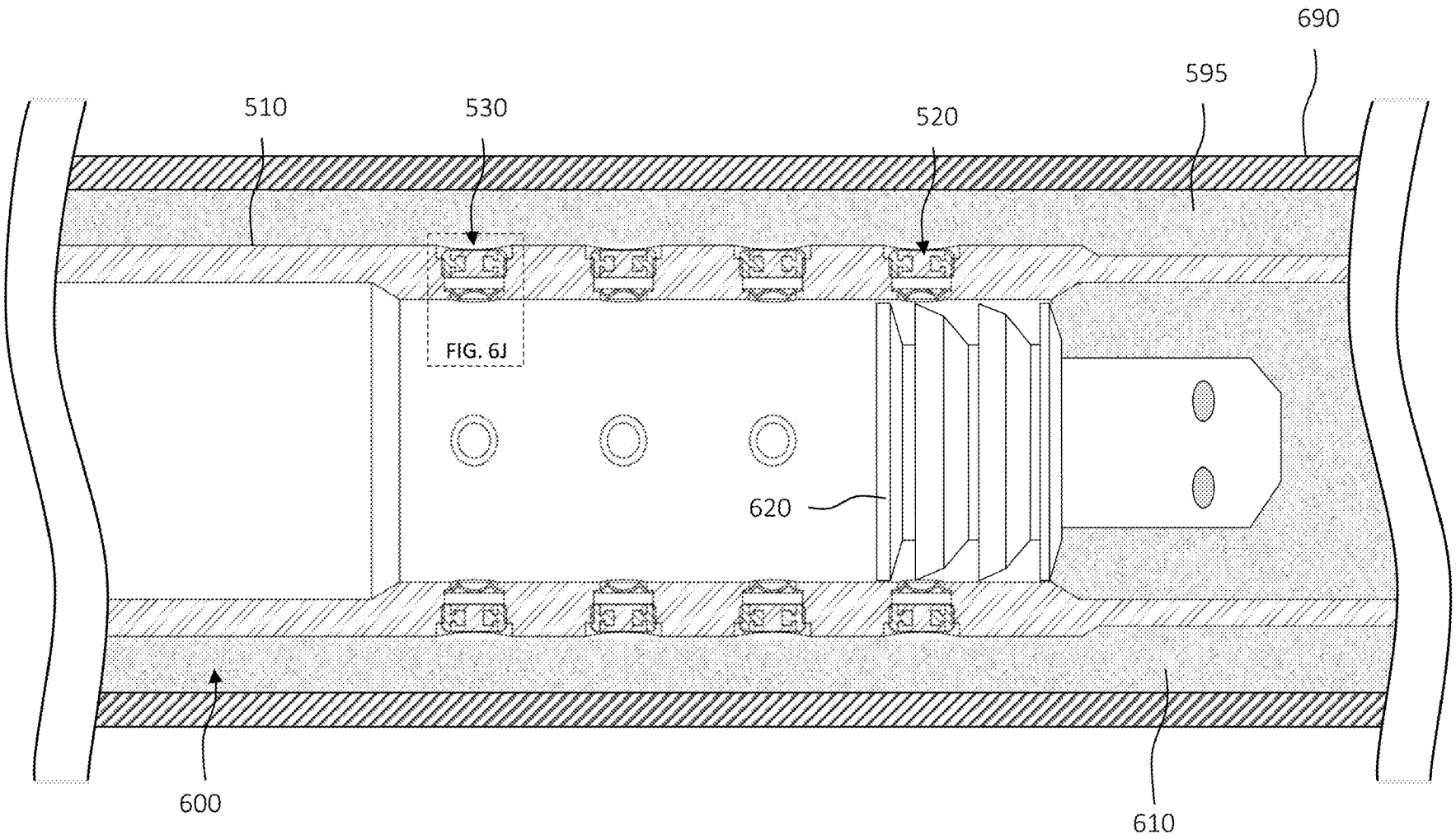
Figure 6J:
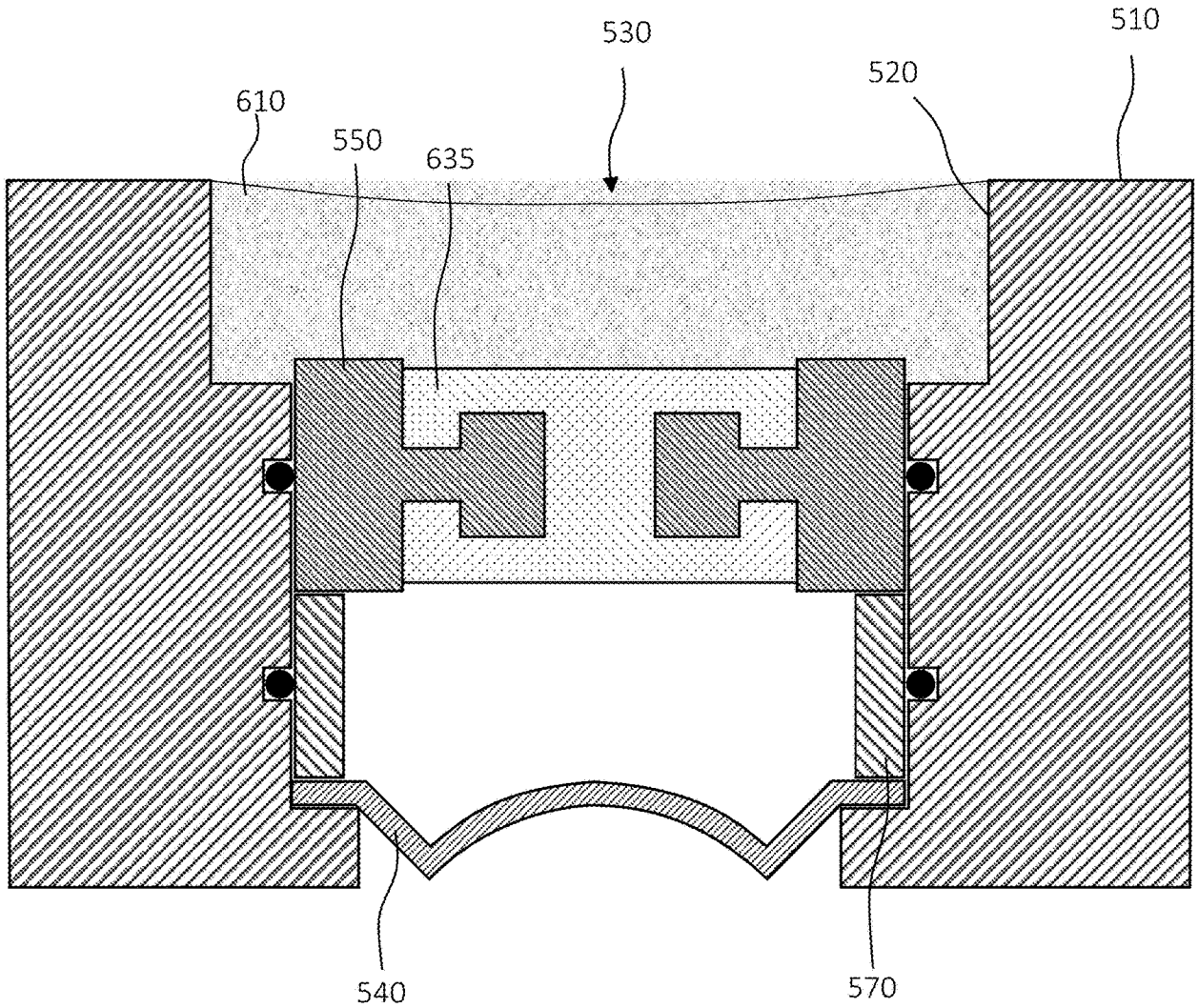
Figure 6K:
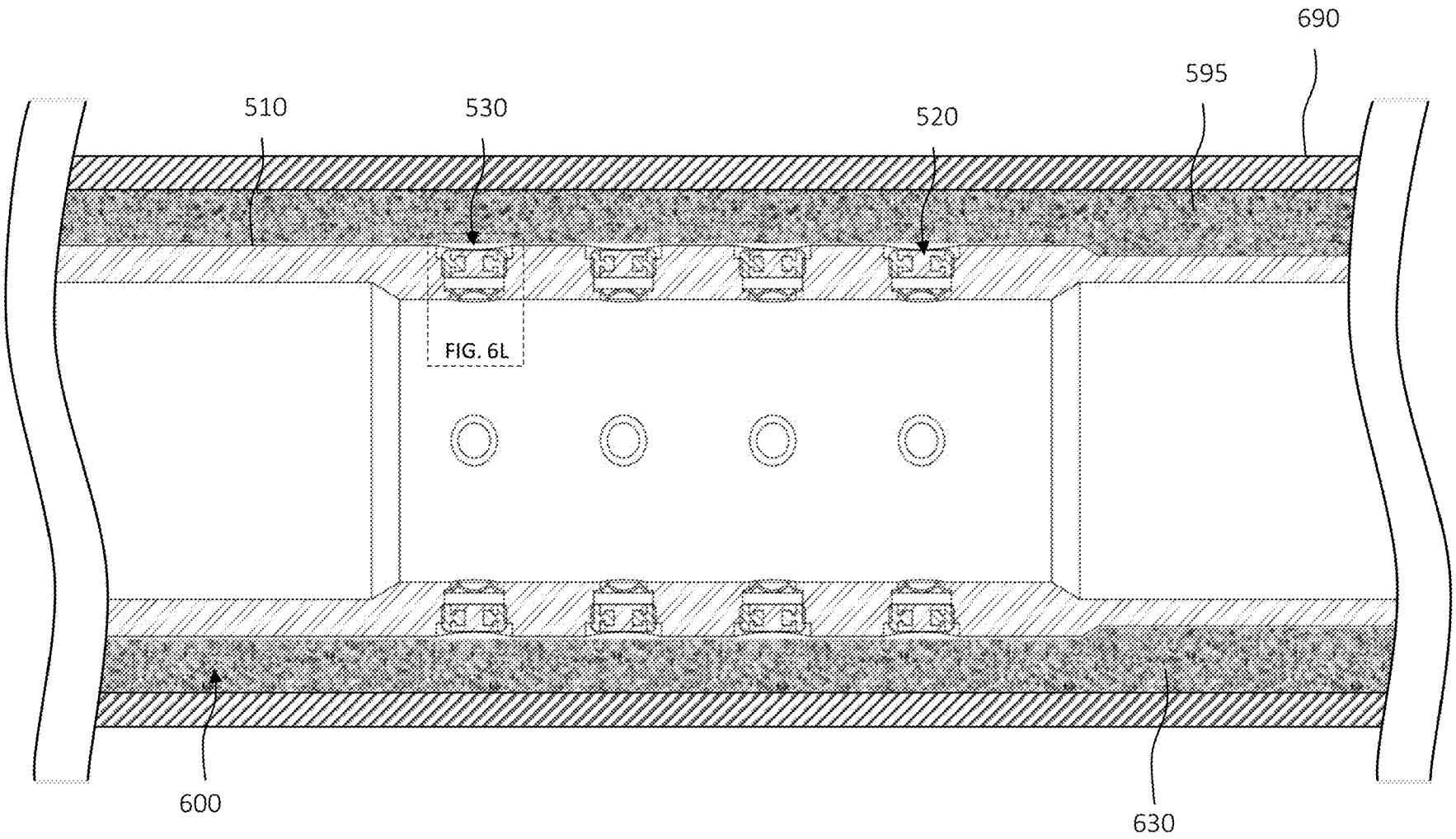
Figure 6L:
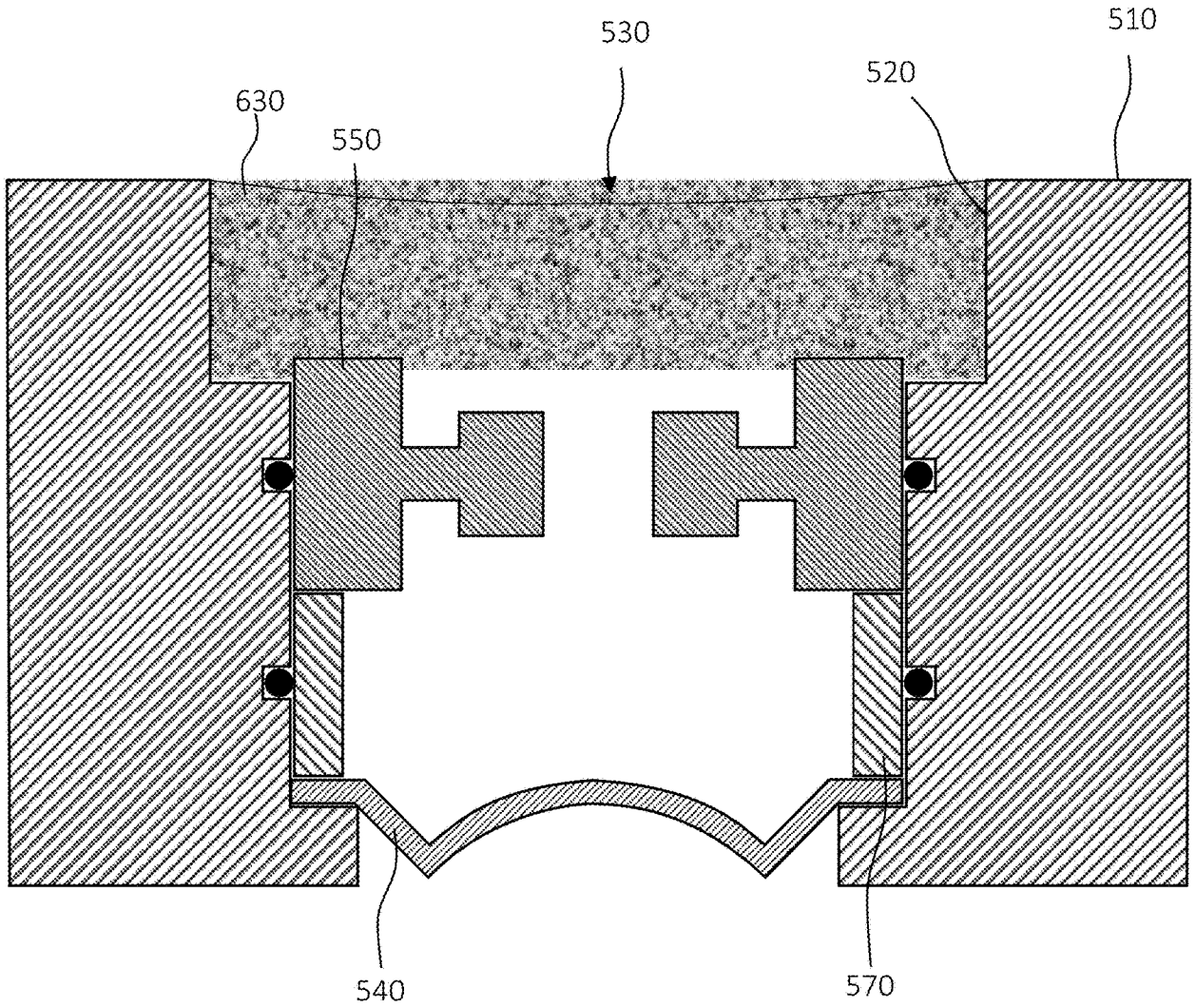
Figure 6M:
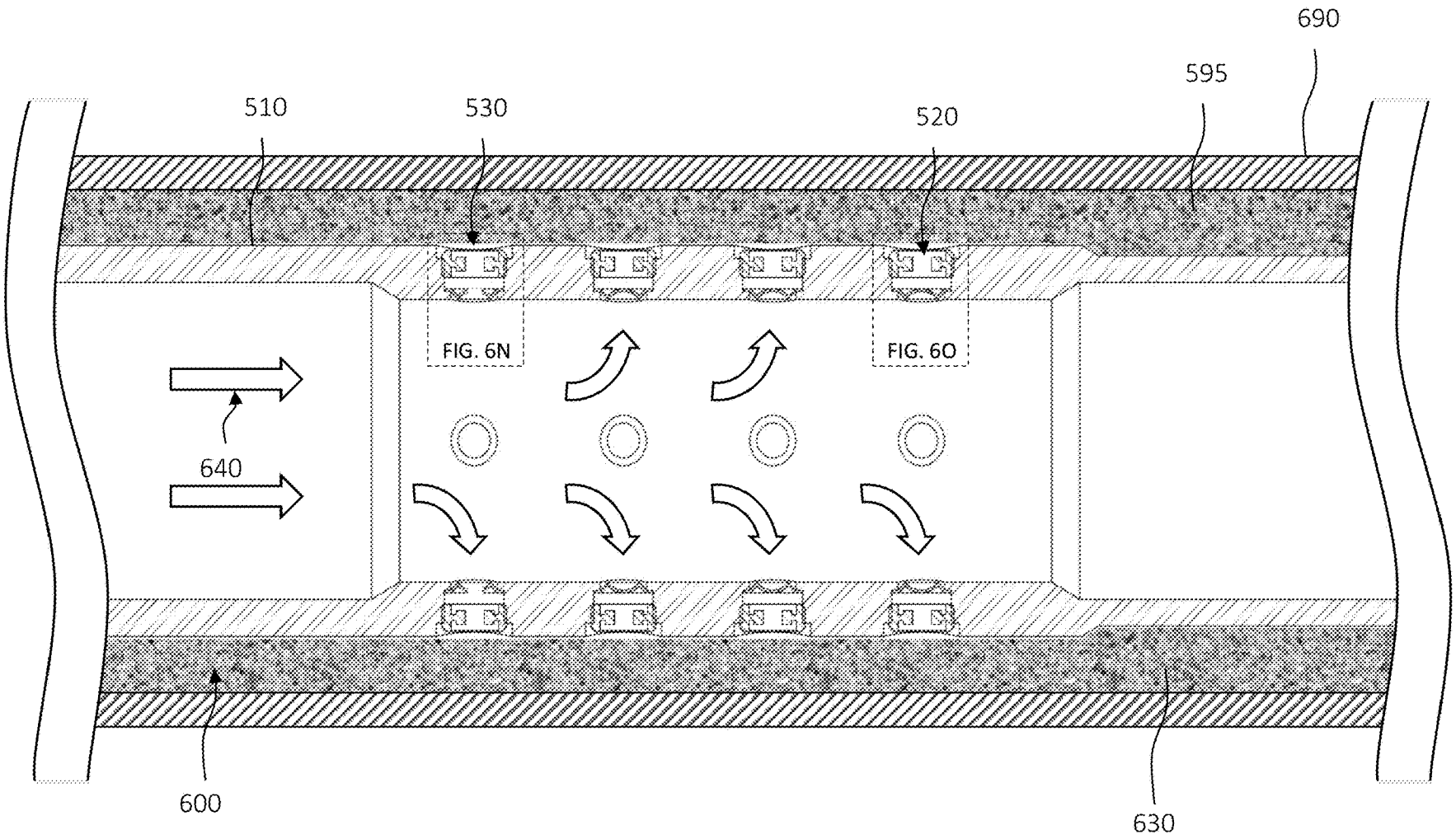
Figure 6N:
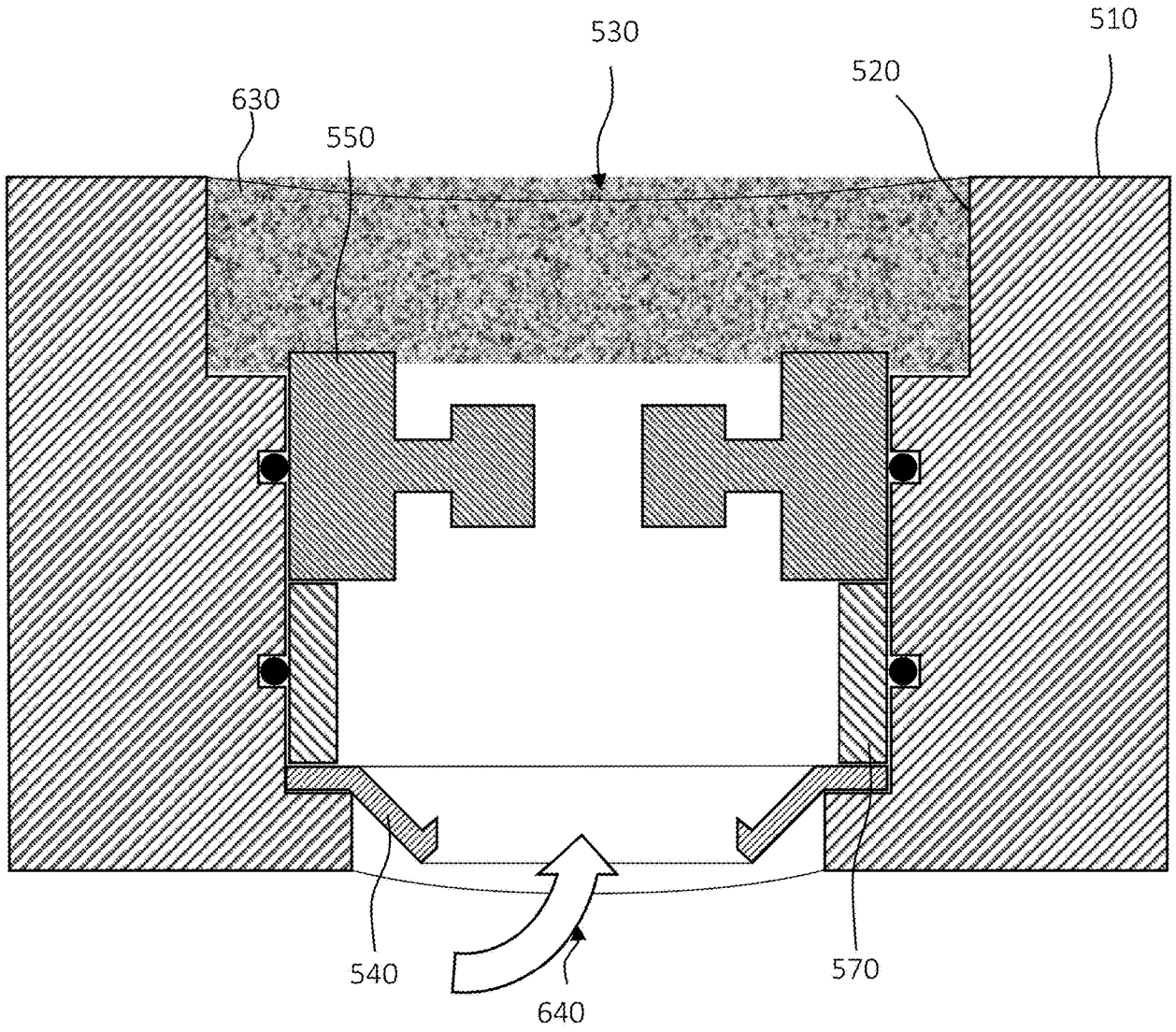
Figure 6O:
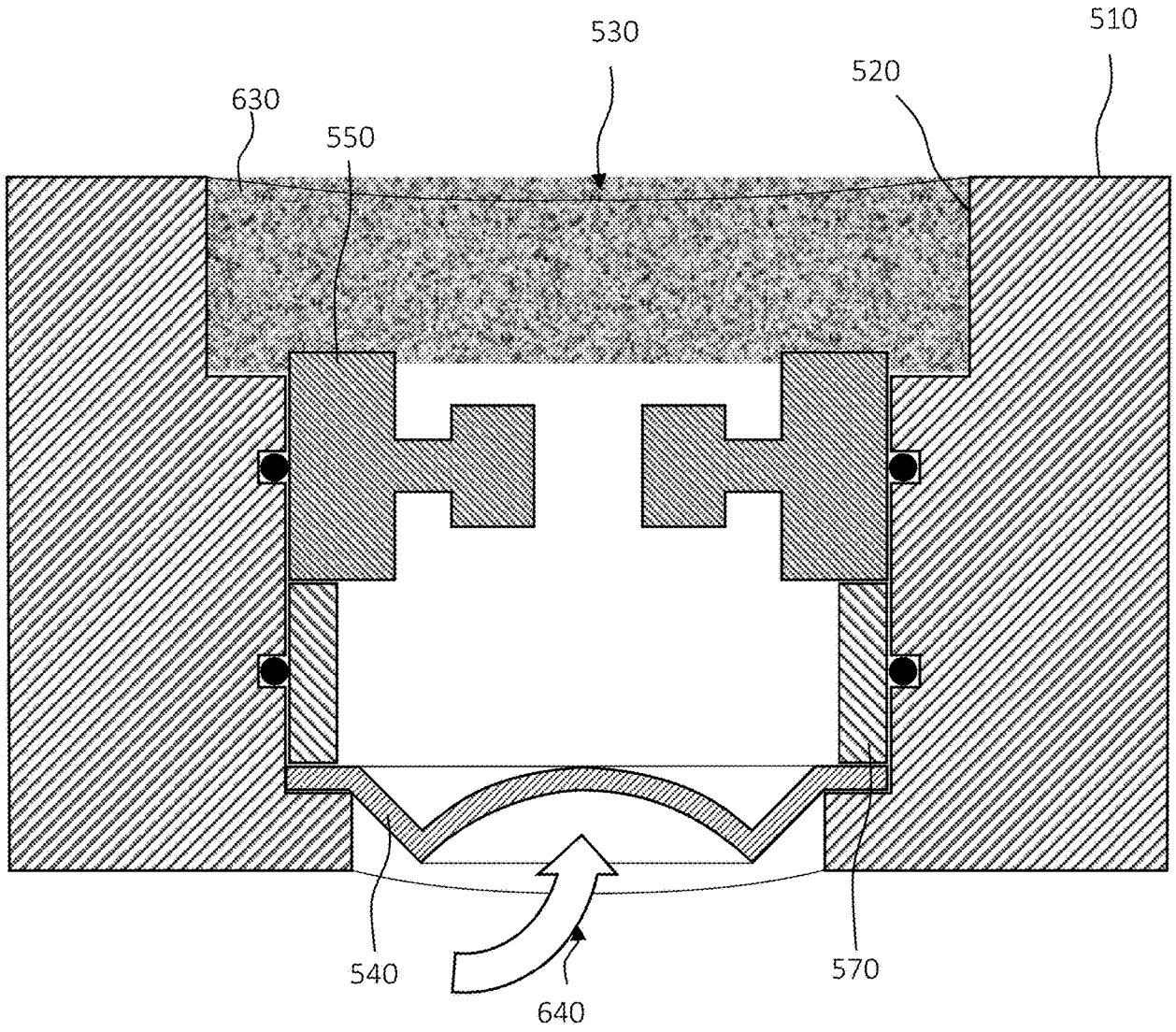
Figure 6P:
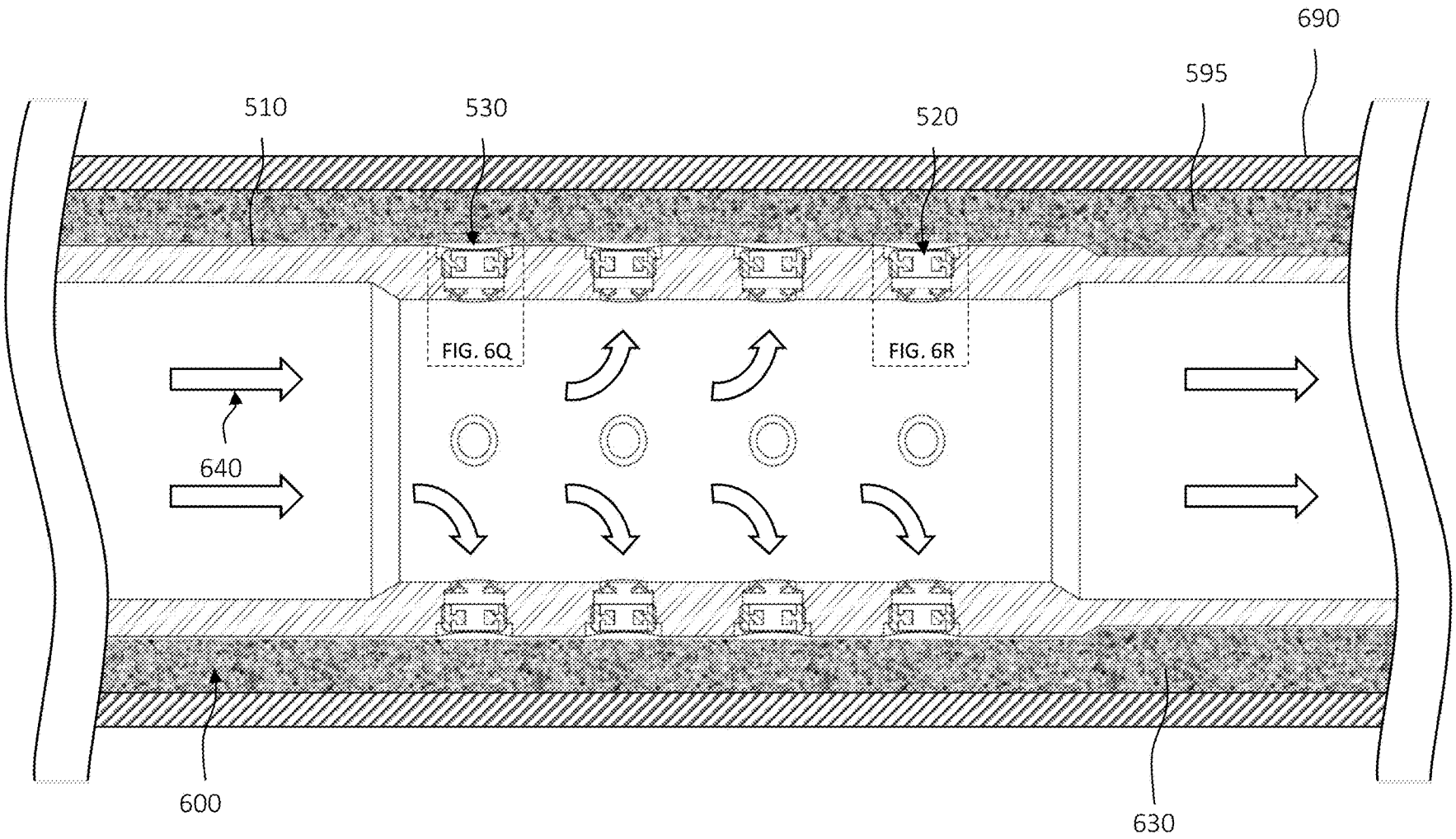
Figure 6Q:
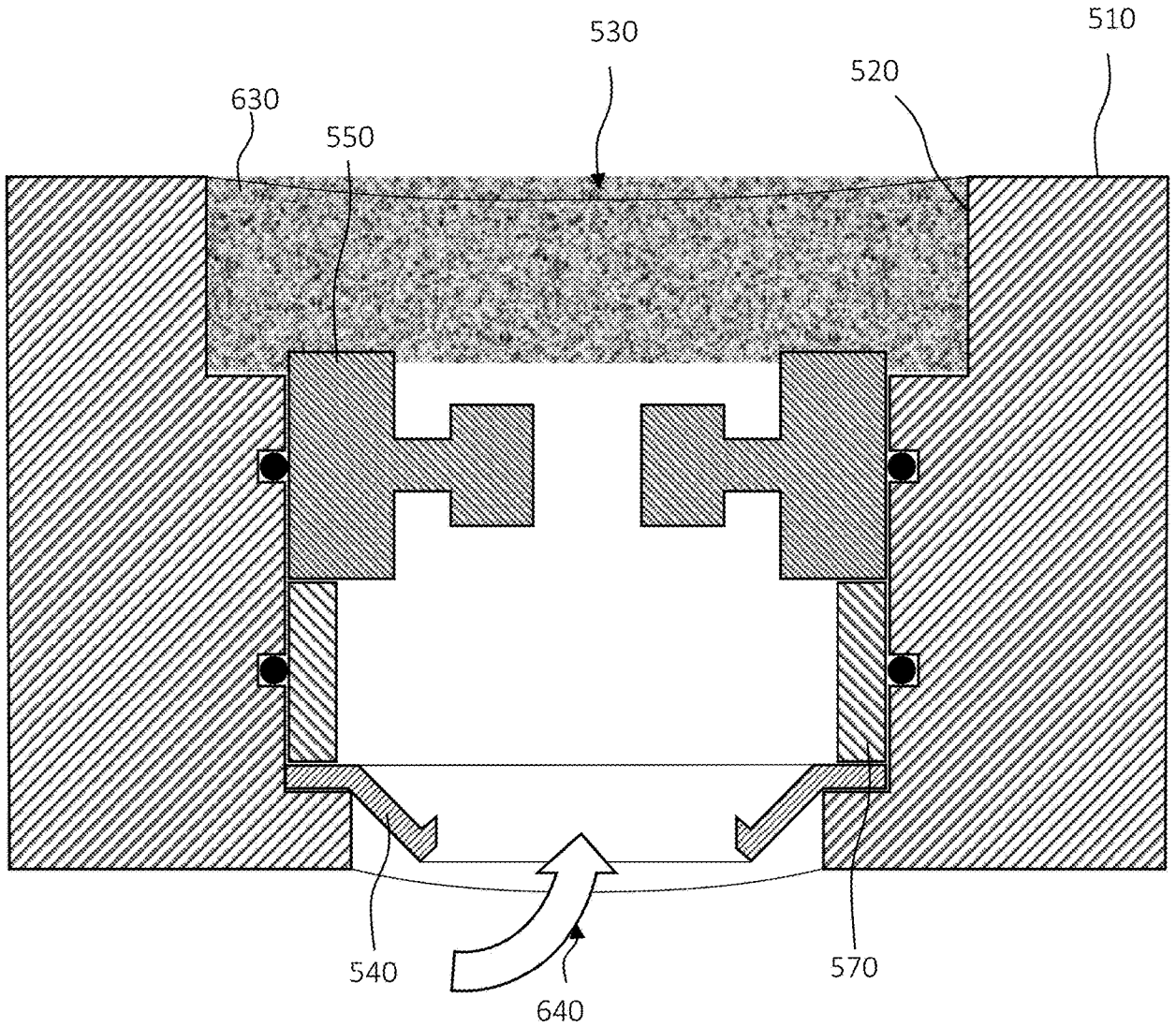
Figure 6R:
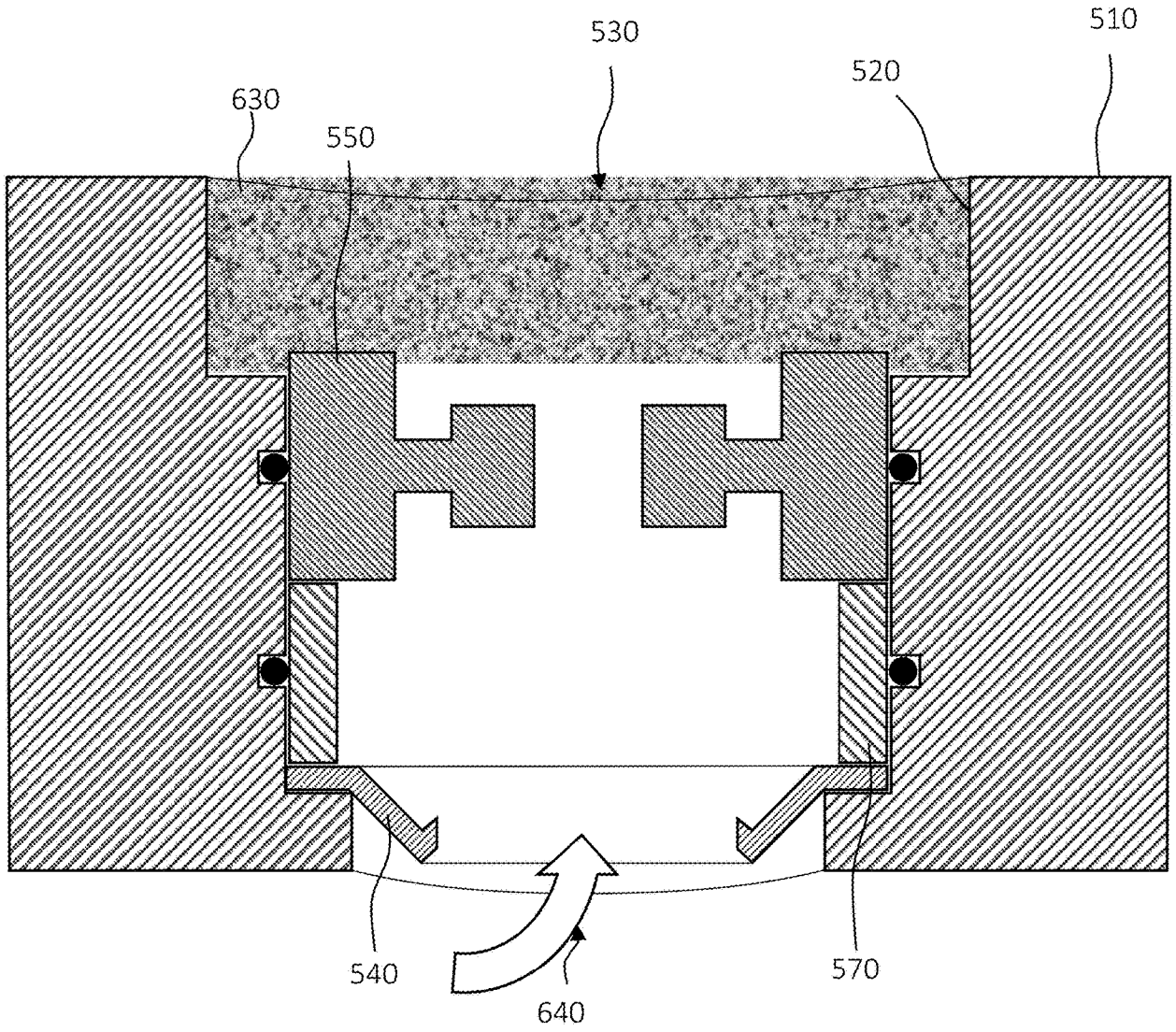
Figure 6S:
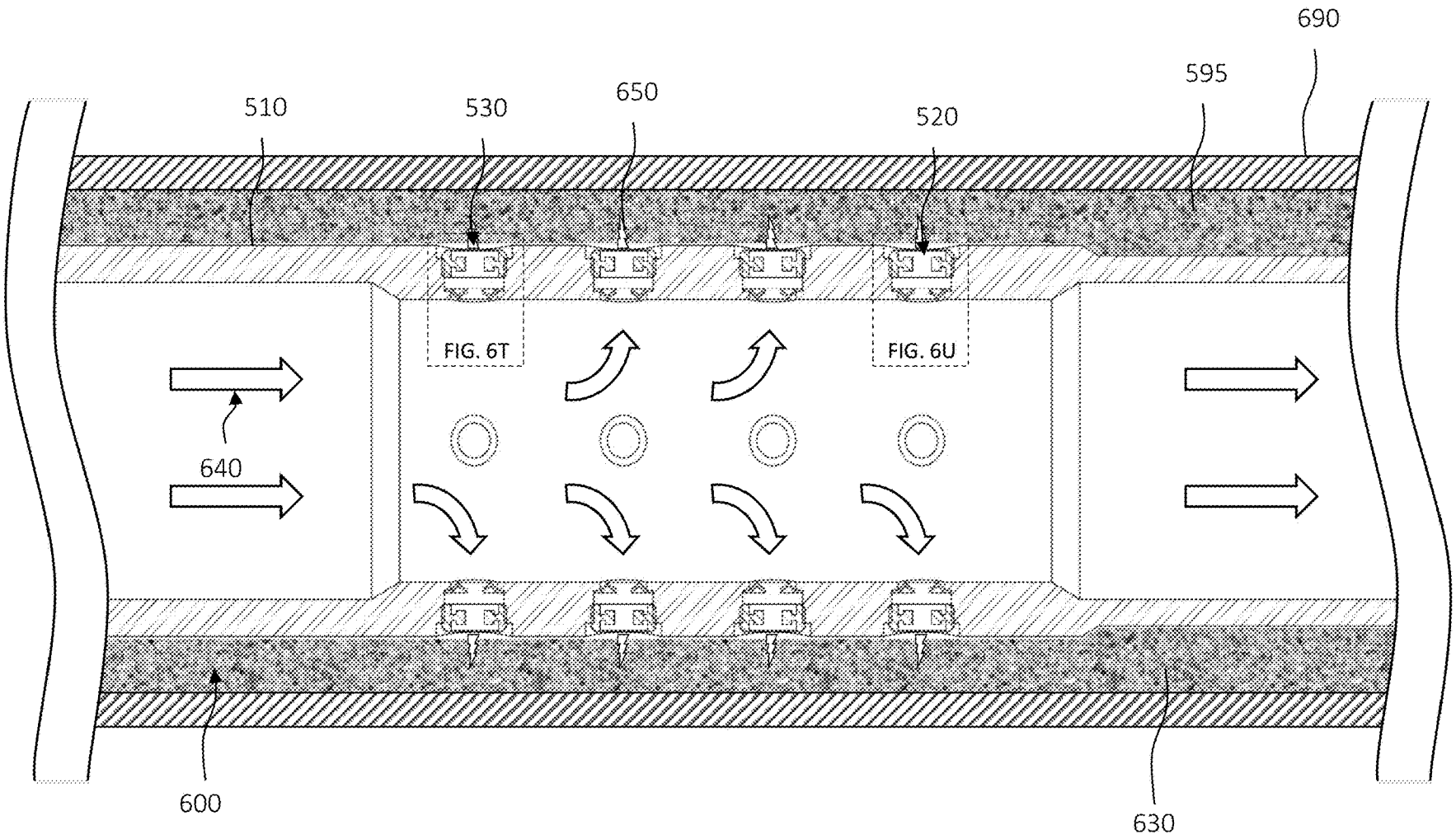
Figure 6T:
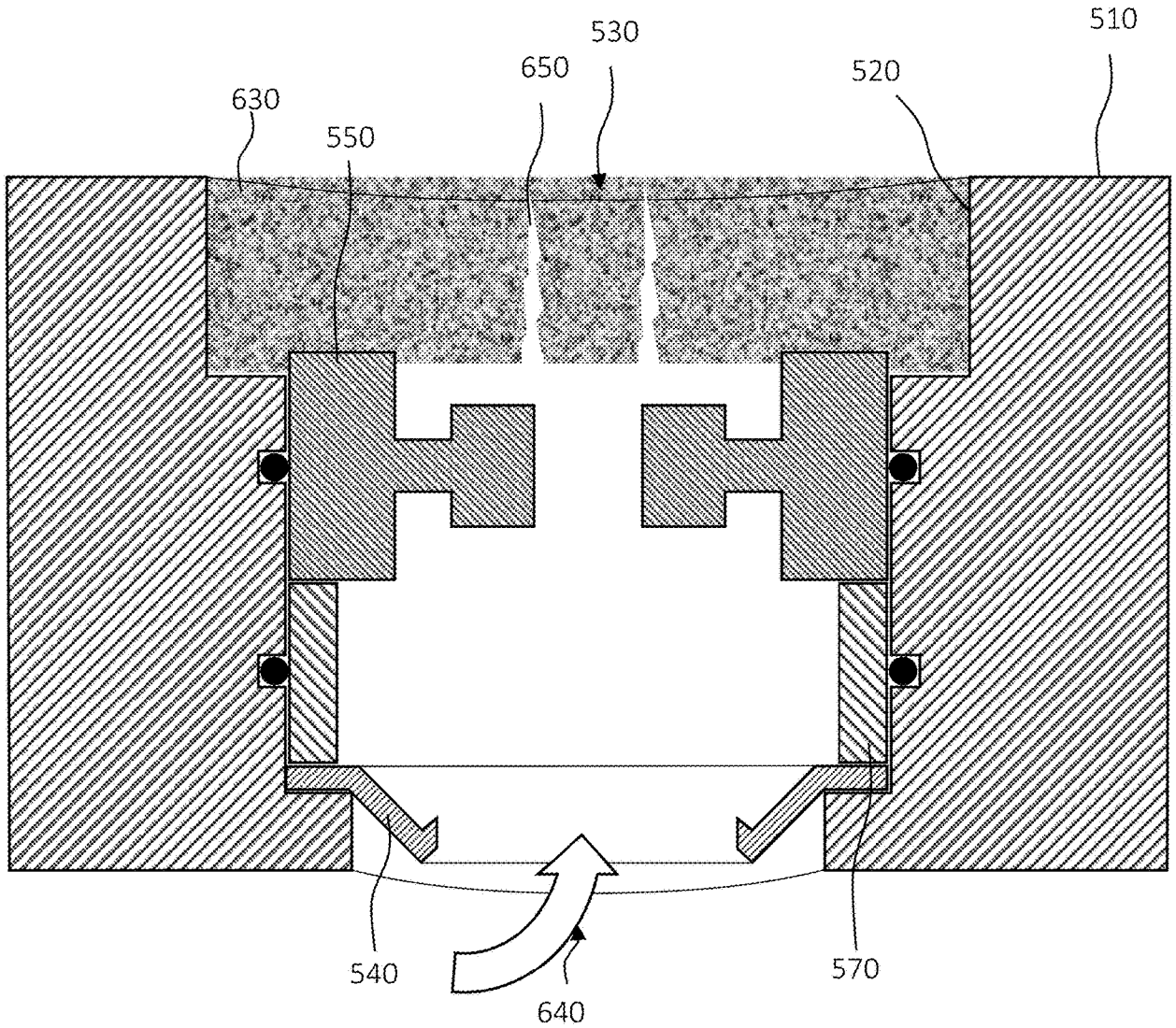
Figure 6U:
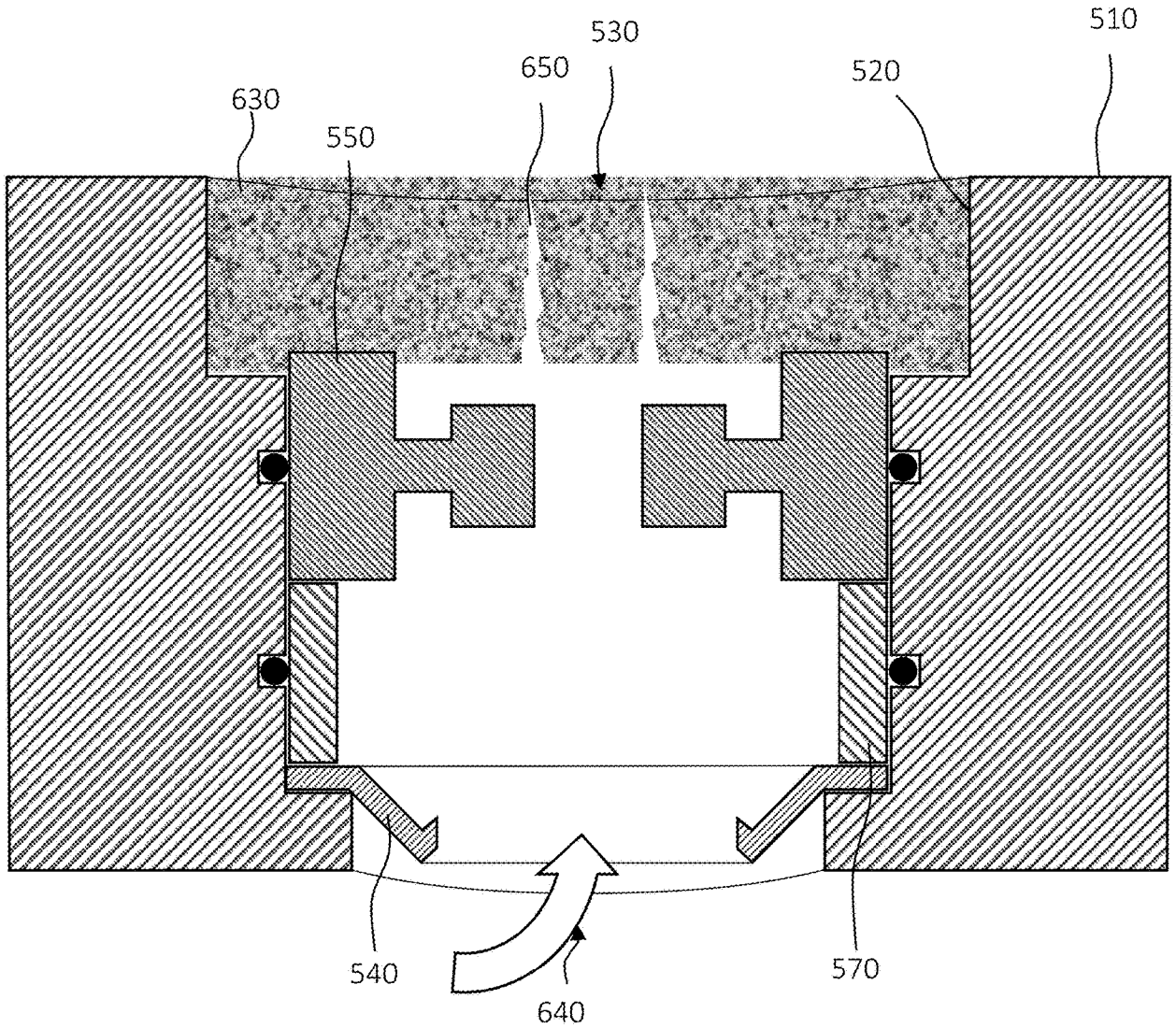
Figure 6V:
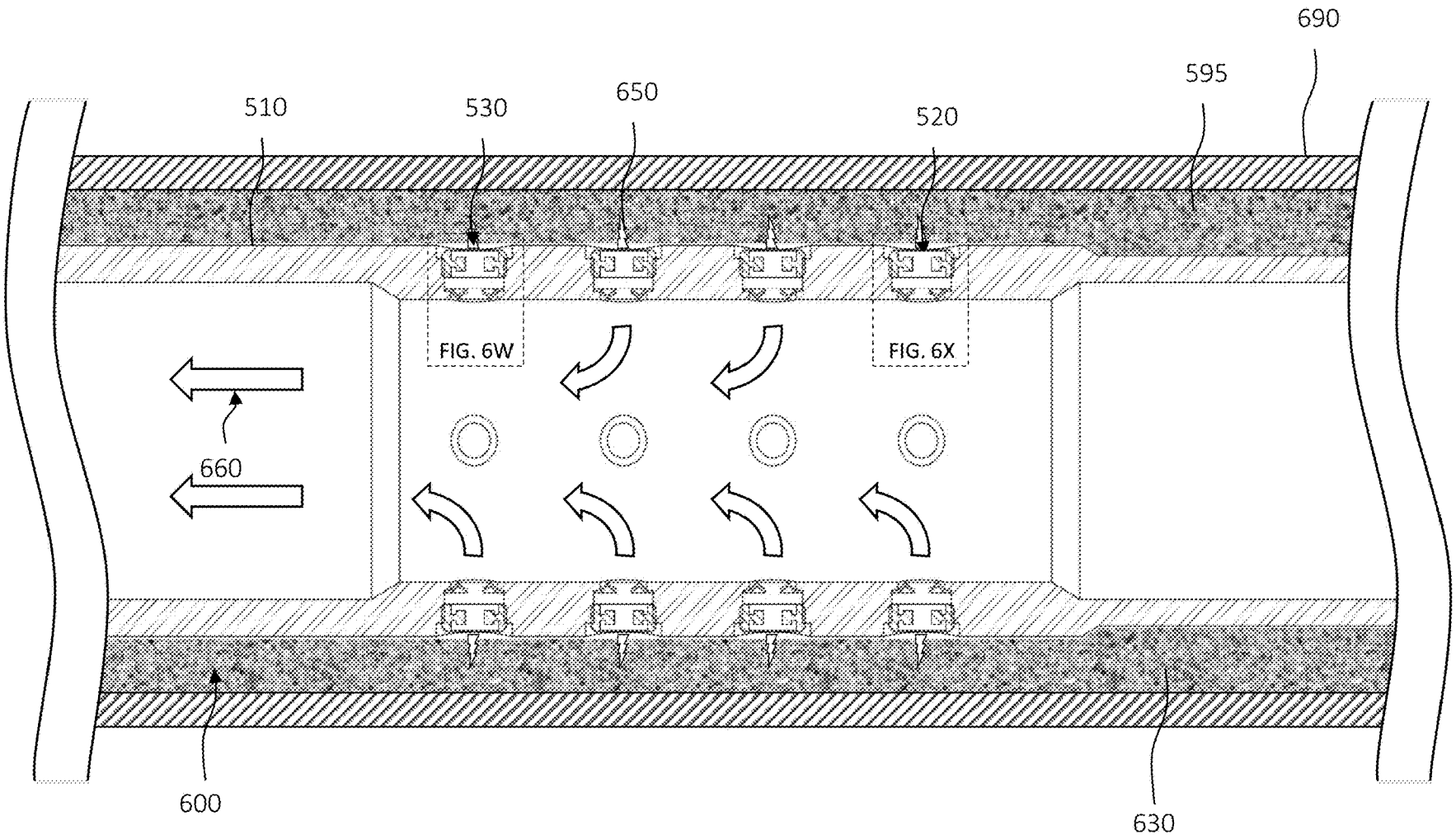
Figure 6W:
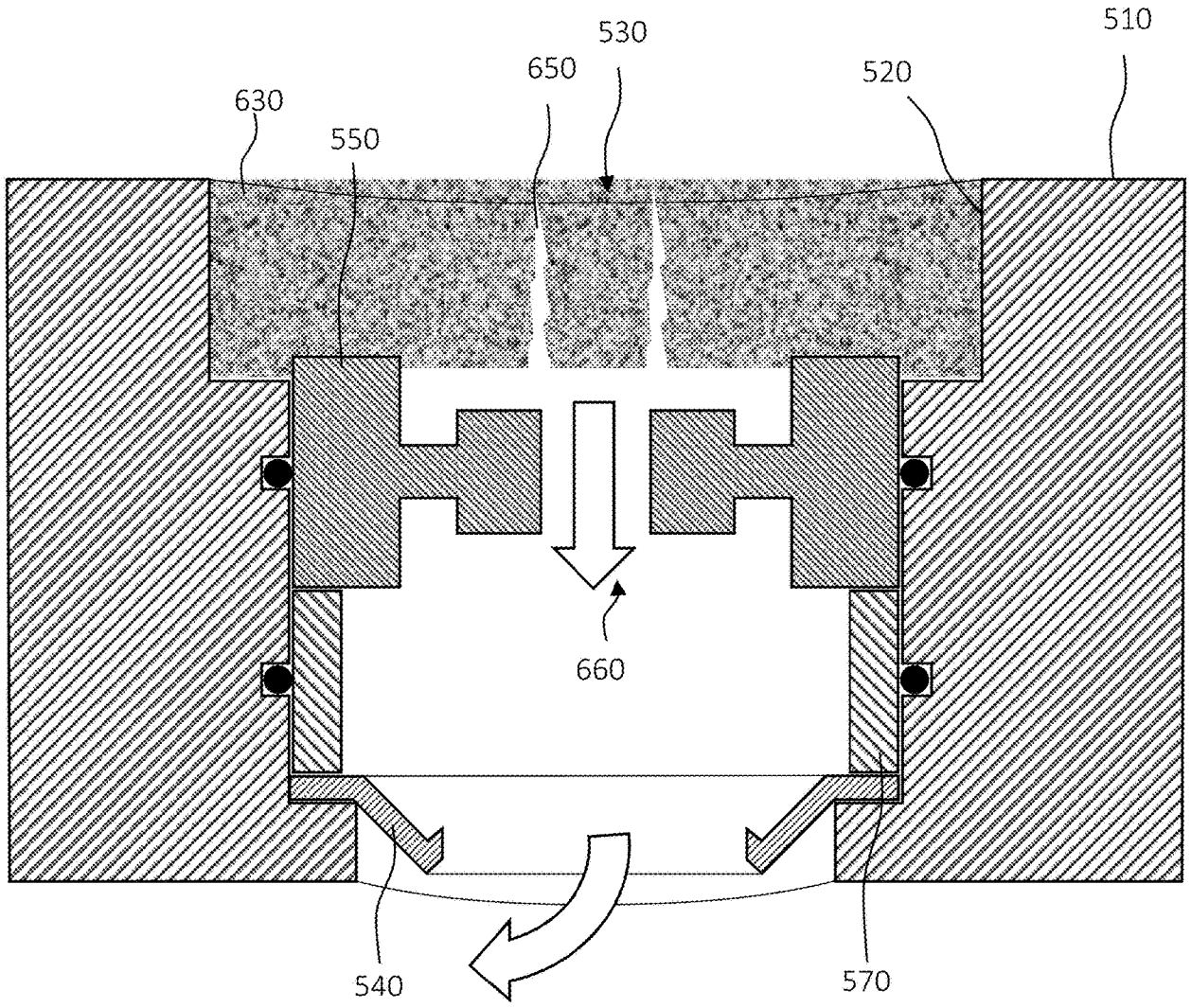
Figure 6X:
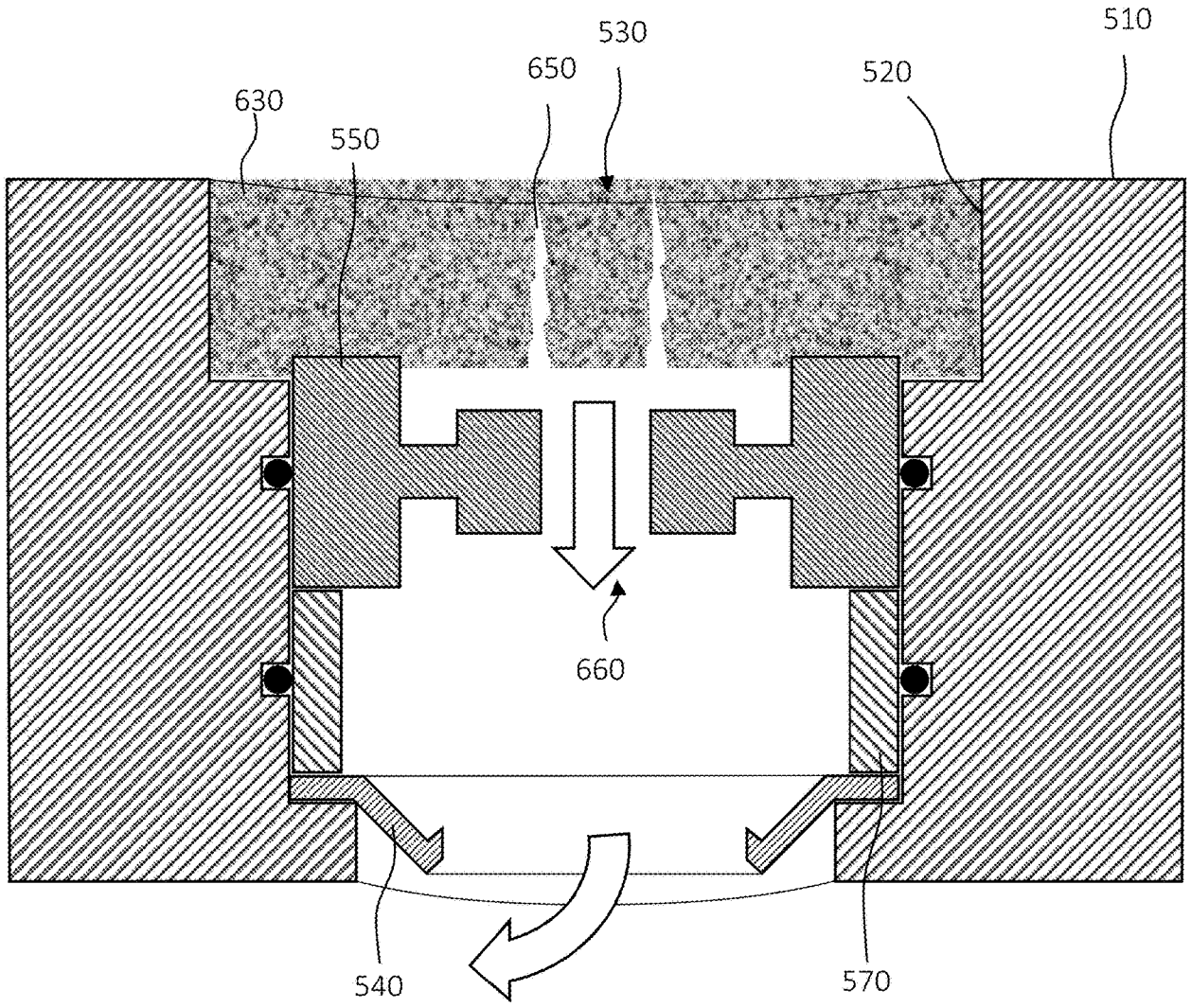
Figure 6Y:
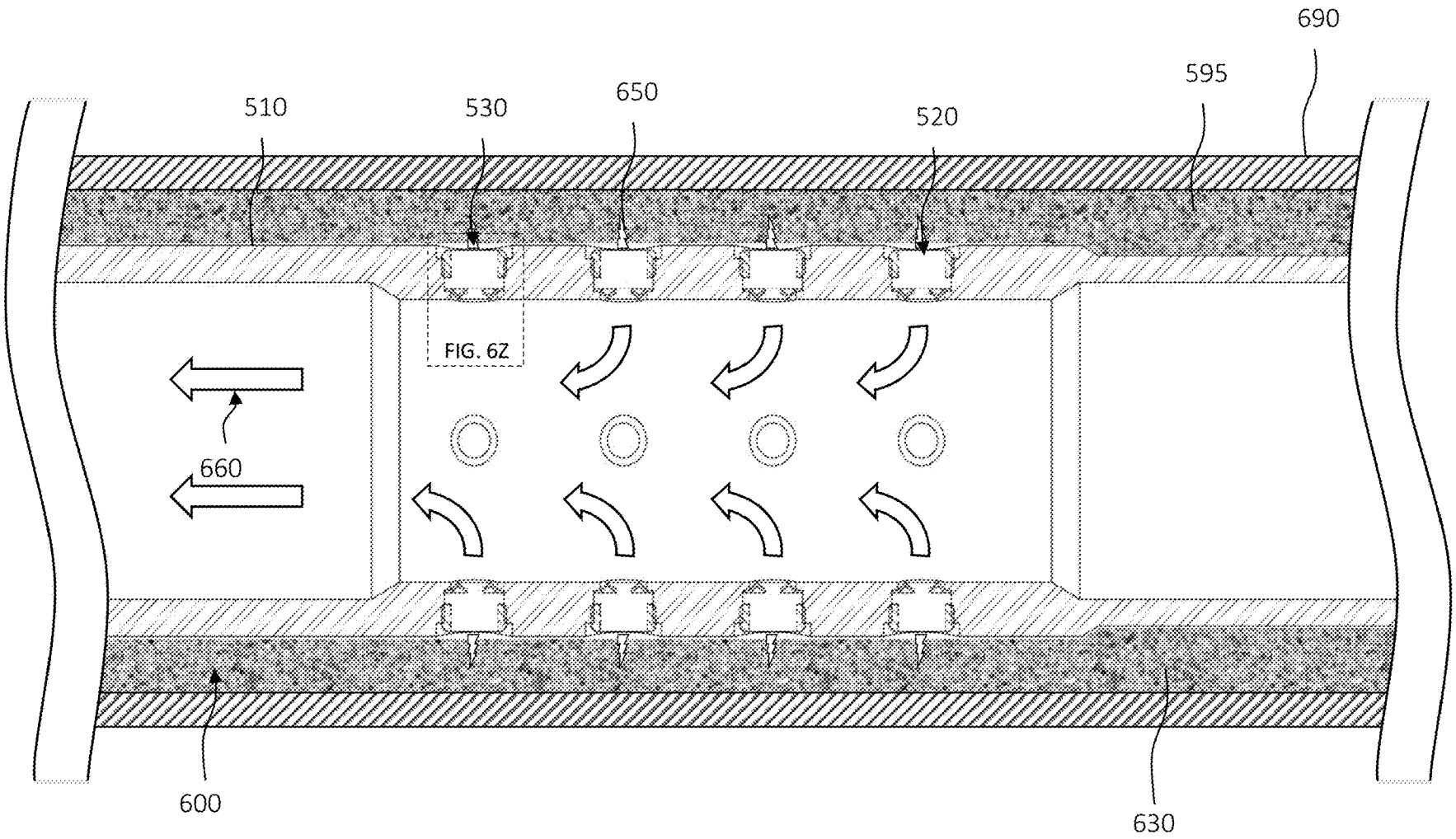
Figure 6Z:
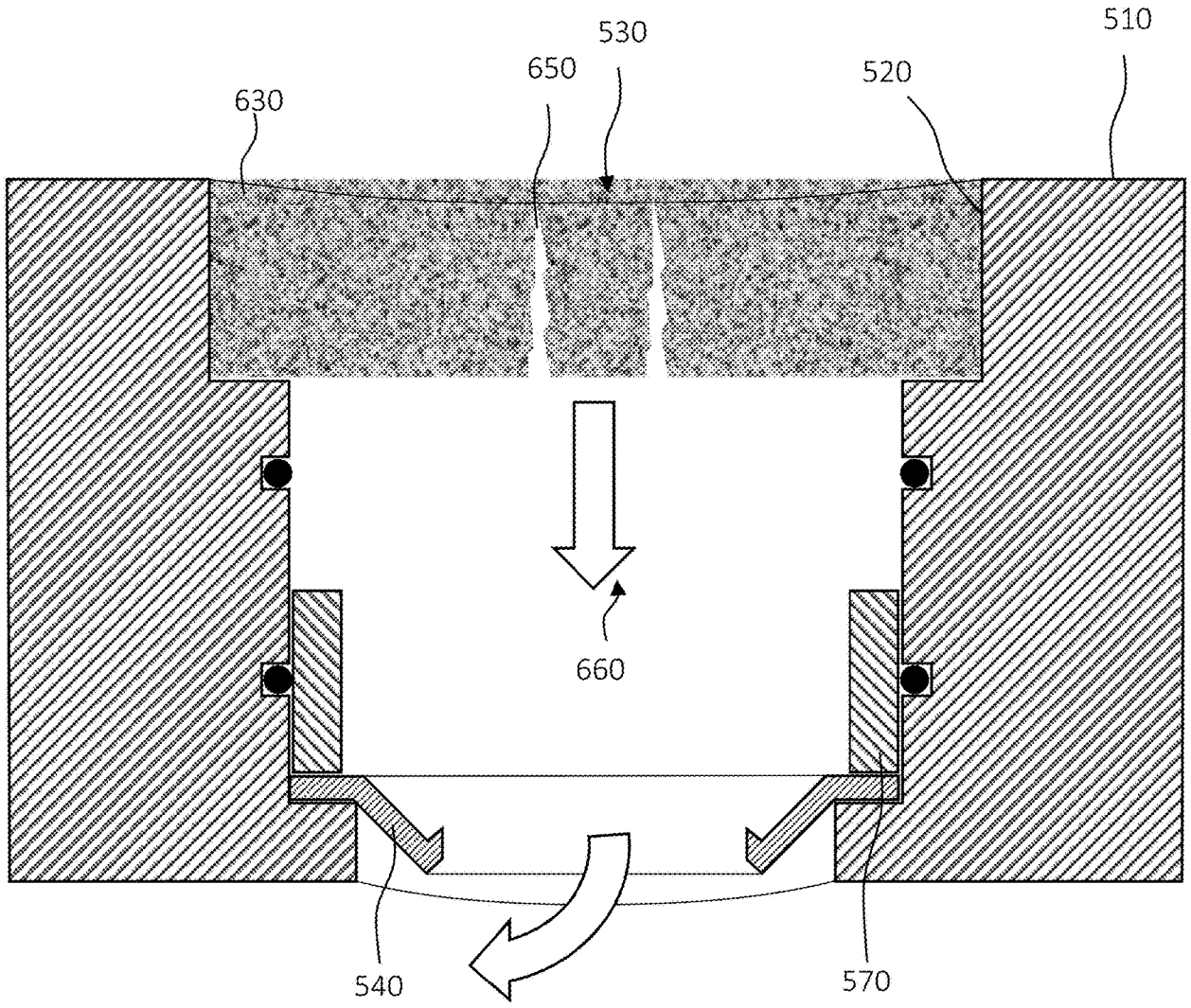

FIGS. 5A and 5B illustrate one embodiment of a production sub designed, manufactured and/or operated according to one or more embodiments of the disclosure, the production sub positioned within a wellbore; and FIGS. 6A through 6Z illustrate a process flow for employing a production sub designed, manufactured and/or operated according to one or more embodiments of the disclosure, to cement, fracture and produce from a subterranean formation located proximate the wellbore, in accordance with one or more embodiments of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of wellbore orientation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure has acknowledged that certain problems exist when using a production sub coupled to a wellbore liner. Typically, production subs include a plurality of production ports therein, for example to receive production fluid from surrounding subterranean formations. Often, the production ports will initially include a pressure barrier (e.g., such as a burst disc) therein, which allows the wellbore to be cemented prior to production. After completing the cementing process (e.g., days, months, years after completing the cementing process), the pressure barriers may be removed, such that the surrounding subterranean formation may be fractured and the production ports may receive production fluid.

The present disclosure has recognized, for the first time, that production subs employing the plurality of production ports may suffer from a pressure balance situation. Specifically, the present disclosure has recognized that the production sub may achieve a pressure balance situation prior to all of the pressure barriers breaking (e.g., bursting when the pressure barriers are burst discs). In such a situation, one or more of the pressure barriers may remain intact, thereby limiting the flow area when producing through the production ports at a later point in time.

Given this recognition, the present disclosure has devised an improved fluid flow assembly to be positioned in each of the production ports. In at least one embodiment, the fluid flow assembly includes a radially interior burst disc, a radially exterior burst disc, and a sealing member positioned in a chamber created between the radially interior burst disc and the radially exterior burst disc. In accordance with this embodiment, the fluid flow assembly further includes a sealing member seat located in the chamber proximate the radially exterior burst disc, the sealing member configured to engage with the sealing member seat as fluid is pushing the sealing member radially outward. Thus, each of the radially interior burst discs of each of the production ports may burst prior to the production sub achieving a pressure balance situation, for example as the sealing members and sealing member seats maintain the pressure differential during this time. In at least one embodiment, the sealing members unseat from the sealing member seats (e.g., fall from, dissolve, erode, etc.) at a later point in time, thereby increasing a flow volume through the production ports.

In at least one other embodiment, the fluid flow assembly includes a radially interior burst disc, and a degradable fluid flow orifice positioned radially outside of the radially interior burst disk. The degradable fluid flow orifice, in this embodiment, is configured to provide a restriction that maintains the pressure differential until all of the radially interior burst discs have burst. However, the degradable fluid flow orifice is configured to degrade over time (e.g., days, months, years, etc.), such as to increase a flow volume through the production port.

The present disclosure has further recognized that in certain circumstances after pumping cement into a liner, cement and/or debris (e.g., hardened cement) existing in an annulus between the wellbore and the liner may fall into the plurality of production ports of the production sub. In the first improved fluid flow assembly discussed above, the radially exterior burst disc keeps the cement and/or debris from the plurality of production ports until the cement may cure. In the second improved fluid flow assembly discussed above, a dissolvable plug may be positioned within each of the degradable fluid flow orifices to keep the cement and/or debris from the plurality of production ports until the cement may cure. In this embodiment, the dissolvable plug dissolves over time (e.g., days, months, etc.), thereby allowing the degradable fluid flow orifices to perform their intended function.

Figure 1:
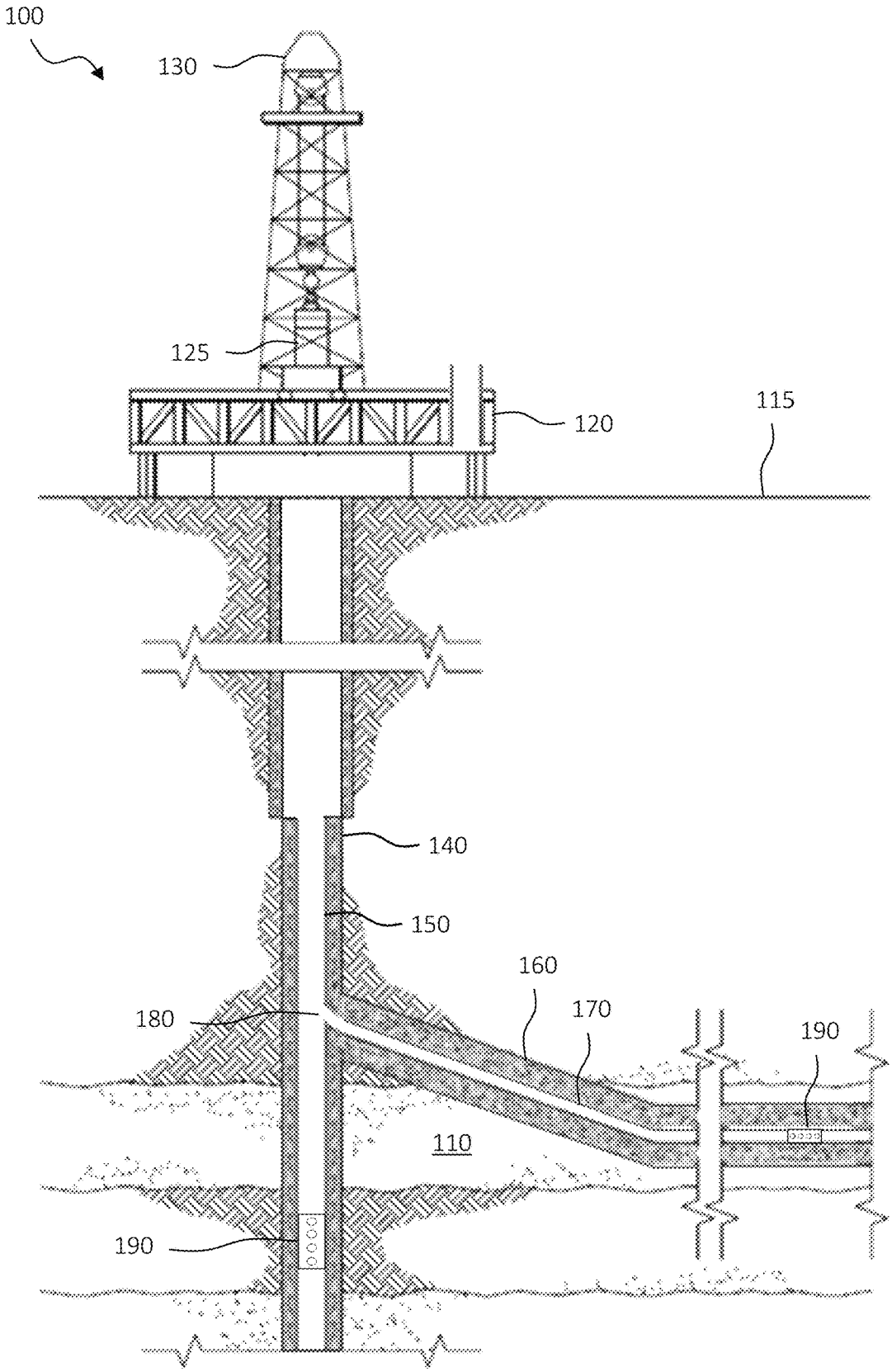
FIG. 1 illustrates a well system including an exemplary operating environment that the apparatuses, systems and methods disclosed herein may be employed.

FIG. 1 is a schematic view of a well system 100 designed, manufactured and operated according to one or more embodiments disclosed herein. The well system 100 may include a platform 120 positioned over a subterranean formation 110 located below the earth's surface 115. The platform 120, in at least one embodiment, has a hoisting apparatus 125 and a derrick 130 for raising and lowering one or more downhole tools including pipe strings. Although a land-based oil and gas platform 120 is illustrated in FIG. 1, the scope of this disclosure is not thereby limited, and thus could potentially apply to offshore applications. The teachings of this disclosure may also be applied to other land-based well systems different from that illustrated.

As shown, a main wellbore 140 has been drilled through the various earth strata, including the subterranean formation 110. The term "main" wellbore is used herein to designate a wellbore from which another wellbore is drilled. It is to be noted, however, that a main wellbore 140 does not necessarily extend directly to the earth's surface, but could instead be a branch of yet another wellbore. A casing string 150 may be at least partially cemented within the main wellbore 140. The term "casing" is used herein to designate a tubular string used to line a wellbore. Casing may actually be of the type known to those skilled in the art as a "liner" and may be made of any material, such as steel or composite material and may be segmented or continuous, such as coiled tubing.

In the illustrated embodiment, a lateral wellbore 160 extends from the main wellbore 140. The term "lateral" wellbore is used herein to designate a wellbore that is drilled outwardly from its intersection with another wellbore, such as a main wellbore. Moreover, a lateral wellbore may have another lateral wellbore drilled outwardly therefrom. In the illustrated embodiment, the lateral wellbore 160 includes a lateral wellbore liner 170. Accordingly, a junction 180 exists where the main wellbore 140 (e.g., the casing string 150) and the lateral wellbore 160 (e.g., the lateral wellbore liner 170) intersect. In accordance with at least one embodiment of the disclosure, cement surrounds the junction 180.

In accordance with another embodiment of the disclosure, a production sub 190 may be positioned in one or both of the casing string 150 or lateral wellbore liner 170. The production sub 190, in accordance with one embodiment, is configured to receive production fluid from a subterranean formation 110 surrounding one or both of the casing string 150 or lateral wellbore liner 170. The production subs 190, in one embodiment, each including a plurality of production ports, the plurality of production ports each having a plurality of fluid flow assembly designed, manufactured and/or operated according to one or more embodiments of the disclosure located therein.

Figure 2A:
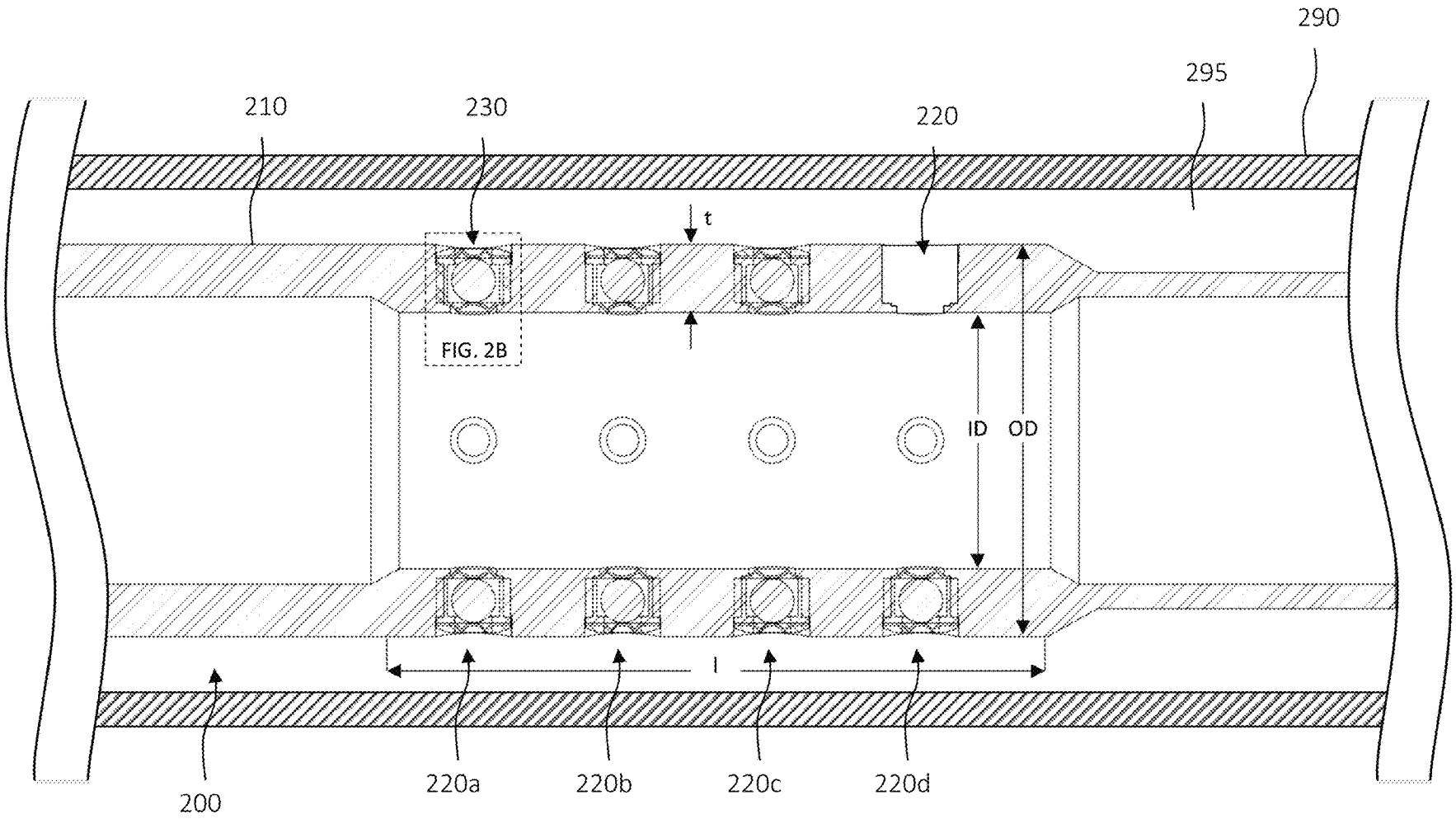
FIGS. 2A and 2B illustrate one embodiment of a production sub designed, manufactured and/or operated according to one or more embodiments of the disclosure, the production sub positioned within a wellbore.
Figure 2B:
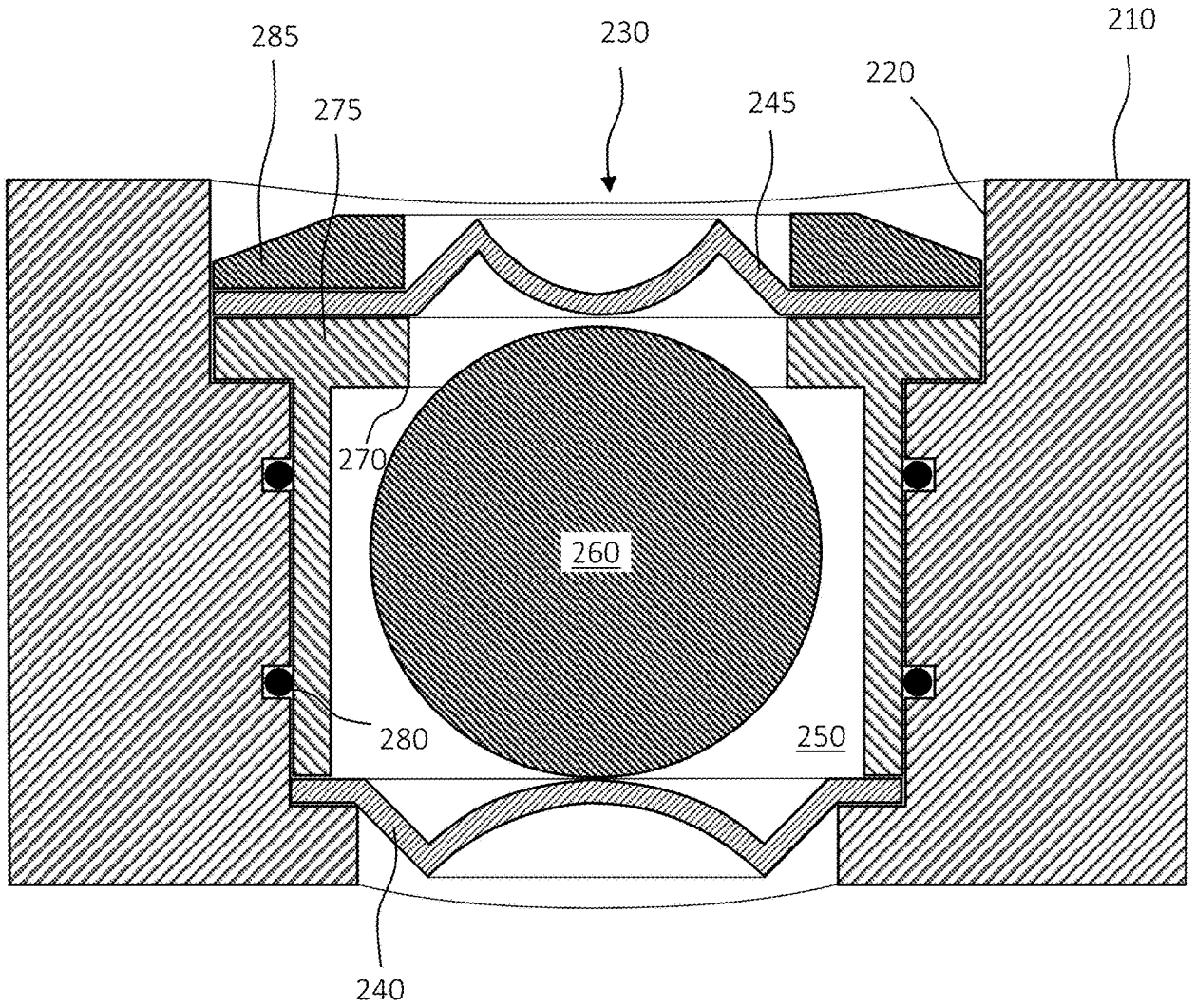

Turning to FIGS. 2A and 2B, illustrated is one embodiment of a production sub 200 designed, manufactured and/or operated according to one or more embodiments of the disclosure, the production sub positioned within a wellbore 290. The wellbore 290, in one embodiment, is a main wellbore. The wellbore 290, in yet another embodiment, is a lateral wellbore.

In the illustrated embodiment of FIGS. 2A and 2B, the production sub 200 includes a tubular 210 having a length (l), an inside diameter (ID), an outside diameter (OD), and a sidewall thickness (t). The production sub 200, in the illustrated embodiment, further includes a plurality of production ports 220 extending through the sidewall thickness (t) and coupling the inside diameter (ID) and the outside diameter (OD). In at least one embodiment, the production sub 200 includes a first set of radially spaced apart production ports 220*a* and a second set of radially spaced apart production ports 220*b*, the first and second sets 220*a*, 220*b* axially offset from one another along the length (l). In the illustrated embodiment, the production sub 200 includes at least four sets of radially spaced apart production ports 220*a*, 220*b*, 220*c*, 220*d*. Nevertheless, the present disclosure is not limited to any specific number of production ports.

In the embodiment of FIGS. 2A and 2B, a fluid flow assembly 230 designed, manufactured and/or operated according to one or more embodiments of the disclosure is positioned in each of the production ports 220. In the embodiment of FIGS. 2A and 2B, the fluid flow assemblies 230 include a radially interior burst disc 240 and a radially exterior burst disc 245. In one or more embodiments, the radially interior burst disc 240 is configured to have a higher ID burst rating and a lower OD burst rating. In one or more other embodiments, the radially exterior burst disc 245 is configured to have a higher OD burst rating and a lower ID burst rating.

In the illustrated embodiment of FIGS. 2A and 2B, the radially interior burst disc 240 and the radially exterior burst disc 245 form a chamber 250. For example, in at least one embodiment, the chamber 250 is a fluid tight chamber. Accordingly, when the radially interior burst disc 240 and the radially exterior burst disc 245 remain intact, the chamber 250 is protected from fluids within the tubular 210, as well as fluids in an annulus 295 between the tubular 210 and the wellbore 290.

In the embodiment of FIGS. 2A and 2B, a sealing member 260 is positioned in the chamber 250 created between the radially interior burst disc 240 and the radially exterior burst disc 245. The scaling member 260, in at least one embodiment, is configured to engage with a sealing member seat 270 located in the chamber 250 proximate the radially exterior burst disc 245 as fluid is pushing the scaling member 260 radially outward. In at least one embodiment, the scaling member 260 is a dissolvable sealing member (e.g., dissolvable ball). While the dissolvable sealing member may comprise many different materials, and furthermore may be designed to dissolve over various different periods of time, in at least one embodiment the dissolvable sealing member comprises a Magnesium based alloy, an Aluminum based alloy, a (PGA) Polyglycolic acid polymer, a (PLA) Polylactic acid polymer, a (PHBV) Poly hydroxybutyrate-co-Hydroxy valerate polymer, or another synthetic or natural biodegradable polymer.

As the chamber 250 is a fluid tight chamber in one embodiment, the fluid tight chamber prevents the dissolvable sealing member from dissolving prior to the radially interior burst disc 240 bursting, or alternatively prior to the radially interior burst disc 240 and the radially exterior burst disc 245 bursting. In yet another embodiment, the sealing member 260 is not configured to dissolve, but may fall back into the ID of the tubular 210 at a later point in time, for example after the radially interior burst disc 240 and the radially exterior burst disc 245 are no longer intact.

In the illustrated embodiment, the sealing member seat 270 is part of housing 275 located within the production port 210. In one or more embodiments, the fluid flow assembly 230 may include one or more one or more sealing elements 280 positioned between the housing 275 and the production port 210. The one or more sealing elements 280 may be any known or subsequently discovered sealing element and remain within the scope of the disclosure.

The fluid flow assembly 230 may be assembled within the production port 220 using a variety of different methods. In at least one embodiment, however, the radially interior burst disc 240 is first placed within the production port 220. Thereafter, the sealing member 260 may be dropped within the production port 220 upon the radially interior burst disc 240, followed by the housing 275 and radially exterior burst disc 245. Thereafter, a coupling member 285 may be secured within the production port 220, thereby holding the other features of the fluid flow assembly 230 therein. In at least one embodiment, the coupling member 285 is threadingly engaged with the production port 220. In yet another embodiment, the coupling member 285 is press fit within the production port 220, held with a screw within the production port 220, etc., among other mechanisms for coupling the two. In yet another embodiment, the radially interior burst disc 240, the sealing member 260, the housing 275 and the radially exterior burst disc 245 are a single premanufactured assembly. Accordingly, the single premanufactured assembly could be insert within the production port 220, and then held in place using the coupling member 285 or another similar feature.

Figure 3A:
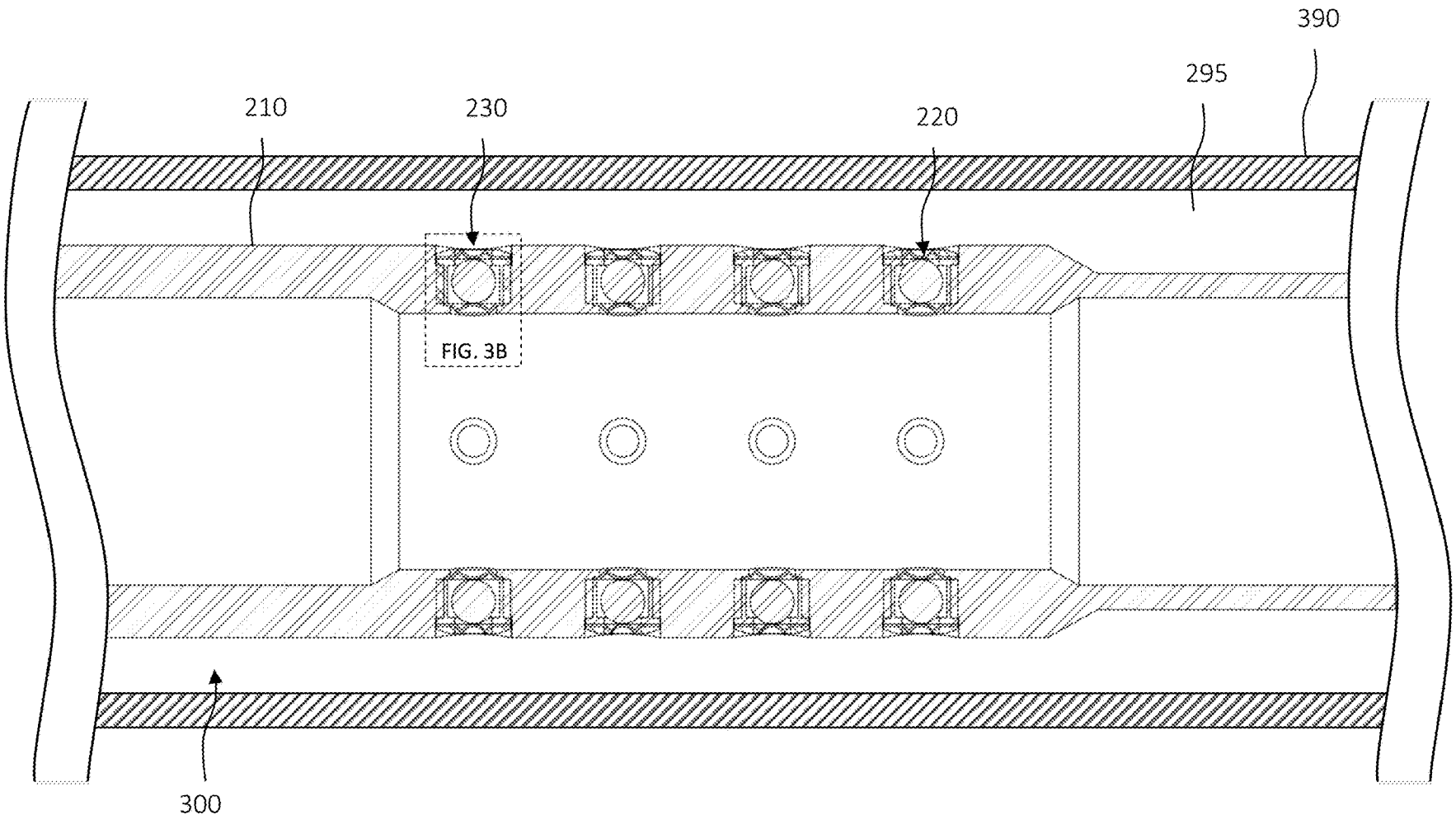
FIGS. 3A through 3X illustrate a process flow for employing a production sub designed, manufactured and/or operated according to one or more embodiments of the disclosure, to cement, fracture and produce from a subterranean formation located proximate the wellbore, in accordance with one or more embodiments of the disclosure.
Figure 3B:
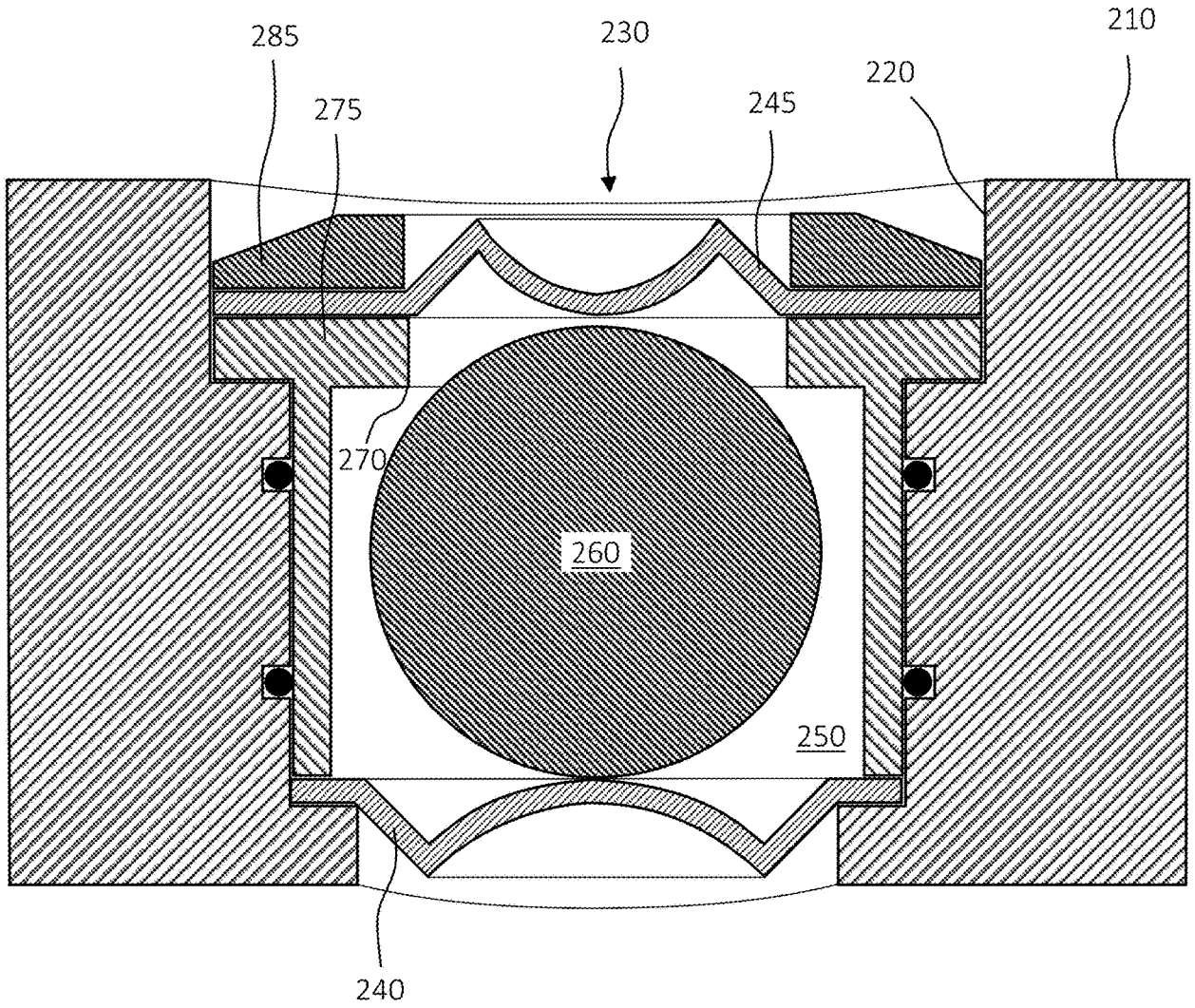
Figure 3C:
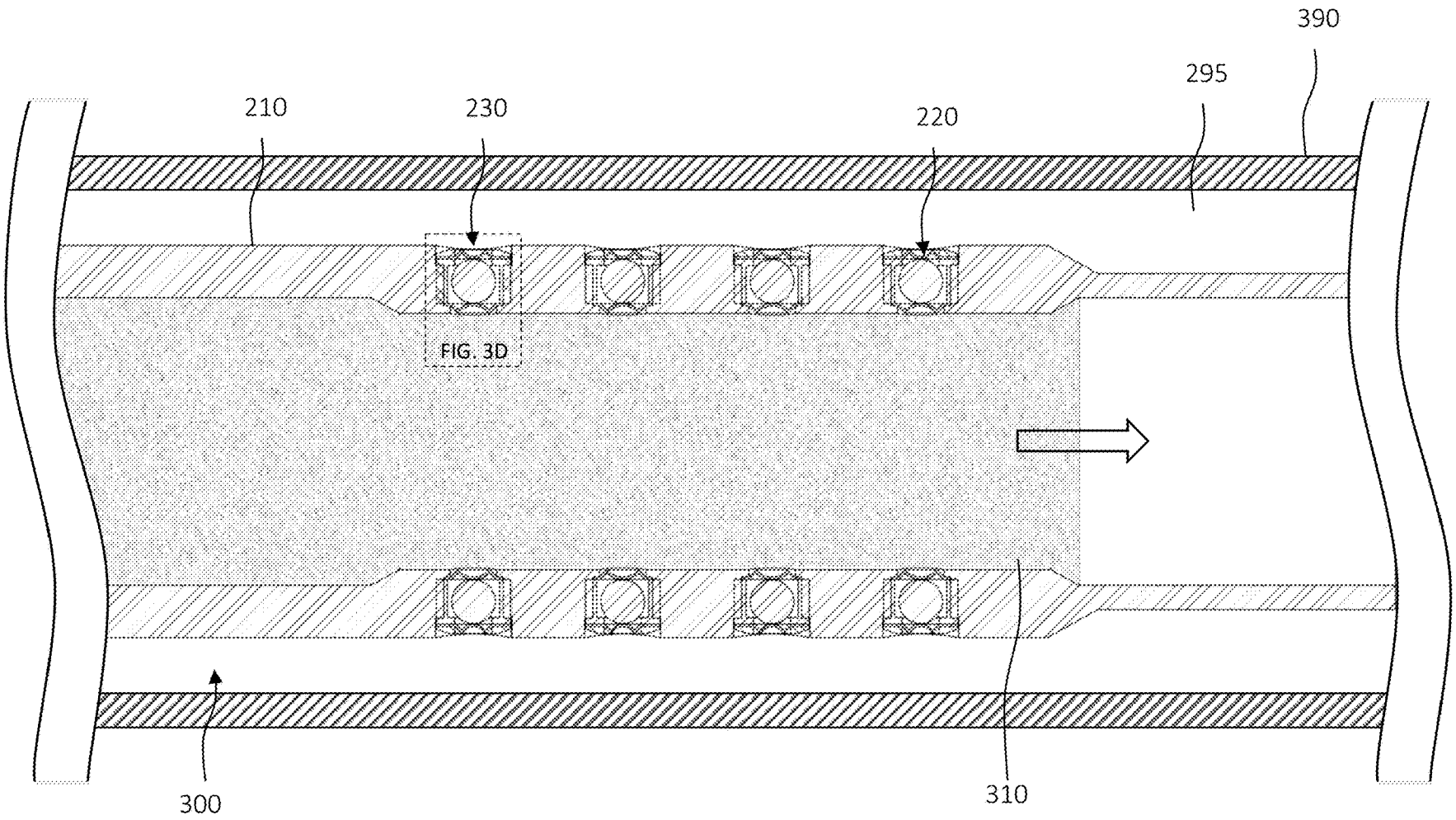
Figure 3D:
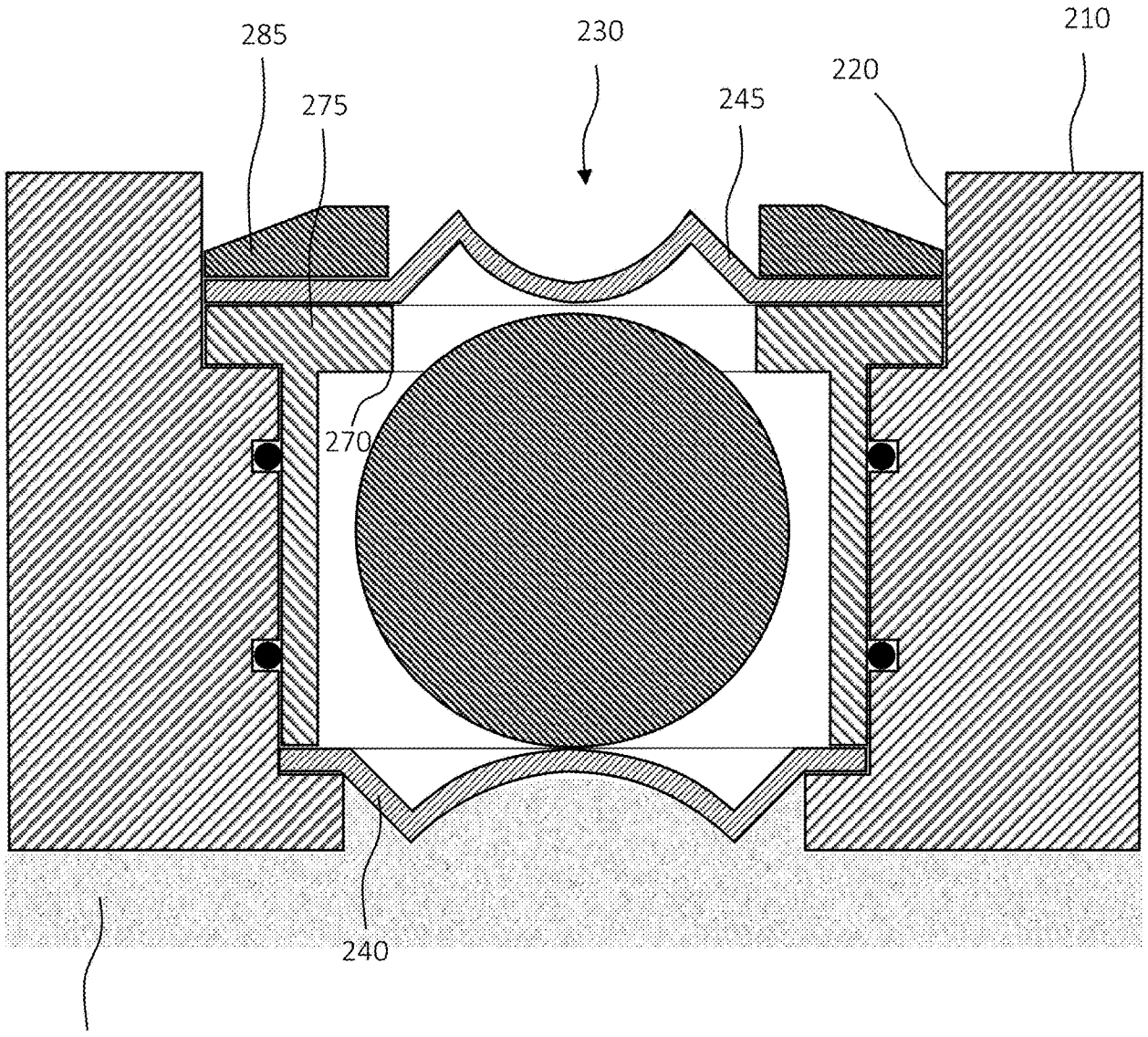
Figure 3E:
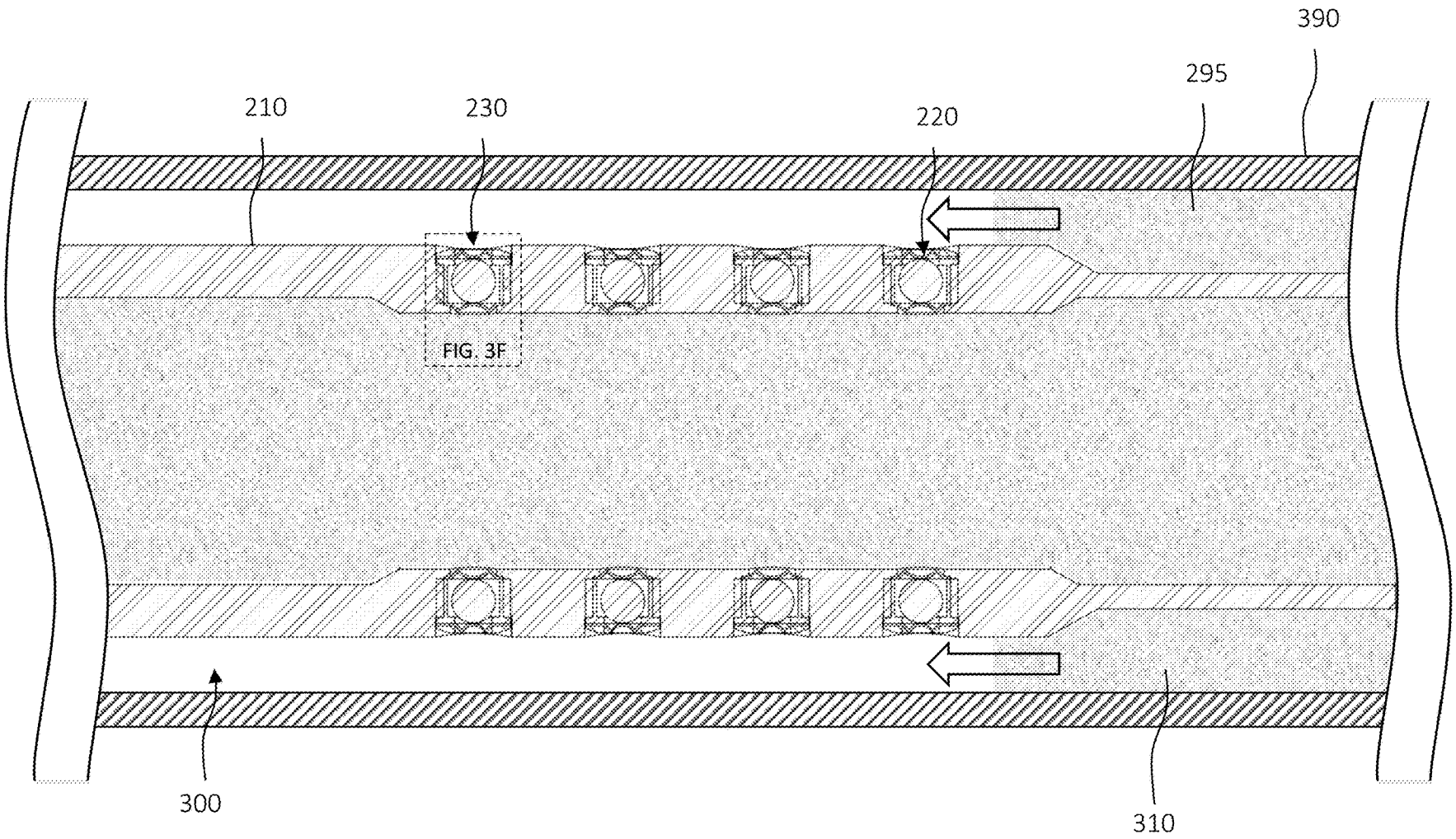
Figure 3F:
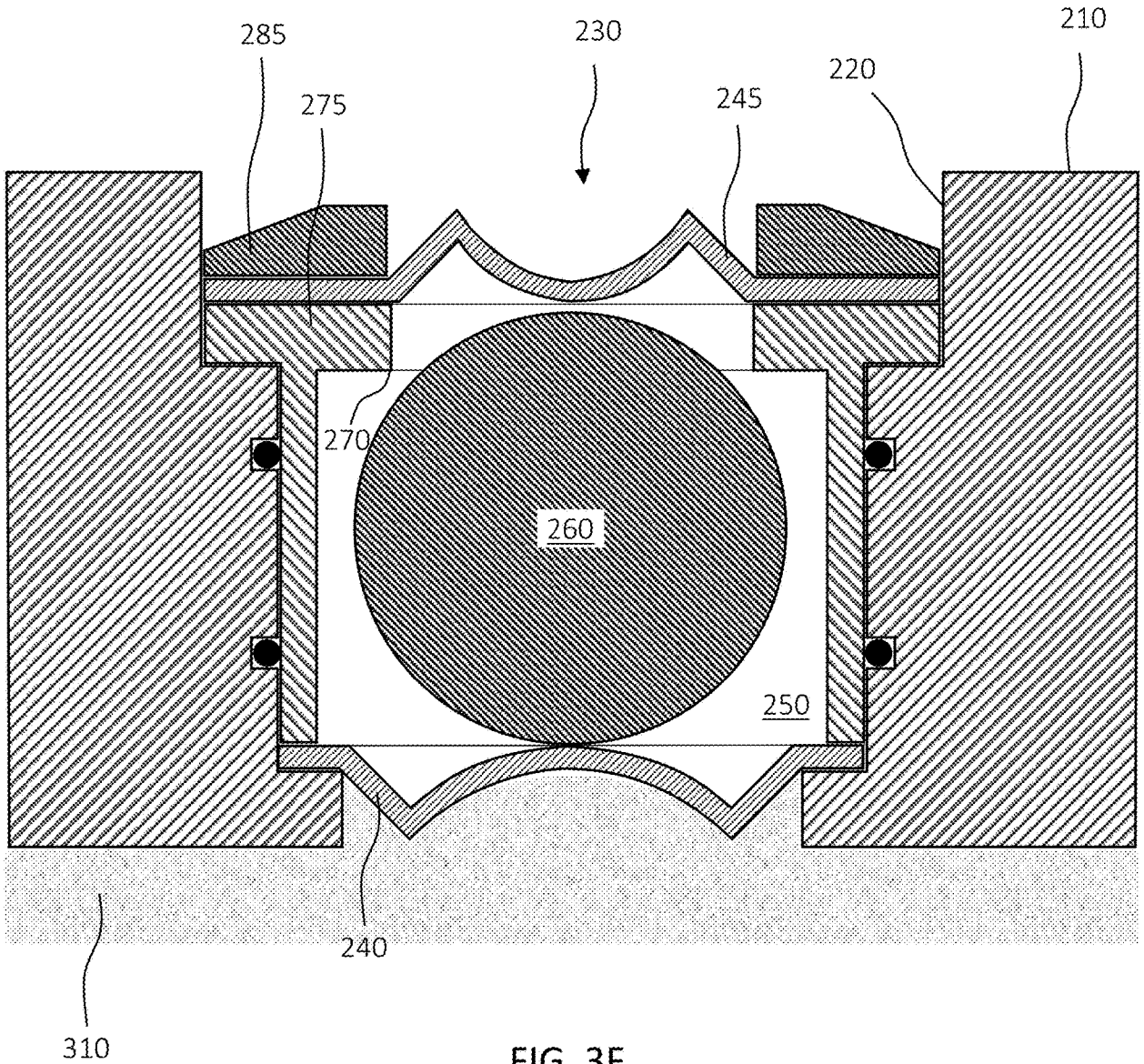
Figure 3G:
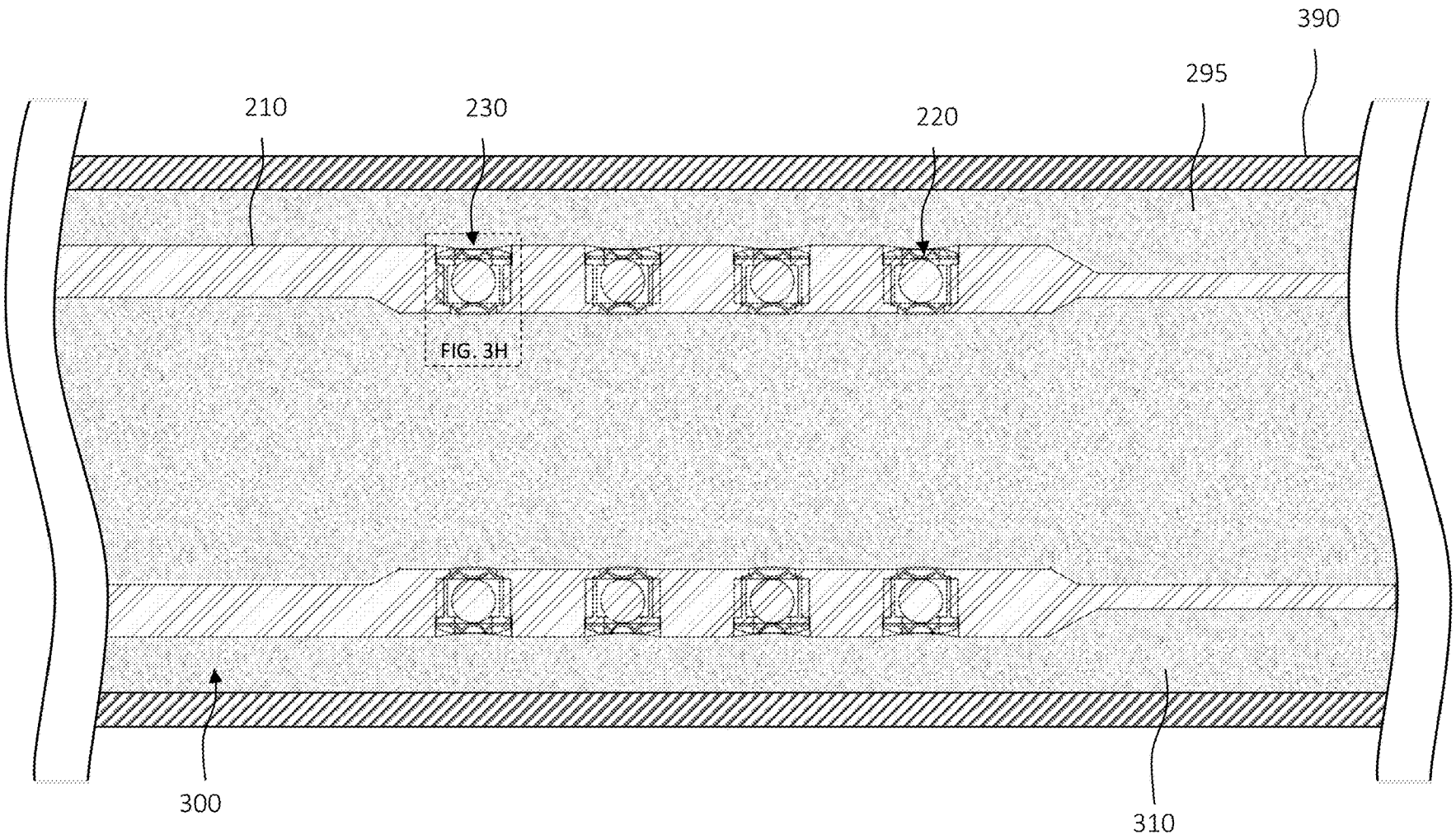
Figure 3H:
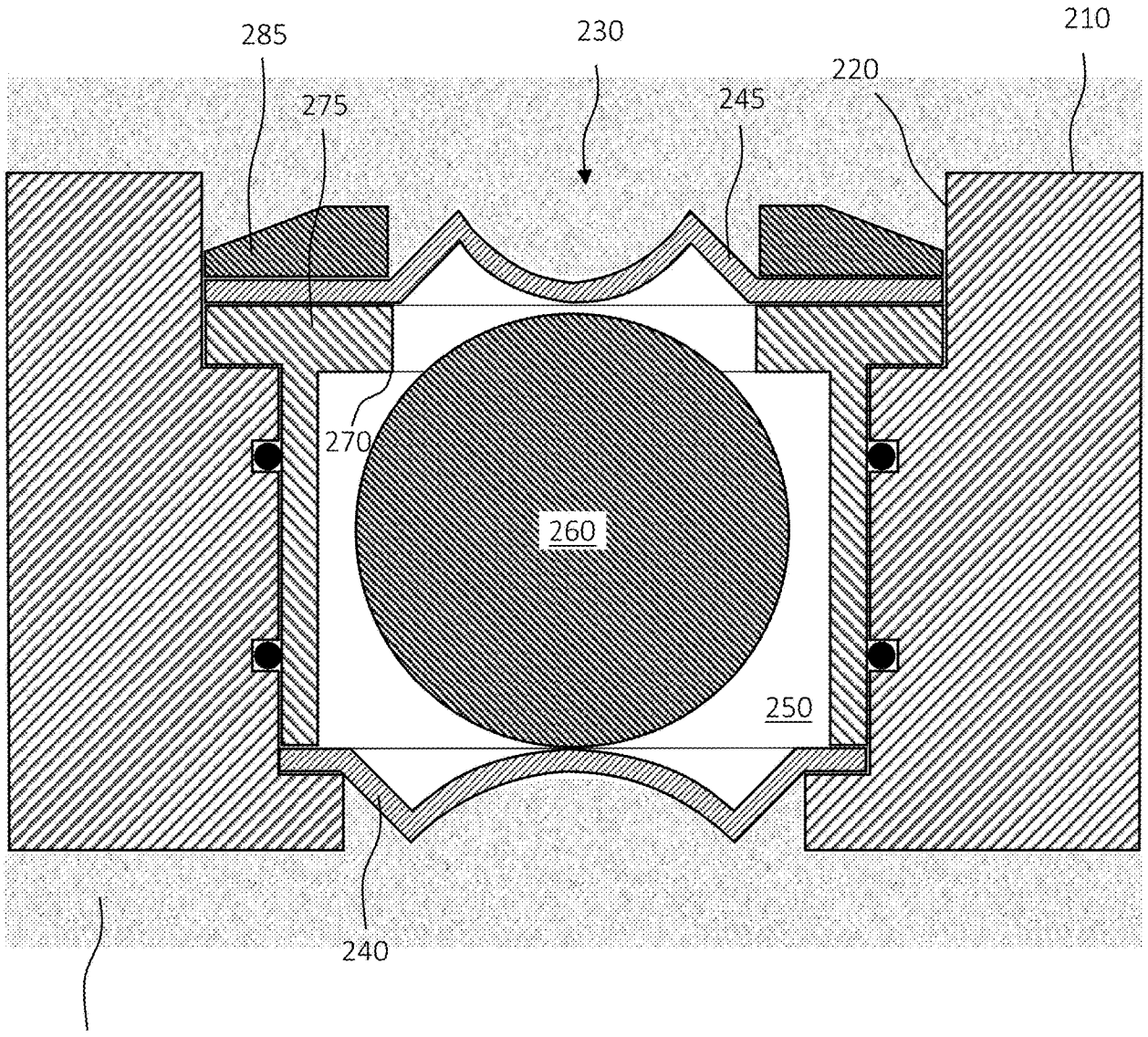
Figure 3I:
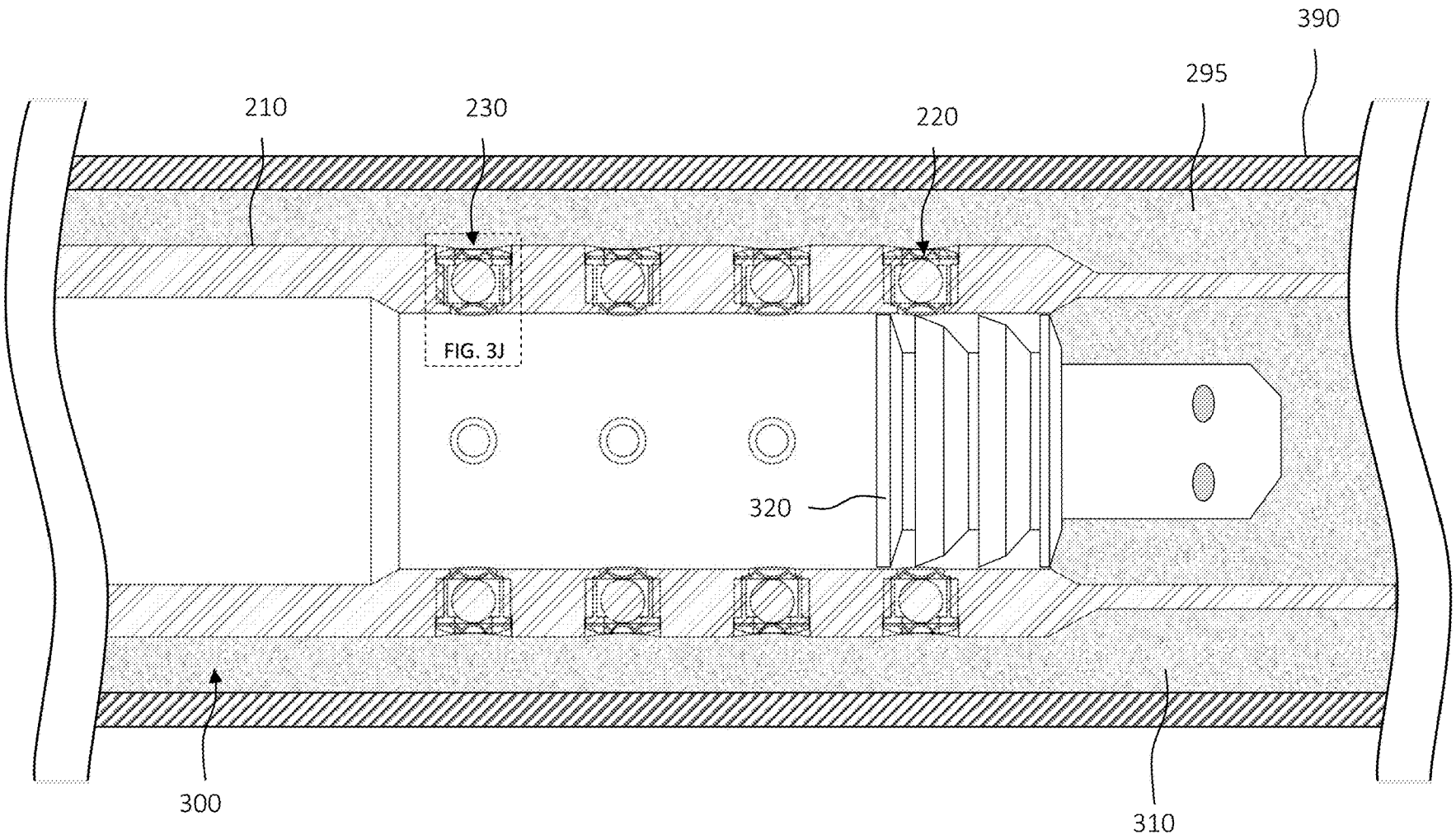
Figure 3J:
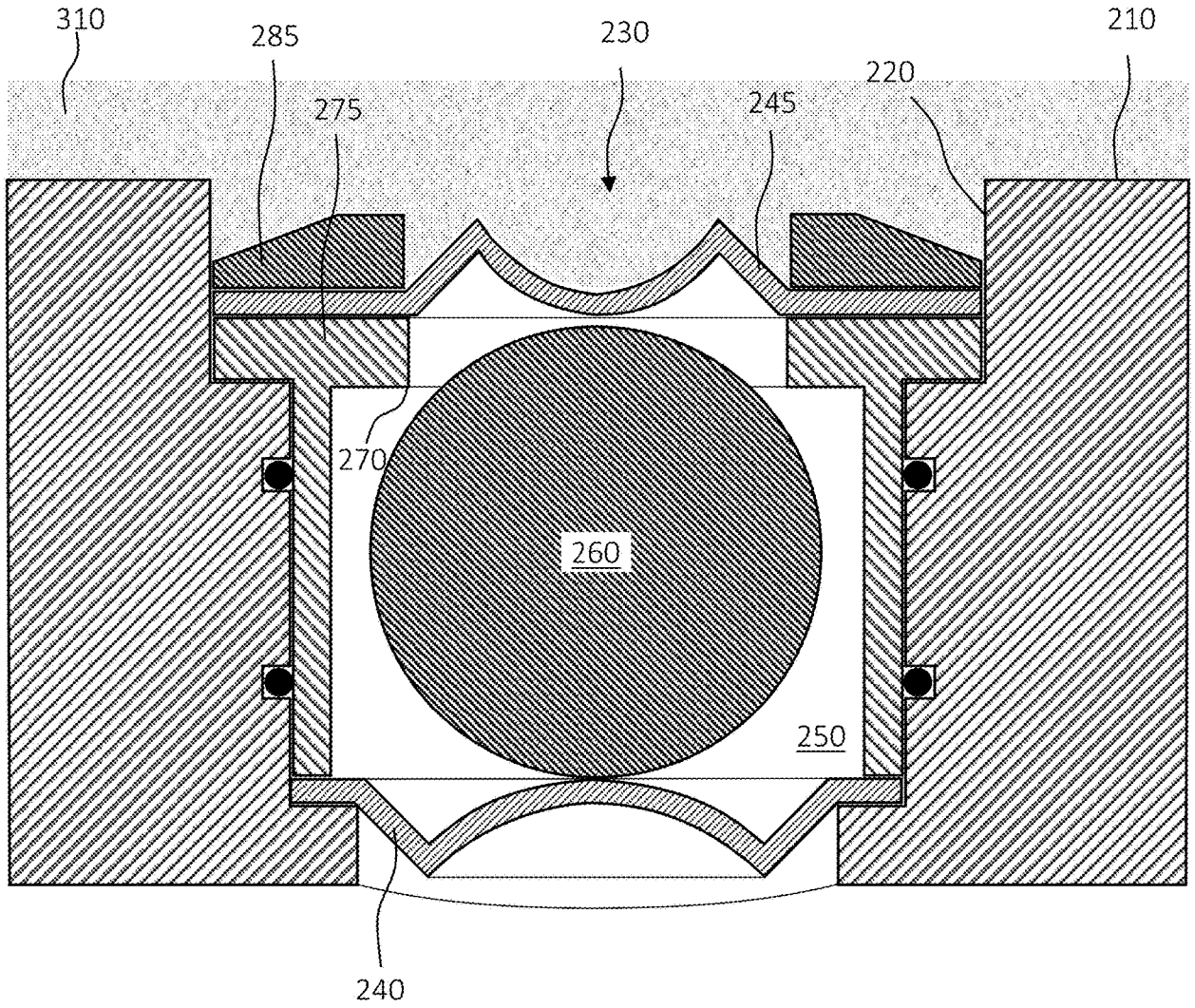
Figure 3K:
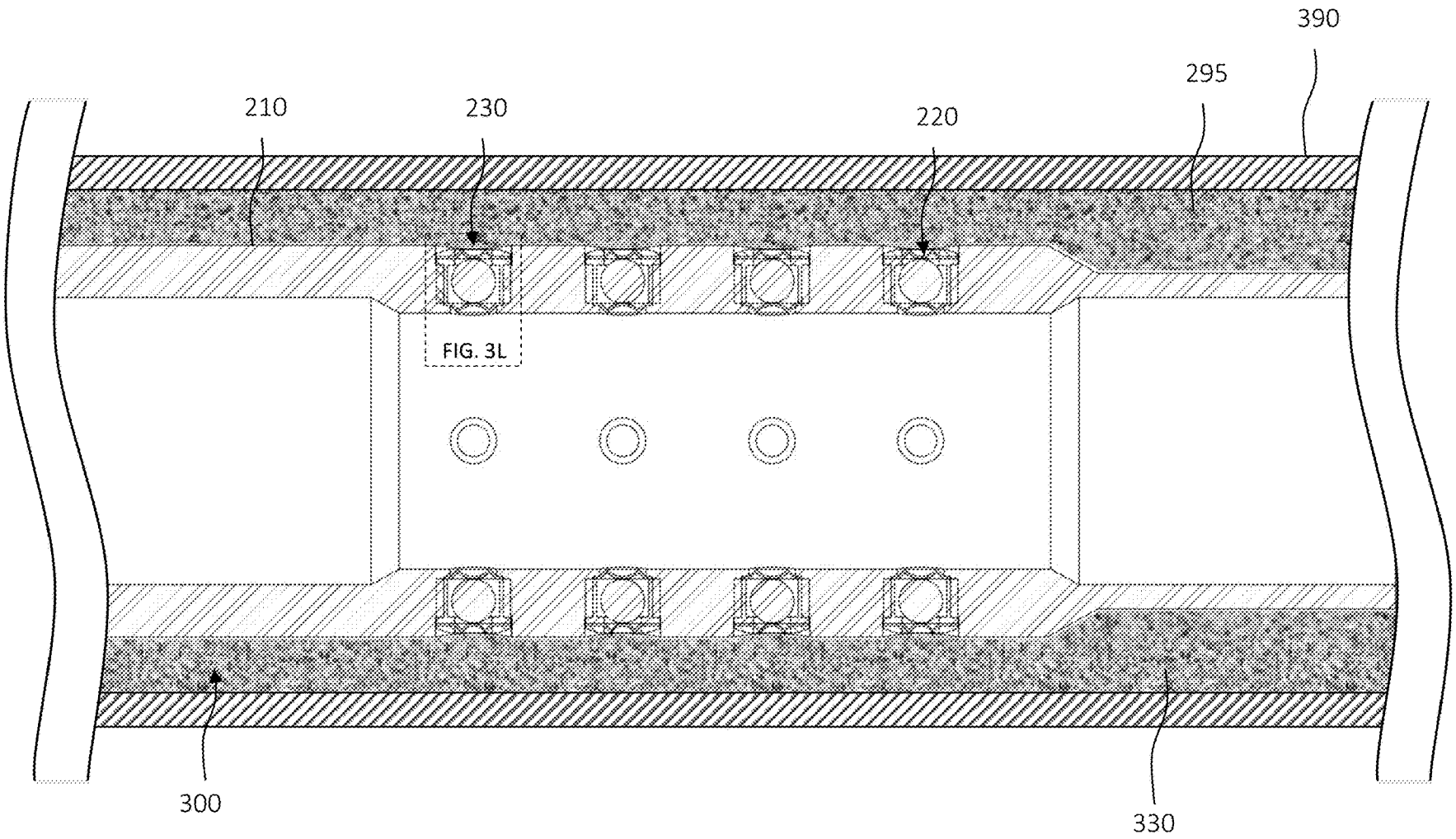
Figure 3L:
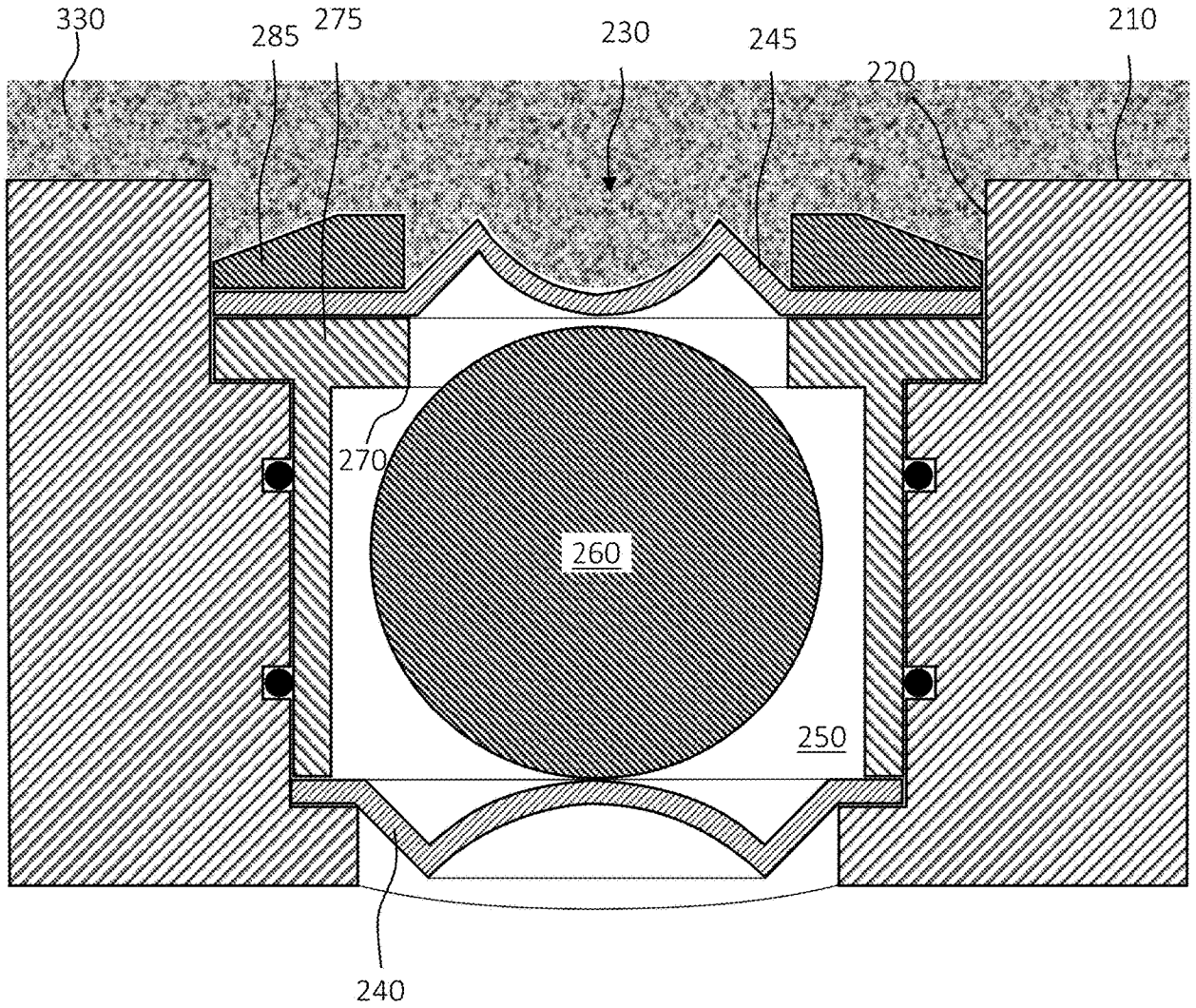
Figure 3M:
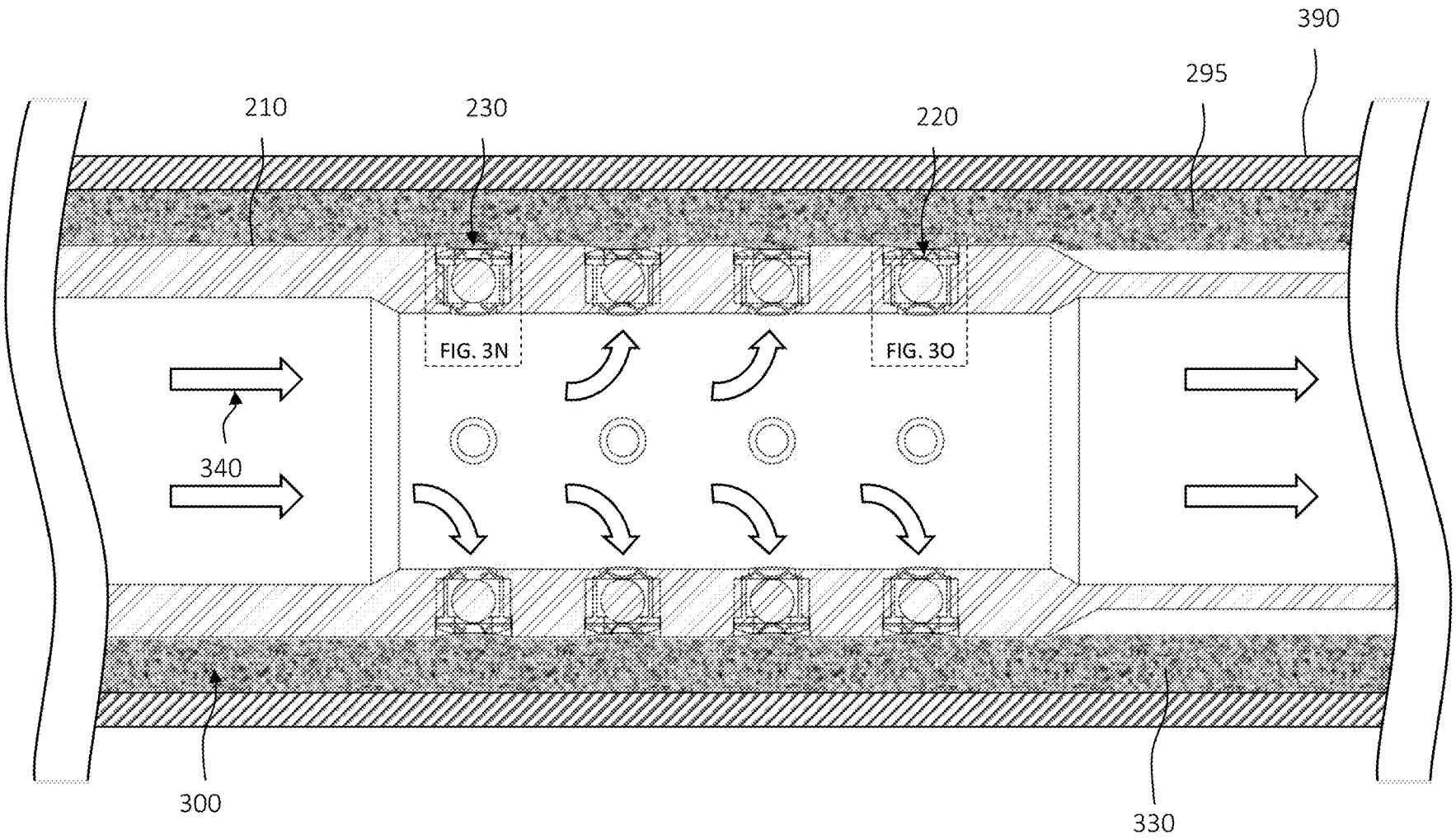
Figure 3N:
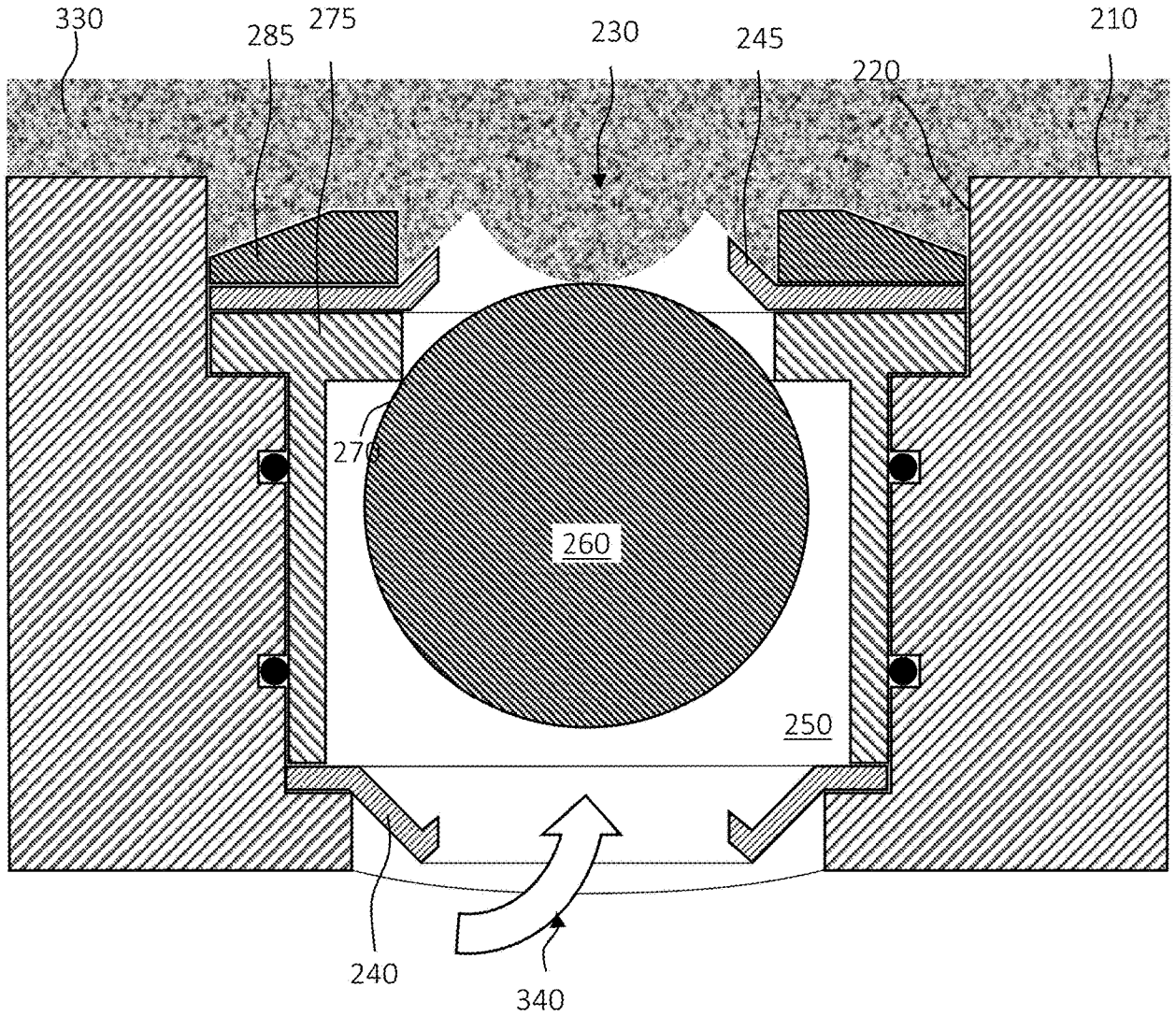
Figure 3O:
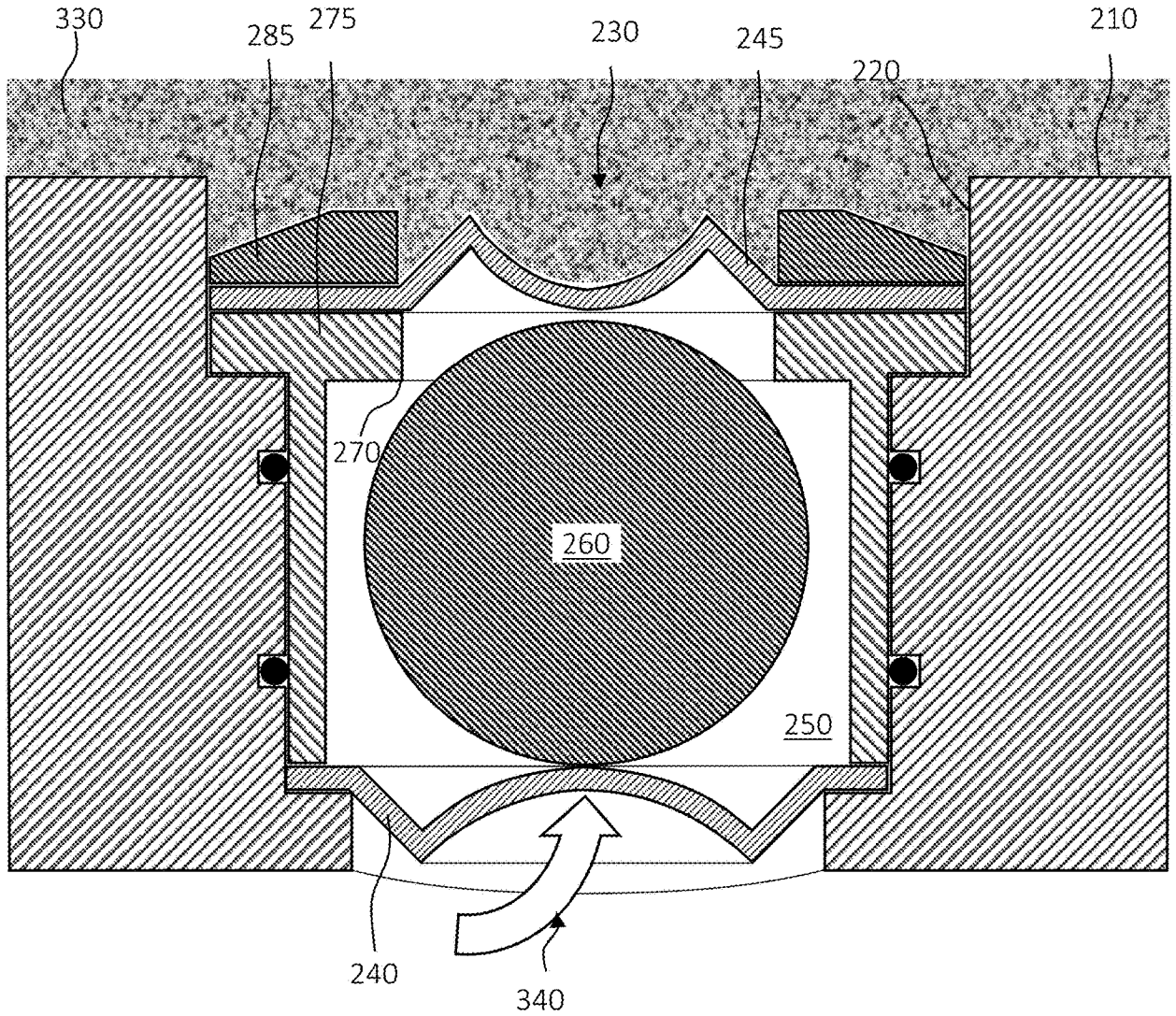
Figure 3P:
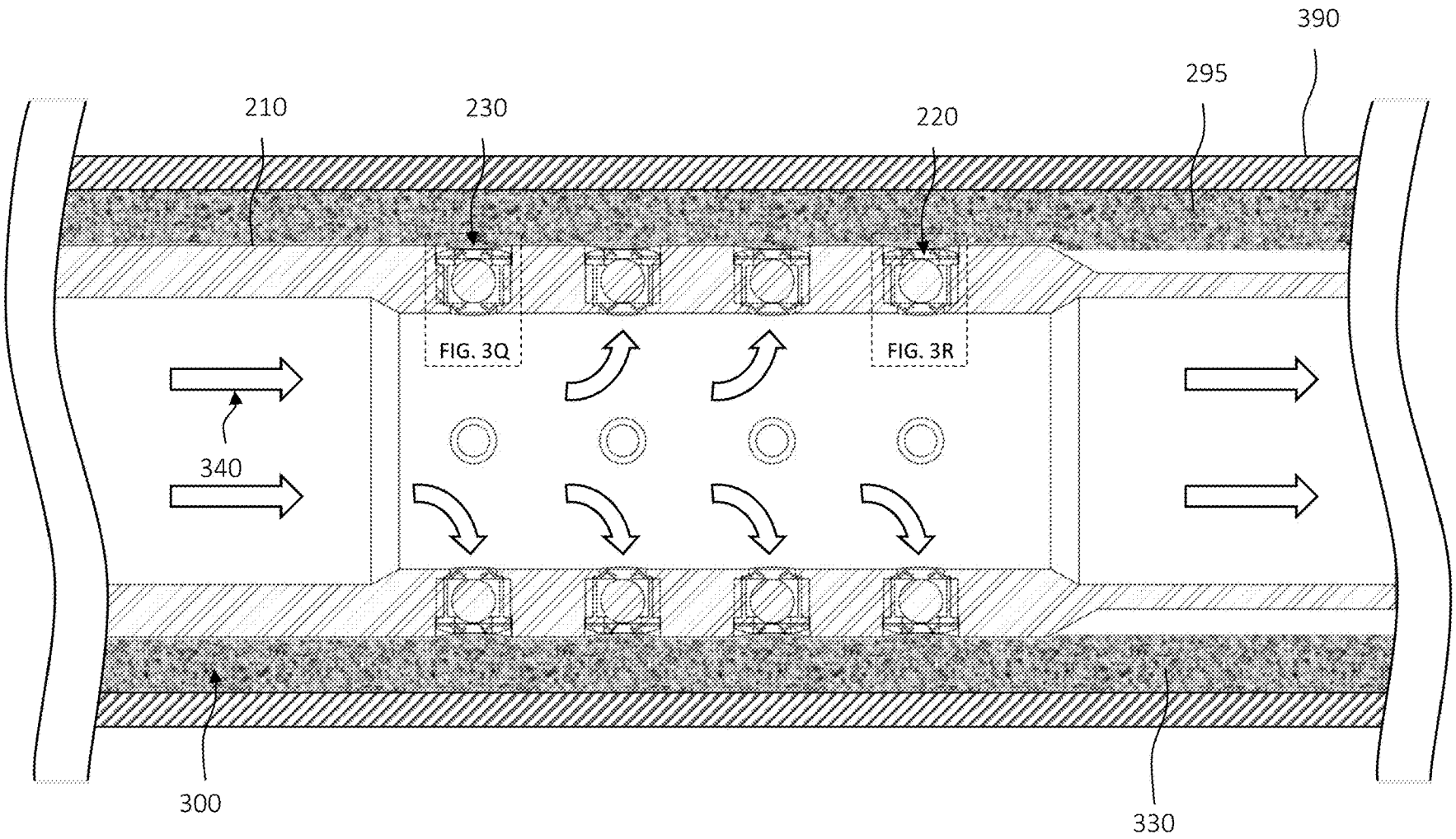
Figure 3Q:
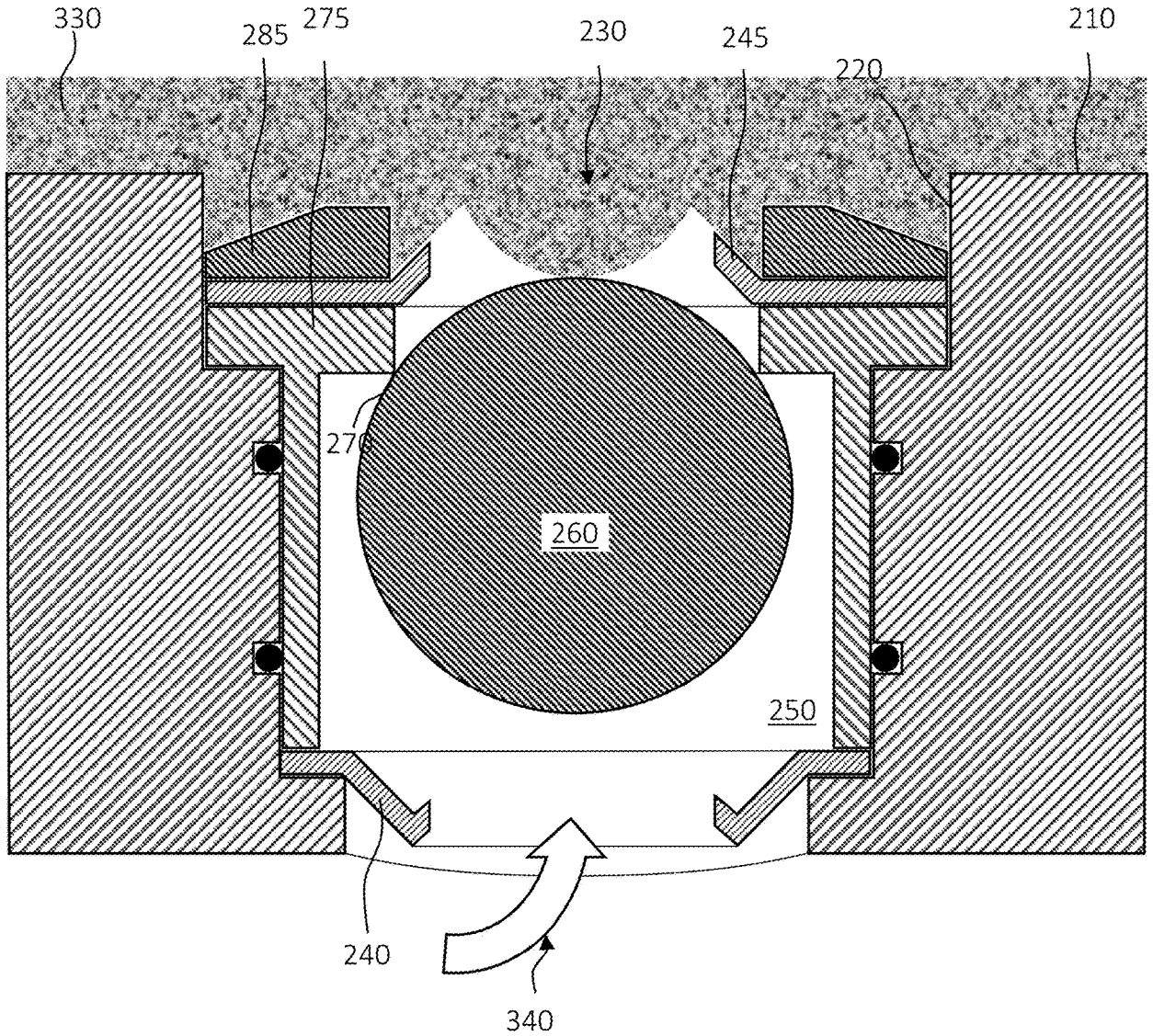
Figure 3R:
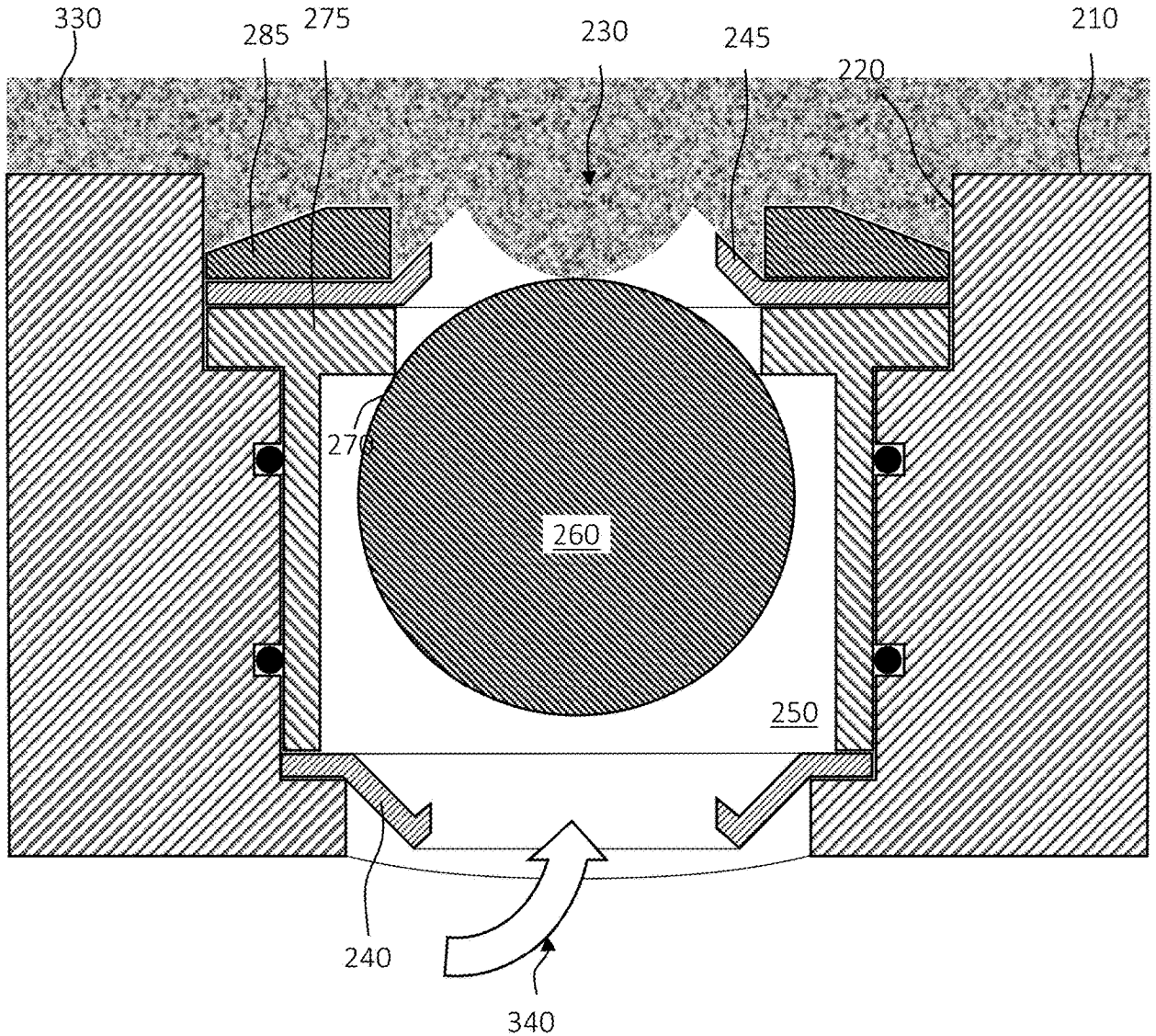
Figure 3S:
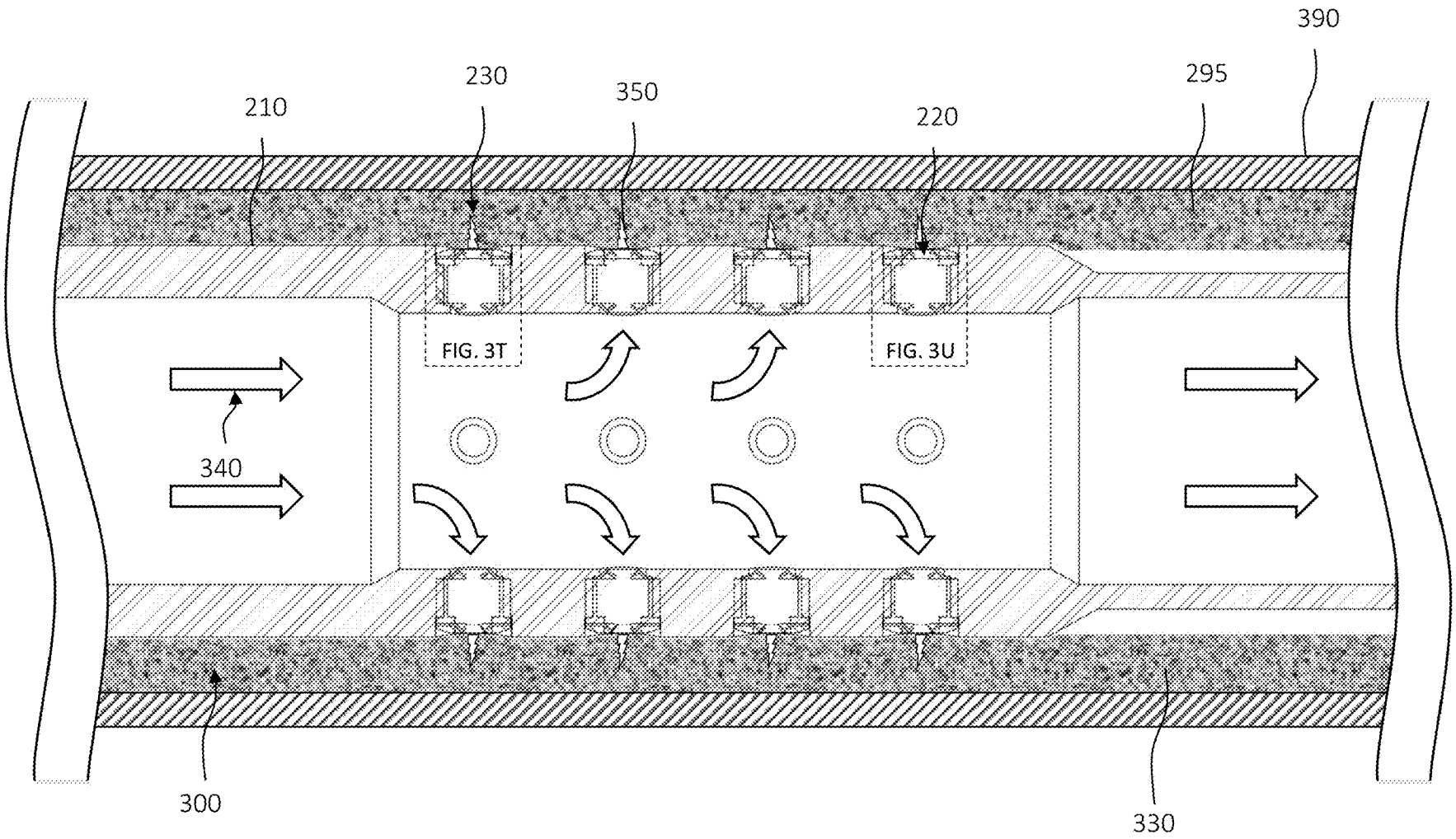
Figure 3T:
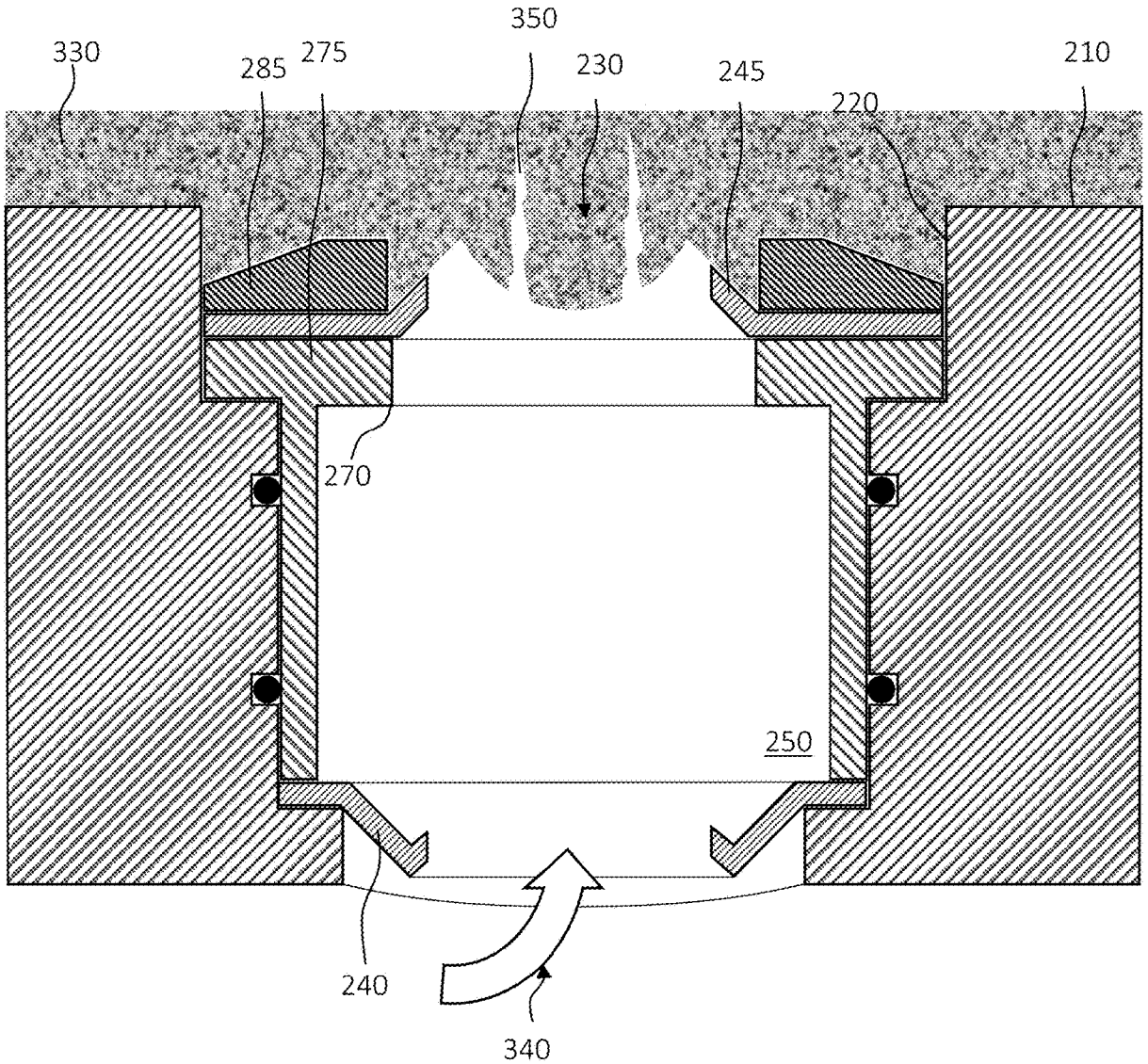
Figure 3U:
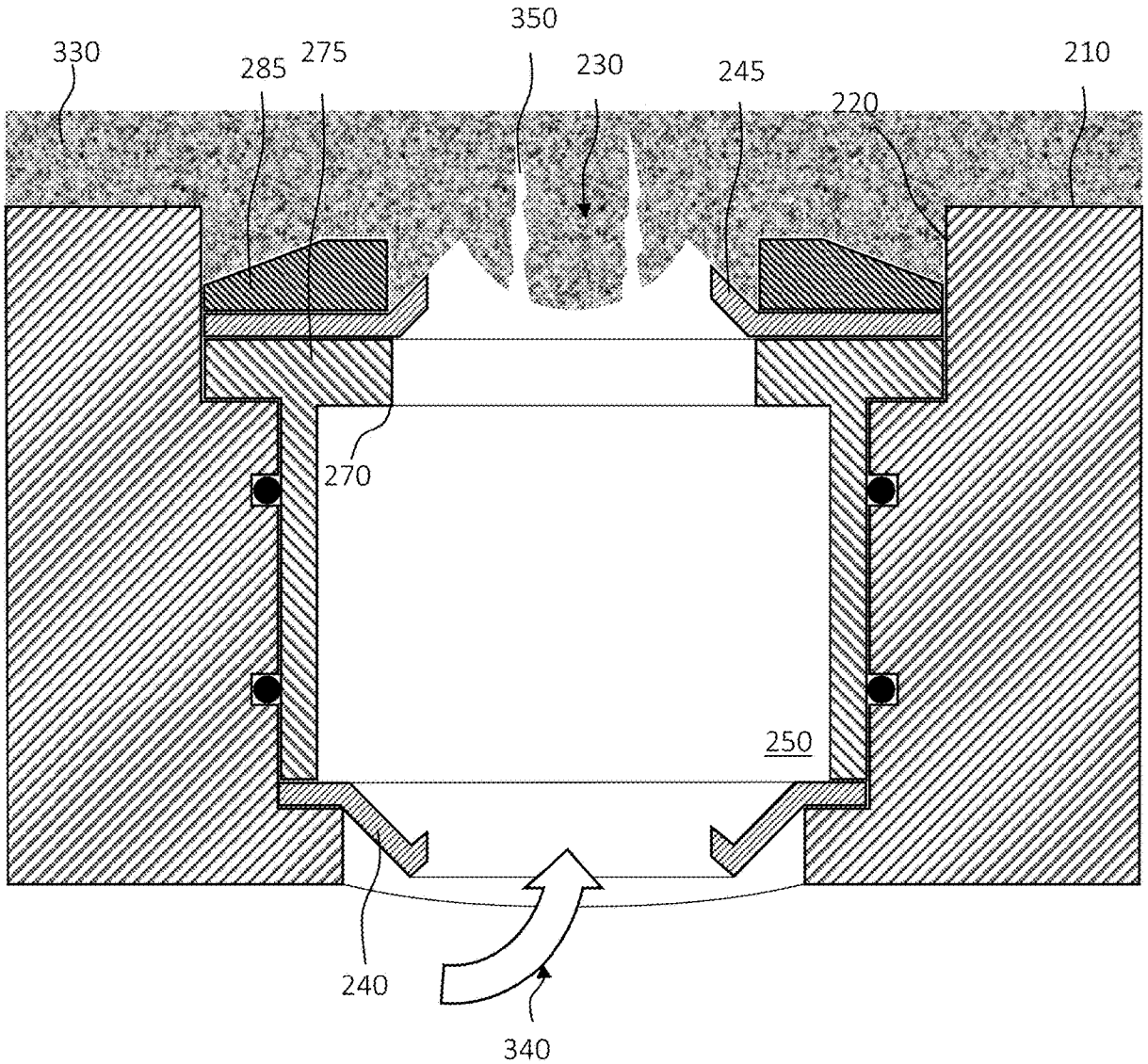
Figure 3V:
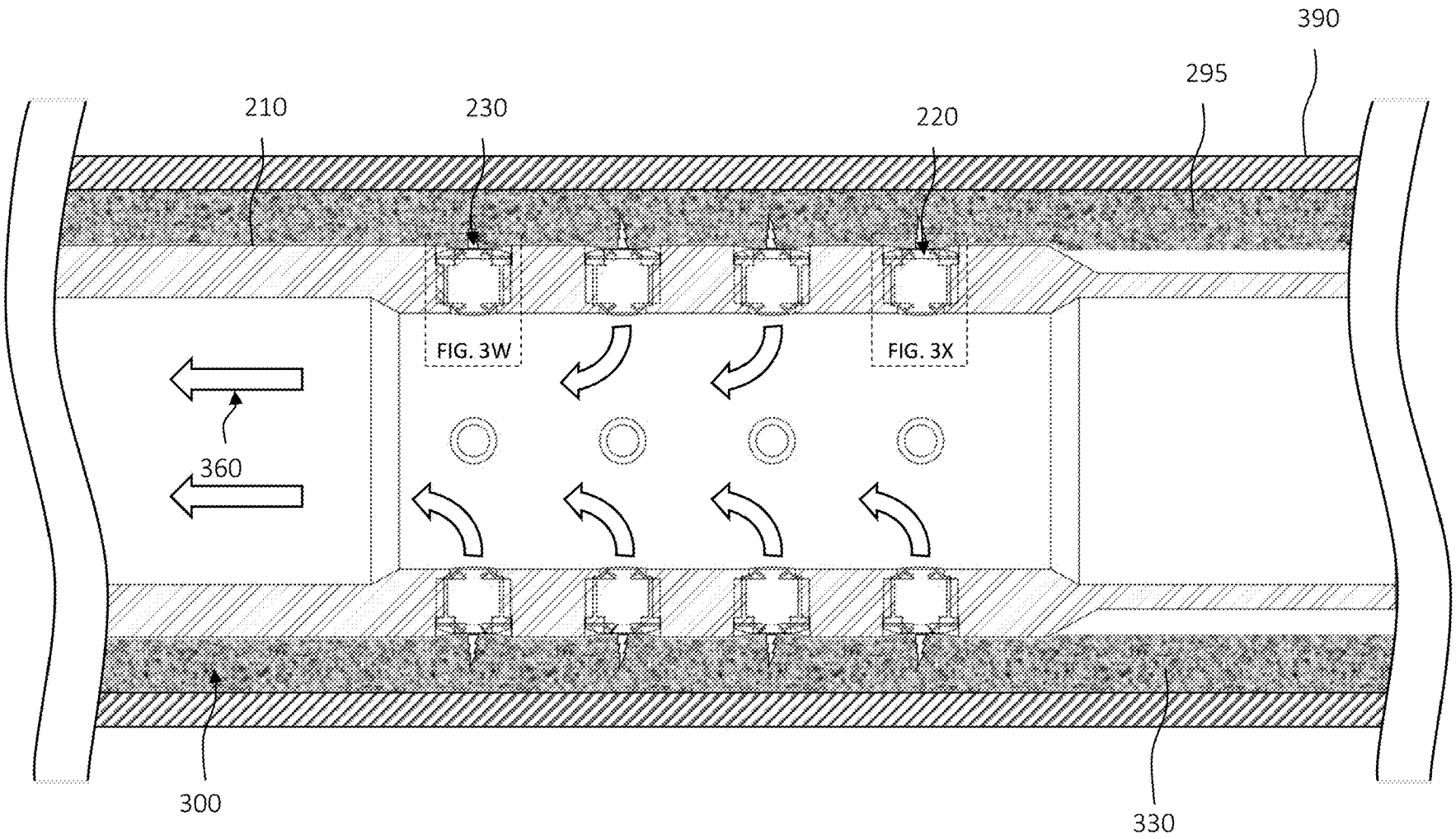
Figure 3W:
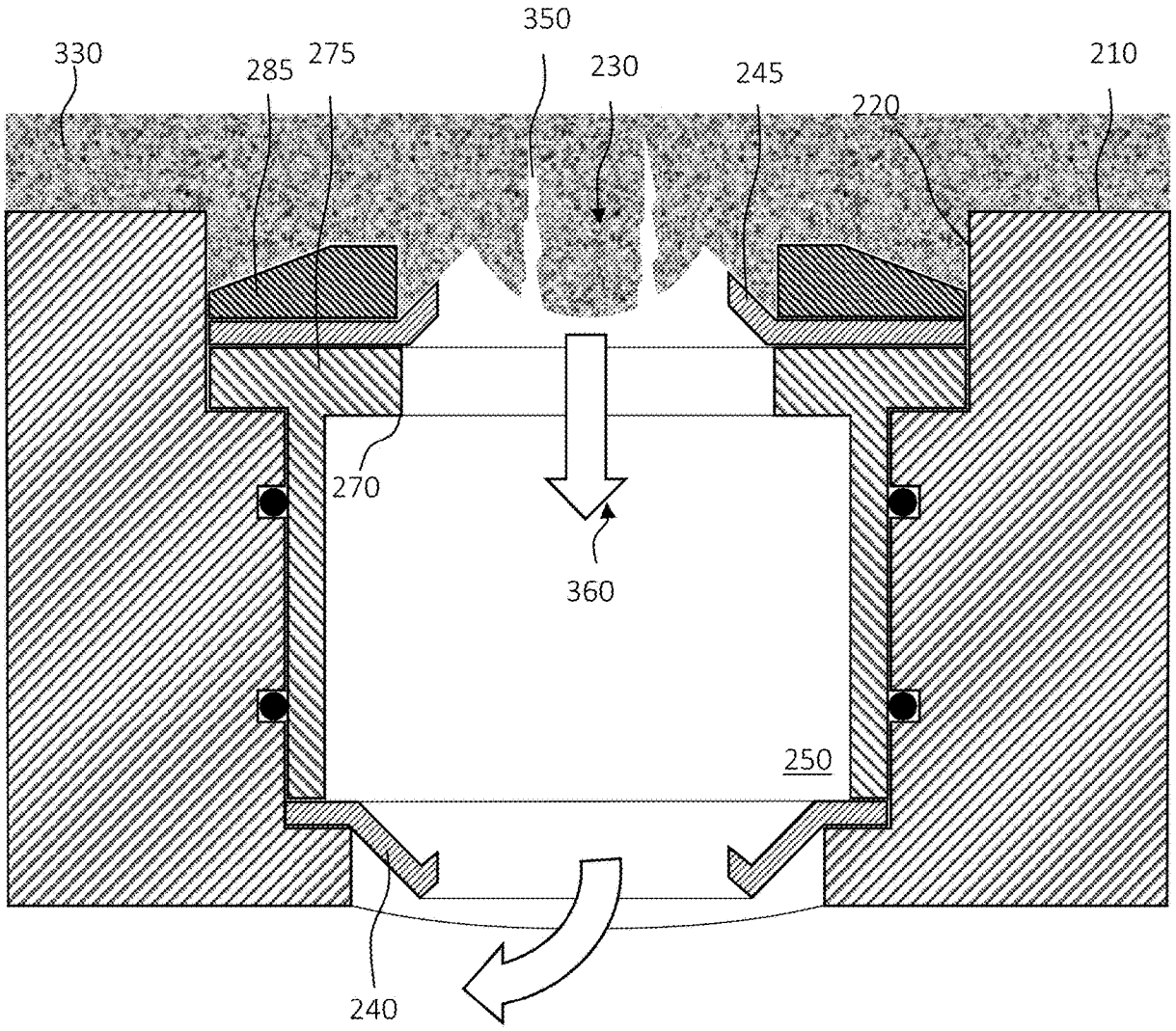
Figure 3X:
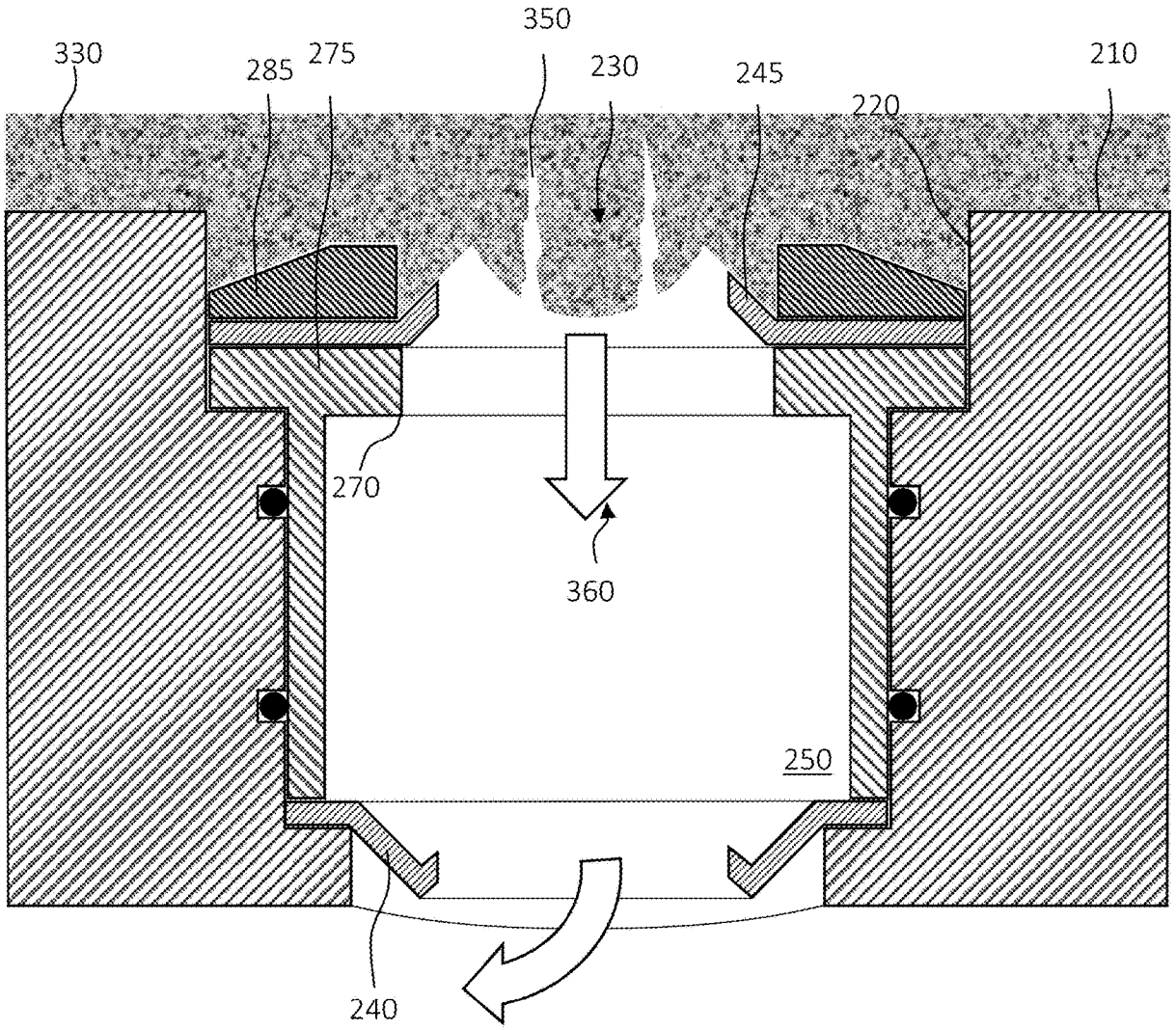

Turning to FIGS. 3A through 3X, illustrated is a process flow for employing a production sub 300 designed, manufactured and/or operated according to one or more embodiments of the disclosure, to cement, fracture and produce from a subterranean formation located proximate the wellbore 390, in accordance with one or more embodiments of the disclosure. The production sub 300 of FIGS. 3A through 3X shares many features as the production sub 200 of FIGS. 2A and 2B. Accordingly, like reference numbers will be used to indicate similar, if not identical, features.

With initial reference to FIGS. 3A and 3B, the production sub 300 is illustrated in its run-in-hole position. Accordingly, the radially interior burst disc 240 and the radially exterior burst disc 245 remain intact. Moreover, the chamber 250 is free from any fluids that might cause the sealing member 260 to dissolve.

With continued reference to FIGS. 3C and 3D, uncured cement 310 is being pumped within the ID of the tubular 210. At this point, all of the radially interior burst discs 240 and the radially exterior burst discs 245 remain intact. Moreover, the chambers 250 are free from any fluids that might cause the sealing member 260 to dissolve.

With continued reference to FIGS. 3E and 3F, uncured cement 310 continues being pumped within the ID of the tubular 210, and at this stage the uncured cement 310 has exited the production sub 300, and is now travelling back up the annulus 295. At this point, all of the radially interior burst discs 240 and the radially exterior burst discs 245 still remain intact. Moreover, the radially exterior burst discs 245 are protecting the other elements of the fluid flow assemblies 230 from the uncured cement 310. Additionally, the chambers 250 are still free from any fluids that might cause the sealing member 260 to dissolve.

With continued reference to FIGS. 3G and 3H, uncured cement 310 continues being pumped within the ID of the tubular 210, and at this stage the uncured cement 310 continues to fill the annulus 295 above the production sub 300. At this point, all of the radially interior burst discs 240 and the radially exterior burst discs 245 still remain intact, the radially exterior burst discs 245 are protecting the other elements of the fluid flow assemblies 230 from the uncured cement 310, and the chambers 250 are still free from any fluids that might cause the scaling member 260 to dissolve.

With continued reference to FIGS. 31 and 3J, a wiper plug 320 has been placed within the tubular 210, the wiper plug 320 pushing any remaining uncured cement 310 out of the production sub 300 and out into the annulus 295. In certain instances, drilling mud is used to displace the wiper plug 320 within the tubular 210. At this point, all of the radially interior burst discs 240 and the radially exterior burst discs 245 still remain intact, the radially exterior burst discs 245 are protecting the other elements of the fluid flow assemblies 230 from the uncured cement 310, and the chambers 250 are still free from any fluids that might cause the sealing member 260 to dissolve.

With continued reference to FIGS. 3K and 3L, the uncured cement 310 has been allowed to cure to form cured cement 330. At this point, all of the radially interior burst discs 240 and the radially exterior burst discs 245 still remain intact, the radially exterior burst discs 245 are protecting the other elements of the fluid flow assemblies 230 from the uncured cement 310, and the chambers 250 are still free from any fluids that might cause the sealing member 260 to dissolve.

With continued reference to FIGS. 3M through 3O, pressurized fluid 340 (e.g., fracturing fluid in one embodiment) is being pumped downhole within the tubular 210. The pressurized fluid 340, in at least one embodiment, begins to burst one or more of the radially interior burst discs 240 and radially exterior burst discs 245. As discussed above, the radially interior burst discs 240 and radially exterior burst discs 245 of the different fluid flow assemblies 230 may not all burst at the same time. When they do not, a pressure balance may occur. However, as shown in FIG. 3N, the sealing members 260 substantially seals against the sealing member seats 270 of those fluid flow assemblies that have had their radially interior burst discs 240 and radially exterior burst discs 245 burst, thereby keeping a high pressure differential needed to burst the remaining burst discs. In at least one embodiment, the sealing members 260 fully seals against the sealing members seats 270, in yet another embodiment the sealing members 260 provide an imperfect seal, which maintains the pressure differential, but also assists in bursting the exterior burst discs 245. FIG. 3O illustrates those fluid flow assemblies 230 that their radially interior burst discs 240 and radially exterior burst discs 245 have yet to burst.

With continued reference to FIGS. 3P through 3R, pressurized fluid 340 (e.g., fracturing fluid in one embodiment) continues to being pumped downhole within the tubular 210. The pressurized fluid 340, in at least one embodiment, continues to burst all the remaining radially interior burst discs 240 and radially exterior burst discs 245. Moreover, all of the scaling members 260 remain intact, and thus prevent the pressurized fluid 340 from accessing the cured cement 330.

With continued reference to FIGS. 3S through 3U, over time the sealing members 260 no longer seal against the sealing member seats 270. For example, in certain instance, the sealing members 260 dissolve enough to slip past the sealing member seats 270. In other embodiments, the sealing members 260 fully dissolve. In yet other embodiments, the sealing members 260 fall back into the tubular 210, such as might be the case if the pressurized fluid 340 were no longer being pumped downhole. Ultimately, as the pressurized fluid 340 continues to be impart upon the exposed cured cement 330 after the sealing members 260 no longer seal against the sealing member seats 270, fractures 350 in the cured cement 330 and/or wellbore 390 will form.

With continued reference to FIGS. 3V through 3X, at a point in time when the subterranean formation surrounding the wellbore 390 has been sufficiently fractured, pumping of the pressurized fluid 340 may cease, and production fluid 360 may be allowed to flow from the fractures 350.

Figure 4A:
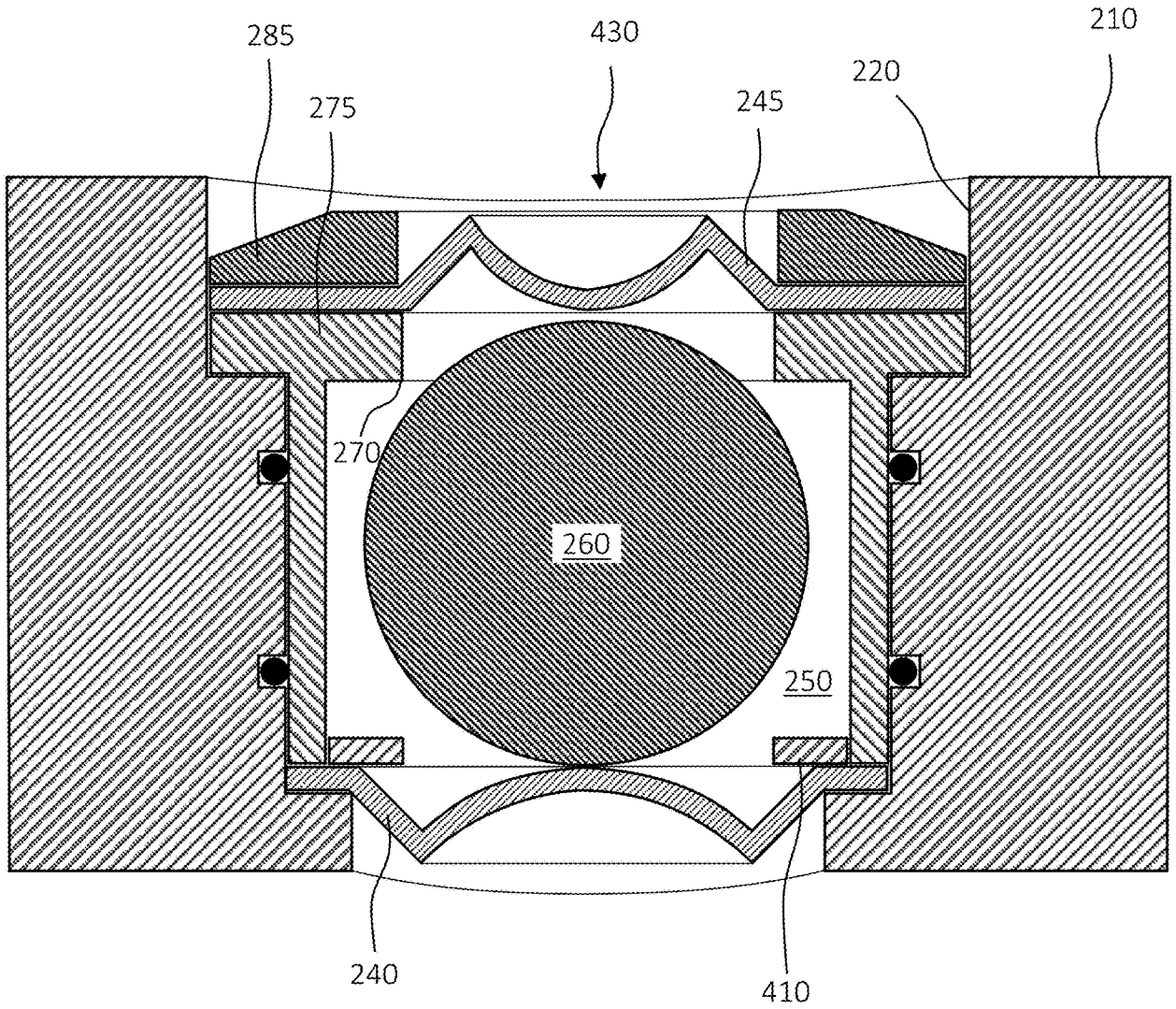
FIGS. 4A through 4C illustrate a process flow for employing a production sub employing a fluid flow assembly designed, manufactured and/or operated according to one or more embodiments of the disclosure, to cement, fracture and produce from a subterranean formation located proximate the wellbore, in accordance with one or more alternative embodiments of the disclosure.
Figure 4B:
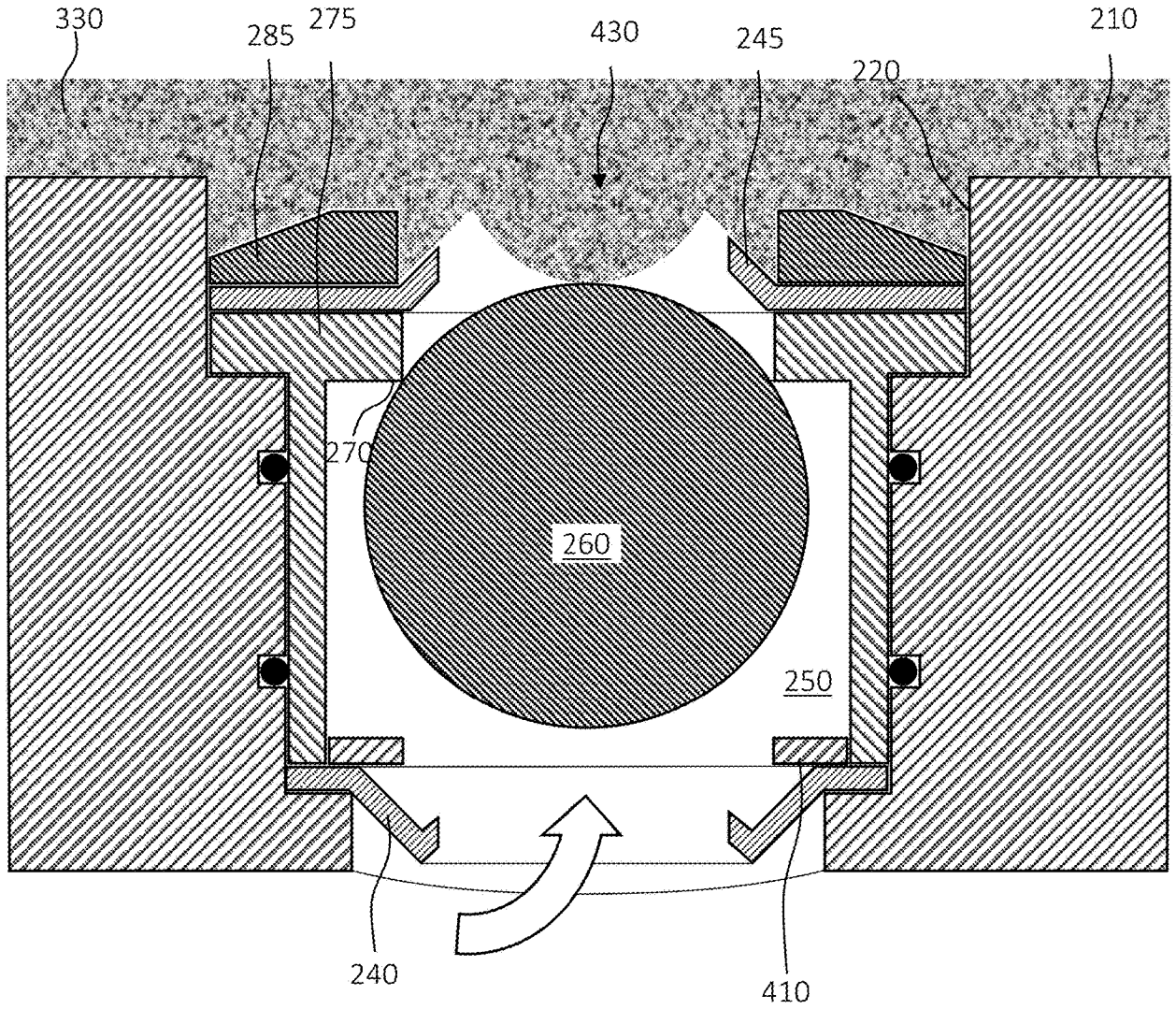
Figure 4C:
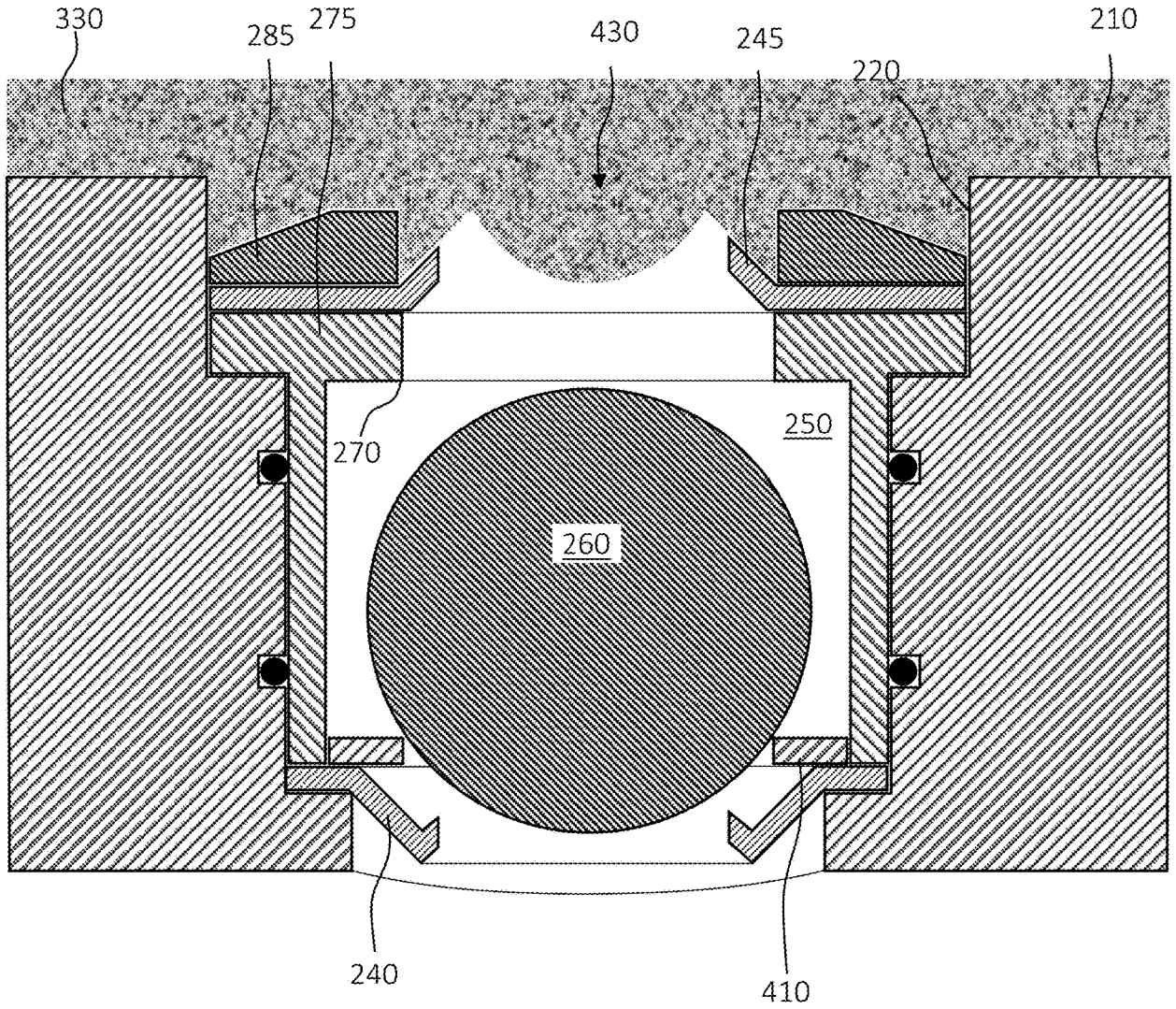

Turning to FIGS. 4A through 4C, illustrated is a process flow for employing a production sub employing a fluid flow assembly 430 designed, manufactured and/or operated according to one or more embodiments of the disclosure, to cement, fracture and produce from a subterranean formation located proximate the wellbore 390, in accordance with one or more alternative embodiments of the disclosure. The fluid flow assembly 430 of FIGS. 4A through 4C shares many features as the fluid flow assembly 230 of FIGS. 3A and 3X. Accordingly, like reference numbers will be used to indicate similar, if not identical, features. The fluid flow assembly 430 differs, for the most part, from the fluid flow assembly 230, in that the fluid flow assembly 430 additionally includes a sealing member trap 410 located in the chamber 250 proximate the radially interior burst disc 240. The sealing member trap 410, in this embodiment, is configured to prevent the sealing member 260 from falling back into the tubular 210 during one or more pressure cycles that may occur. As the sealing member 260 remains within the chamber 250 until such time as it dissolves, any number of pressure cycles may be used while continuing to achieve the requisite pressure differential required to burst all of the burst discs.

FIG. 4A illustrates the fluid flow assembly 430 in the run-in-hole state. Accordingly, the radially interior burst disc 240 and the radially exterior burst disc 245 remain intact. Moreover, the chamber 250 is free from any fluids that might cause the sealing member 260 to dissolve. FIG. 4B illustrates the fluid flow assembly 430 after one or more of its radially interior burst discs 240 and radially exterior burst discs 245 have burst. As shown in FIG. 4B, the sealing member 260 seals against the sealing member seat 270. FIG. 4C illustrates the fluid flow assembly 430 in the middle of two pressure cycles, the sealing member trap 410 preventing the sealing member 260 from falling back into the tubular 210, which could in turn prevent another pressure cycle.

Turning to FIGS. 5A and 5B, illustrated is one embodiment of a production sub 500 designed, manufactured and/or operated according to one or more embodiments of the disclosure, the production sub positioned within a wellbore 590. The wellbore 590, in one embodiment, is a main wellbore. The wellbore 590, in yet another embodiment, is a lateral wellbore.

In the illustrated embodiment of FIGS. 5A and 5B, the production sub 500 includes a tubular 510 having a length (l), an inside diameter (ID), an outside diameter (OD), and a sidewall thickness (t). The production sub 500, in the illustrated embodiment, further includes a plurality of production ports 520 extending through the sidewall thickness (t) and coupling the inside diameter (ID) and the outside diameter (OD). In at least one embodiment, the production sub 500 includes a first set of radially spaced apart production ports 520*a* and a second set of radially spaced apart production ports 520*b*, the first and second sets 520*a*, 520*b* axially offset from one another along the length (l). In the illustrated embodiment, the production sub 500 includes at least four sets of radially spaced apart production ports 520*a*, 520*b*, 520*c*, 520*d*. Nevertheless, the present disclosure is not limited to any specific number of production ports.

In the embodiment of FIGS. 5A and 5B, a fluid flow assembly 530 designed, manufactured and/or operated according to one or more embodiments of the disclosure is positioned in each of the production ports 520. In the embodiment of FIGS. 5A and 5B, the fluid flow assemblies 530 include a radially interior burst disc 540. In one or more embodiments, the radially interior burst disc 540 is configured to have a higher ID burst rating and a lower OD burst rating.

In the embodiment of FIGS. 5A and 5B, the fluid flow assembly 530 additionally includes a degradable fluid flow orifice 550 positioned radially outside of the radially interior burst disk 540. In at least one embodiment, the degradable fluid flow orifice 550 is configured to keep a pressure differential inside and outside of the tubular 510 as the radially interior burst discs 540 of the production sub 500 continue to be burst. Nevertheless, the degradable fluid flow orifice 550 is also configured to degrade over time after the radially interior burst discs 540 have all burst, in doing so increasing a flow volume through the production ports 520 of the production sub 500.

In at least one embodiment, the degradable fluid flow orifice 550 is an erodible fluid flow orifice having a hardness less than a hardness of the tubular 510. Accordingly, over time, the erodible fluid flow orifice would erode away, in doing so increasing a flow volume through the production ports 520 of the production sub 500. The erosion may occur, in one embodiment, during a fracturing phase, or in an alternative embodiment, during the production phase. In at least one embodiment, a time that it takes for the erodible fluid flow orifice to fully erode after the radially interior burst discs 540 have burst may be tailored, for example changing the size and/or material properties of the erodible fluid flow orifice. Accordingly, the erodible fluid flow orifice, in at least one embodiment, has a hardness at least 20% less than a hardness of the tubular 510. The erodible fluid flow orifice, in at least one other embodiment, has a hardness at least 50% less than a hardness of the tubular 510, and in yet another embodiment at least 80% less than a hardness of the tubular 510. Furthermore, in at least one embodiment, the erodible fluid flow orifice comprises a low alloy steel, an Aluminum alloy, a Brass alloy, a Copper alloy, a Magnesium alloy, an Iron-Carbon alloy, among others.

In yet another embodiment, the degradable fluid flow orifice 550 is a dissolvable fluid flow orifice. Accordingly, over time, the dissolvable fluid flow orifice would dissolve away, in doing so increasing a flow volume through the production ports 520 of the production sub 500. In at least one embodiment, a time that it takes for the dissolvable fluid flow orifice to fully dissolve after the radially interior burst discs 540 have burst may be tailored, for example changing the size and/or material properties of the dissolvable fluid flow orifice. In at least one other embodiment, a protective layer may be positioned about the dissolvable fluid flow orifice to increase an amount of time that passes prior to dissolving. Those skilled in the art understand the various different materials and/or protective layers that might be used to achieve the desired purpose of the dissolvable fluid flow orifice.

In the embodiment of FIGS. 5A and 5B, the fluid flow assembly 530 additionally includes a dissolvable plug 560 sealing the degradable fluid flow orifice 550. The dissolvable plug 560, in at least one embodiment, protects the radially interior burst disc 540 from any debris and/or cement that may exist outside of the production port 520. Nevertheless, once the cement existing outside of the production ports 520 cures, the dissolvable plug 560 may fully dissolve, or turn to a pliable material (e.g., liquid, gel, paste, etc.) that will be pushed out of the degradable fluid flow orifice 550 when the degradable fluid flow orifice 550 receives the slightest of pressure from the ID of the tubular 510. In at least one embodiment, the dissolvable plug 560 is configured to dissolve prior to the degradable fluid flow orifice 550 degrading. In at least one embodiment, the dissolvable plug 560 is configured to dissolve days, weeks, months or years prior to the degradable fluid flow orifice 550 degrading. In at least one embodiment, the dissolvable plug 560 comprises a Magnesium based alloy, an Aluminum based alloy, a (PGA) Polyglycolic acid polymer, a (PLA) Polylactic acid polymer, a (PHBV) Poly hydroxybutyrate-co-Hydroxy valerate polymer, or another synthetic or natural biodegradable polymer. In certain embodiments, the dissolvable plug 560 may comprise a material that helps break up the cured cement in the annulus surrounding the production ports. For example, in at least one embodiment the dissolvable plug 560 may comprise one of the acids disclosed above, which may provide this added benefit.

The degradable fluid flow orifice 550, and the dissolvable plug 560 in the illustrated embodiment, may form part of a housing 570 located within the production port 520. In accordance with this embodiment, one or more sealing elements 580 may be positioned between the degradable fluid flow orifice 550 and the production port 520, or alternatively between the housing 570 and the production port 520. The one or more sealing elements 580 may be any known or subsequently discovered sealing element and remain within the scope of the disclosure.

The fluid flow assembly 530 may be assembled within the production port 520 using a variety of different methods. In at least one embodiment, however, the radially interior burst disc 540 is first placed within the production port 520. Thereafter, the housing 570 may be dropped within the production port 520 upon the radially interior burst disc 540, followed by the degradable fluid flow orifice 550 having the dissolvable plug 560 therein. In at least one embodiment, the degradable fluid flow orifice 550 is threadingly engaged with the production port 220, thereby holding the entire fluid flow assembly 530 within the production port 520. In yet another embodiment, the degradable fluid flow orifice 550 is press fit within the production port 220, held with a screw within the production port 520, etc., among other mechanisms for coupling the two. In yet another embodiment, a coupling member (now shown, but similar to the coupling member 285 of FIGS. 2A and 2B), may be used to secure the fluid flow assembly 530 within the production port 520. In yet even another embodiment, the radially interior burst disc 540, the housing 570, and the degradable fluid flow orifice 550 having the dissolvable plug 560 therein are a single premanufactured assembly. Accordingly, the single premanufactured assembly could be insert within the production port 520, and then held in place using one or more of the coupling mechanisms discussed above.

Turning to FIGS. 6A through 6Z, illustrated is a process flow for employing a production sub 600 designed, manufactured and/or operated according to one or more embodiments of the disclosure, to cement, fracture and produce from a subterranean formation located proximate the wellbore 690, in accordance with one or more embodiments of the disclosure. The production sub 600 of FIGS. 6A through 6Z shares many features as the production sub 500 of FIGS. 5A and 5B. Accordingly, like reference numbers will be used to indicate similar, if not identical, features.

With initial reference to FIGS. 6A and 6B, the production sub 600 is illustrated in its run-in-hole position. Accordingly, the radially interior burst disc 540 and the degradable fluid flow orifice 550 having the dissolvable plug 560 therein remain intact.

With continued reference to FIGS. 6C and 6D, uncured cement 610 is being pumped within the ID of the tubular 510. At this point, all of the radially interior burst discs 540 and the degradable fluid flow orifice 550 having the dissolvable plug 560 therein remain intact.

With continued reference to FIGS. 6E and 6F, uncured cement 610 continues being pumped within the ID of the tubular 510, and at this stage the uncured cement 610 has exited the production sub 600, and is now travelling back up the annulus 595. At this point, all of the radially interior burst discs 540 and the degradable fluid flow orifice 550 having the dissolvable plug 560 therein still remain intact. Moreover, the degradable fluid flow orifices 550 having the dissolvable plugs 560 therein are protecting the radially interior burst discs 540 from the uncured cement 610.

With continued reference to FIGS. 6G and 6H, uncured cement 610 continues being pumped within the ID of the tubular 510, and at this stage the uncured cement 610 continues to fill the annulus 595 above the production sub 600. At this point, all of the radially interior burst discs 540 and the degradable fluid flow orifice 550 having the dissolvable plug 560 therein still remain intact, and the degradable fluid flow orifices 550 having the dissolvable plugs 560 therein are protecting the radially interior burst discs 540 from the uncured cement 610.

With continued reference to FIGS. 6I and 6J, a wiper plug 620 has been placed within the tubular 510, the wiper plug 620 pushing any remaining uncured cement 610 out of the production sub 600 and out into the annulus 595. In certain instances, drilling mud is used to displace the wiper plug 620 within the tubular 510. At this point, all of the radially interior burst discs 540 and the degradable fluid flow orifices 550 remain intact. However, about this time, fluid from the annulus 595, fluid from the uncured cement, and/or fluid from the subterranean formation may begin to dissolve the dissolvable plugs 560. In certain embodiments the dissolvable plugs 560 are fully dissolved, but in other embodiments the dissolvable plugs 560 turn into a pliable material 635, as discussed above.

With continued reference to FIGS. 6K and 6L, the uncured cement 610 has been allowed to cure to form cured cement 630. At this point, all of the radially interior burst discs 540 and the degradable fluid flow orifice 550 remain intact. Furthermore, in at least one embodiment all of the dissolvable plugs 560 have fully dissolved.

With continued reference to FIGS. 6M through 6O, pressurized fluid 640 (e.g., fracturing fluid in one embodiment) is being pumped downhole within the tubular 510. The pressurized fluid 640, in at least one embodiment, begins to burst one or more of the radially interior burst discs 540. As discussed above, the radially interior burst discs 540 of the different fluid flow assemblies 530 may not all burst at the same time. When they do not, a pressure balance may occur. However, as shown in FIG. 6N, the degradable fluid flow orifices 550 remain, thereby keeping a high pressure differential needed to burst the remaining burst discs. FIG. 6O illustrates those fluid flow assemblies 530 that their radially interior burst discs have yet to burst.

With continued reference to FIGS. 6P through 6R, pressurized fluid 640 (e.g., fracturing fluid in one embodiment) continues to being pumped downhole within the tubular 510. The pressurized fluid 640, in at least one embodiment, continues to burst all the remaining radially interior burst discs 540. Moreover, all of the degradable fluid flow orifices 550 remain intact.

With continued reference to FIGS. 6S through 6U, as the pressurized fluid 640 continues to be impart upon the exposed cured cement 630, fractures 650 in the cured cement 630 and/or wellbore 690 will form.

With continued reference to FIGS. 6V through 6X, at a point in time when the subterranean formation surrounding the wellbore 690 has been sufficiently fractured, pumping of the pressurized fluid 640 may cease, and production fluid 660 may be allowed to flow from the fractures 650.

With continued reference to FIGS. 6Y and 6Z, over time the production fluid 660 may degrade the degradable fluid flow orifices 550. For example, wherein the degradable fluid flow orifices 550 are erodible fluid flow orifices, the production fluid 660 could erode the erodible fluid flow orifices to increase a flow area of the production sub 600. While this embodiment has illustrated that the production fluid 660 degrades the degradable fluid flow orifices 550, other embodiments may exist wherein the pressurized fluid 640 (e.g., the fracturing fluid of FIG. 6S through 6U) degrades the degradable fluid flow orifices 550, as well as any combination of the two.

The embodiment of FIGS. 6A through 6Z is but one process flow for bursting all of the burst discs 545. In one or more other embodiments, the dissolvable plugs 560 dissolve or become pliable after the uncured cement 610 is allowed to cure to form the cured cement 630. In fact, given the time that typically results between cementing the annulus 595, it may be days, months or years before it would be necessary for the dissolvable plugs 560 to have dissolved or become pliable. Accordingly, the time period necessary for the dissolvable plugs 560 to dissolve or become pliable may be tailored based upon the needs of the user.

Aspects Disclosed Herein Include:

A. A production sub, the production sub including: 1) a tubular having a length (l), an inside diameter (ID), an outside diameter (OD), and a sidewall thickness (t); 2) a plurality of production ports extending through the sidewall thickness (t) and coupling the inside diameter (ID) and the outside diameter (OD); and 3) a fluid flow assembly positioned in each of the plurality of production ports, each fluid flow assembly including: a) a radially interior burst disc; b) a radially exterior burst disc; c) a sealing member positioned in a chamber created between the radially interior burst disc and the radially exterior burst disc; and d) a sealing member seat located in the chamber proximate the radially exterior burst disc, the sealing member configured to engage with the sealing member seat as fluid is pushing the sealing member radially outward.

B. A well system, the well system including: 1) a wellbore extending through one or more subterranean formations; 2) production tubing located within the wellbore; 3) a production sub coupled to the production tubing, the production sub including: a) a tubular having a length (1), an inside diameter (ID), an outside diameter (OD), and a sidewall thickness (t); b) a plurality of production ports extending through the sidewall thickness (t) and coupling the inside diameter (ID) and the outside diameter (OD); and c) a fluid flow assembly positioned in each of the plurality of production ports, each fluid flow assembly including: i) a radially interior burst disc; ii) a radially exterior burst disc; iii) a sealing member positioned in a chamber created between the radially interior burst disc and the radially exterior burst disc; and iv) a sealing member seat located in the chamber proximate the radially exterior burst disc, the sealing member configured to engage with the sealing member seat as fluid is pushing the sealing member radially outward.

C. A method, the method including: 1) forming a wellbore through one or more subterranean formations; and 2) positioning production tubing having a production sub coupled thereto within the wellbore, the production sub including: a) a tubular having a length (l), an inside diameter (ID), an outside diameter (OD), and a sidewall thickness (t); b) a plurality of production ports extending through the sidewall thickness (t) and coupling the inside diameter (ID) and the outside diameter (OD); and c) a fluid flow assembly positioned in each of the plurality of production ports, each fluid flow assembly including: i) a radially interior burst disc; ii) a radially exterior burst disc; iii) a sealing member positioned in a chamber created between the radially interior burst disc and the radially exterior burst disc; and iv) a sealing member seat located in the chamber proximate the radially exterior burst disc, the sealing member configured to engage with the sealing member seat as fluid is pushing the sealing member radially outward.

D. A production sub, the production sub including: 1) a tubular having a length (l), an inside diameter (ID), an outside diameter (OD), and a sidewall thickness (t); 2) a plurality of production ports extending through the sidewall thickness (t) and coupling the inside diameter (ID) and the outside diameter (OD); and 3) a fluid flow assembly positioned in each of the plurality of production ports, each fluid flow assembly including: a) a radially interior burst disc; and b) a degradable fluid flow orifice positioned radially outside of the radially interior burst disk, the degradable fluid flow orifice configured to degrade over time after the radially interior burst disc has burst to increase a flow volume through the production port.

E. A well system, the well system including: 1) a wellbore extending through one or more subterranean formations; 2) production tubing located within the wellbore; 3) a production sub coupled to the production tubing, the production sub including: a) a tubular having a length (1), an inside diameter (ID), an outside diameter (OD), and a sidewall thickness (t); b) a plurality of production ports extending through the sidewall thickness (t) and coupling the inside diameter (ID) and the outside diameter (OD); and c) a fluid flow assembly positioned in each of the plurality of production ports, each fluid flow assembly including: i) a radially interior burst disc; and ii) a degradable fluid flow orifice positioned radially outside of the radially interior burst disk, the degradable fluid flow orifice configured to degrade over time after the radially interior burst disc has burst to increase a flow volume through the production port.

F. A method, the method including: 1) forming a wellbore through one or more subterranean formations; and 2) positioning production tubing having a production sub coupled thereto within the wellbore, the production sub including: a) a tubular having a length (l), an inside diameter (ID), an outside diameter (OD), and a sidewall thickness (t); b) a plurality of production ports extending through the sidewall thickness (t) and coupling the inside diameter (ID) and the outside diameter (OD); and c) a fluid flow assembly positioned in each of the plurality of production ports, each fluid flow assembly including: i) a radially interior burst disc; and ii) a degradable fluid flow orifice positioned radially outside of the radially interior burst disk, the degradable fluid flow orifice configured to degrade over time after the radially interior burst disc has burst to increase a flow volume through the production port.

Aspects A, B, C, D, E and F may have one or more of the following additional elements in combination: Element 1: wherein the scaling member is a dissolvable scaling member. Element 2: wherein the dissolvable sealing member comprises a Magnesium based alloy, an Aluminum based alloy, a (PGA) Polyglycolic acid polymer, a (PLA) Polylactic acid polymer, or a (PHBV) Poly hydroxybutyrate-co-Hydroxy valerate polymer. Element 3: wherein the chamber is a fluid tight chamber, the fluid tight chamber preventing the dissolvable sealing member from dissolving prior to the radially interior burst disc bursting. Element 4: wherein the radially interior burst disc is configured to have a higher ID burst rating and a lower OD burst rating. Element 5: wherein the radially exterior burst disc is configured to have a higher OD burst rating and a lower ID burst rating. Element 6: wherein the fluid flow assembly further includes a scaling member trap located in the chamber proximate the radially interior burst disc, the scaling member trap configured to prevent the sealing member from falling back into the tubular during one or more pressure cycles. Element 7: wherein the sealing member seat is part of housing located within the production port. Element 8: further including one or more sealing elements positioned between the housing and the production port. Element 9: wherein the plurality of production ports include a first set of radially spaced apart production ports and a second set of radially spaced apart production ports, the first and second sets axially offset from one another along the length (l). Element 10: wherein the production sub includes a first production port having a first fluid flow assembly therein and a second production port having a second fluid flow assembly therein. Element 11: further including applying a first pressure to the production sub, the first pressure bursting a first radially interior burst disc and a first radially exterior burst disc of the first fluid flow assembly, and then applying a second pressure to the production sub, the second pressure bursting a second radially interior burst disc and a second radially exterior burst disc of the second fluid flow assembly while a first sealing member of the first fluid flow assembly is seat against a first sealing member seat of the first fluid flow assembly. Element 12: wherein the first scaling member is a first dissolvable sealing member, and further including a second dissolvable scaling member located between the second radially interior burst disc and the second radially exterior burst disc. Element 13: further including dissolving the first dissolvable sealing member and the second dissolvable sealing member after bursting the second radially interior burst disc and the second radially exterior burst disc. Element 14: further including producing hydrocarbons from the subterranean formation, through the first and second production ports having the dissolved first and second sealing members, and into the tubular. Element 15: wherein the degradable fluid flow orifice is an erodible fluid flow orifice having a hardness less than a hardness of the tubular. Element 16: wherein the erodible fluid flow orifice comprises a low alloy steel, an Aluminum alloy, a Brass alloy, a Copper alloy, a Magnesium alloy, or an Iron-Carbon alloy. Element 17: wherein the degradable fluid flow orifice is an erodible fluid flow orifice having a hardness at least 20% less than a hardness of the tubular. Element 18: wherein the degradable fluid flow orifice is a dissolvable fluid flow orifice. Element 19: further including a dissolvable plug sealing the degradable fluid flow orifice. Element 20: wherein the dissolvable plug comprises a Magnesium based alloy, an Aluminum based alloy, a (PGA) Polyglycolic acid polymer, a (PLA) Polylactic acid polymer, or a (PHBV) Poly hydroxybutyrate-co-Hydroxy valerate polymer. Element 21: wherein the degradable fluid flow orifice is part of housing located within the production port. Element 22: further including one or more sealing elements positioned between the housing and the production port. Element 23: wherein the plurality of production ports include a first set of radially spaced apart production ports and a second set of radially spaced apart production ports, the first and second sets axially offset from one another along the length (l). Element 24: wherein the production sub includes a first production port having a first fluid flow assembly therein and a second production port having a second fluid flow assembly therein. Element 25: further including applying a first pressure to the production sub, the first pressure bursting a first radially interior burst disc of the first fluid flow assembly, and then applying a second pressure to the production sub, the second pressure bursting a second radially interior burst disc of the second fluid flow assembly while a first degradable fluid flow orifice of the first fluid flow assembly maintains a pressure differential across the inside diameter (ID) and the outside diameter (OD) of the tubular. Element 26: wherein the first degradable fluid flow orifice is a first erodible fluid flow orifice, and further including a second erodible fluid flow orifice located in the second production port. Element 27: further including fully eroding the first and second erodible fluid flow orifices after bursting the second radially interior burst disc. Element 28: further including producing hydrocarbons from the subterranean formation, through the first and second production ports having the eroded first and second erodible fluid flow orifices.

Those skilled in the art to which this application relates will appreciate that other and further additions, deletions, substitutions and modifications may be made to the described embodiments.

What is claimed is:

1. A production sub, comprising:

a tubular having a length (l), an inside diameter (ID), an outside diameter (OD), and a sidewall thickness (t);

a plurality of production ports extending through the sidewall thickness (t) and coupling the inside diameter (ID) and the outside diameter (OD); and a fluid flow assembly positioned in each of the plurality of production ports, each fluid flow assembly including:

a radially interior burst disc;

a radially exterior burst disc;

a sealing member positioned in a chamber created between the radially interior burst disc and the radially exterior burst disc; and a sealing member seat located in the chamber proximate the radially exterior burst disc, the sealing member configured to engage with the sealing member seat as fluid is pushing the sealing member radially outward.

2. The production sub as recited in claim 1, wherein the sealing member is a dissolvable sealing member.

3. The production sub as recited in claim 2, wherein the dissolvable sealing member comprises a Magnesium based alloy, an Aluminum based alloy, a (PGA) Polyglycolic acid polymer, a (PLA) Polylactic acid polymer, or a (PHBV) Poly hydroxybutyrate-co-Hydroxy valerate polymer.

4. The production sub as recited in claim 3, wherein the chamber is a fluid tight chamber, the fluid tight chamber preventing the dissolvable sealing member from dissolving prior to the radially interior burst disc bursting.

5. The production sub as recited in claim 1, wherein the radially interior burst disc is configured to have a higher ID burst rating and a lower OD burst rating.

6. The production sub as recited in claim 1, wherein the radially exterior burst disc is configured to have a higher OD burst rating and a lower ID burst rating.

7. The production sub as recited in claim 1, wherein the fluid flow assembly further includes a sealing member trap located in the chamber proximate the radially interior burst disc, the sealing member trap configured to prevent the sealing member from falling back into the tubular during one or more pressure cycles.

8. The production sub as recited in claim 1, wherein the sealing member seat is part of housing located within the production port.

9. The production sub as recited in claim 8, further including one or more sealing elements positioned between the housing and the production port.

10. The production sub as recited in claim 1, wherein each of the plurality of production ports include a first set of radially spaced apart production ports and a second set of radially spaced apart production ports, the first and second sets axially offset from one another along the length (l).

11. A well system, comprising:

a wellbore extending through one or more subterranean formations;

production tubing located within the wellbore;

a production sub coupled to the production tubing, the production sub including:

a tubular having a length (l), an inside diameter (ID), an outside diameter (OD), and a sidewall thickness (t);

a plurality of production ports extending through the sidewall thickness (t) and coupling the inside diameter (ID) and the outside diameter (OD); and a fluid flow assembly positioned in each of the plurality of production ports, each fluid flow assembly including:

a radially interior burst disc;

a radially exterior burst disc;

a sealing member positioned in a chamber created between the radially interior burst disc and the radially exterior burst disc; and a sealing member seat located in the chamber proximate the radially exterior burst disc, the sealing member configured to engage with the sealing member seat as fluid is pushing the sealing member radially outward.

12. The well system as recited in claim 11, wherein the sealing member is a dissolvable sealing member.

13. The well system as recited in claim 12, wherein the dissolvable sealing member comprises a Magnesium based alloy, an Aluminum based alloy, a (PGA) Polyglycolic acid polymer, a (PLA) Polylactic acid polymer, or a (PHBV) Poly hydroxybutyrate-co-Hydroxy valerate polymer.

14. The well system as recited in claim 13, wherein the chamber is a fluid tight chamber, the fluid tight chamber preventing the dissolvable sealing member from dissolving prior to the radially interior burst disc bursting.

15. The well system as recited in claim 11, wherein the radially interior burst disc is configured to have a higher ID burst rating and a lower OD burst rating.

16. The well system as recited in claim 11, wherein the radially exterior burst disc is configured to have a higher OD burst rating and a lower ID burst rating.

17. The well system as recited in claim 11, wherein the fluid flow assembly further includes a sealing member trap located in the chamber proximate the radially interior burst disc, the sealing member trap configured to prevent the sealing member from falling back into the tubular during one or more pressure cycles.

18. The well system as recited in claim 11, wherein the sealing member seat is part of housing located within the production port.

19. The well system as recited in claim 18, further including one or more sealing elements positioned between the housing and the production port.

20. The well system as recited in claim 11, wherein each of the plurality of production ports include a first set of radially spaced apart production ports and a second set of radially spaced apart production ports, the first and second sets axially offset from one another along the length (l).

21. A method, comprising:

forming a wellbore through one or more subterranean formations; and positioning production tubing having a production sub coupled thereto within the wellbore, the production sub including:

a tubular having a length (l), an inside diameter (ID), an outside diameter (OD), and a sidewall thickness (t);

a plurality of production ports extending through the sidewall thickness (t) and coupling the inside diameter (ID) and the outside diameter (OD); and a fluid flow assembly positioned in each of the plurality of production ports, each fluid flow assembly including:

a radially interior burst disc;

a radially exterior burst disc;

a sealing member positioned in a chamber created between the radially interior burst disc and the radially exterior burst disc; and a sealing member seat located in the chamber proximate the radially exterior burst disc, the sealing member configured to engage with the sealing member seat as fluid is pushing the sealing member radially outward.

22. The method as recited in claim 21, wherein the production sub includes a first production port having a first fluid flow assembly therein and a second production port having a second fluid flow assembly therein.

23. The method as recited in claim 22, further including applying a first pressure to the production sub, the first pressure bursting a first radially interior burst disc and a first radially exterior burst disc of the first fluid flow assembly, and then applying a second pressure to the production sub, the second pressure bursting a second radially interior burst disc and a second radially exterior burst disc of the second fluid flow assembly while a first sealing member of the first fluid flow assembly is seat against a first sealing member seat of the first fluid flow assembly.

24. The method as recited in claim 23, wherein the first sealing member is a first dissolvable sealing member, and further including a second dissolvable sealing member located between the second radially interior burst disc and the second radially exterior burst disc.

25. The method as recited in claim 24, further including dissolving the first dissolvable sealing member and the second dissolvable sealing member after bursting the second radially interior burst disc and the second radially exterior burst disc.

26. The method as recited in claim 25, further including producing hydrocarbons from the subterranean formation, through the first and second production ports having the dissolved first and second sealing members, and into the tubular.

* * * * *